US005749569A

United States Patent [19]

Atsumi et al.

[11] Patent Number: 5,749,569

[45] Date of Patent: May 12, 1998

[54] DOCUMENT FEEDING APPARATUS HAVING IMPROVED FORWARDING MEANS

[75] Inventors: Tomoyuki Atsumi; Yuusuke Morigami; Hirokazu Matsuo, all of Toyohashi, Japan

[73] Assignee: Minolta Camera Kabushiki Kaisha, Osaka, Japan

[21] Appl. No.: 260,949

[22] Filed: Jun. 16, 1994

Related U.S. Application Data

[62] Division of Ser. No. 135,730, Oct. 13, 1993, abandoned.

[30] Foreign Application Priority Data

| | | | |
|---|---|---|---|
| Oct. 15, 1992 | [JP] | Japan | 4-277482 |
| Oct. 15, 1992 | [JP] | Japan | 4-277483 |
| Oct. 15, 1992 | [JP] | Japan | 4-277484 |

[51] Int. Cl.[6] ..... B65H 5/00

[52] U.S. Cl. ..... 271/10.11; 271/118; 271/265.01; 271/258.01

[58] Field of Search ..... 271/10.01–10.03, 271/10.11, 10.09, 110, 118, 265.01, 258.01

[56] References Cited

U.S. PATENT DOCUMENTS

| | | | |
|---|---|---|---|
| 3,806,112 | 4/1974 | Melby et al. | 271/118 X |
| 4,052,054 | 10/1977 | Cardwell et al. . | |
| 4,436,298 | 3/1984 | Donner et al. | 271/118 X |
| 4,727,401 | 2/1988 | Partilla et al. . | |
| 4,771,319 | 9/1988 | Hamakawa . | |
| 4,831,413 | 5/1989 | Hamakawa . | |
| 4,912,518 | 3/1990 | Matsuo et al. . | |
| 4,914,472 | 4/1990 | Hamakawa . | |
| 4,958,198 | 9/1990 | Hamakawa . | |
| 5,005,055 | 4/1991 | Matsuo et al. . | |
| 5,006,904 | 4/1991 | Matsuo et al. . | |
| 5,010,371 | 4/1991 | Matsuo et al. . | |
| 5,077,577 | 12/1991 | Hamakawa . | |
| 5,124,758 | 6/1992 | Hamakawa . | |
| 5,196,896 | 3/1993 | Hamakawa . | |

FOREIGN PATENT DOCUMENTS

| | | | |
|---|---|---|---|
| 60-2942 | 1/1985 | Japan . | |
| 60-93463 | 5/1985 | Japan . | |
| 61-32836 | 2/1986 | Japan . | |
| 178336 | 8/1986 | Japan | 271/110 |
| 139821 | 6/1988 | Japan | 271/110 |
| 238240 | 10/1990 | Japan | 271/110 |

*Primary Examiner*—William E. Terrell
*Assistant Examiner*—Boris Miles
*Attorney, Agent, or Firm*—Burns, Doane, Swecker & Mathis, L.L.P.

[57] ABSTRACT

A sheet feeding apparatus has a forwarding device for successively forwarding a plurality of sheets accommodated in a state of stacked layer one by one. The forwarding device is movable between a sheet forwarding position where the forwarding device is brought in contact with the leading end of a sheet for forwarding the sheet and a retracted position where the forwarding device is separated away from the sheet. The apparatus includes a transport device for receiving a sheet forwarded by the forwarding device and transporting the sheet in a predetermined direction of transport. The apparatus also includes a control device for controlling a timing of movement of the forwarding device, wherein the control device forwards a sheet by positioning the forwarding device at a forwarding position and moves the forwarding device to a retracted position after the leading end of the sheet is forwarded by the forwarding device, and further start moving the forwarding device to the forwarding position for forwarding the following sheet before the rear end of the sheet previously forwarded passes through the forwarding device, and the forwarding device is positioned at the forwarding position after the rear end of the sheet previously forwarded has passed through the forwarding device.

5 Claims, 50 Drawing Sheets

Fig. 5
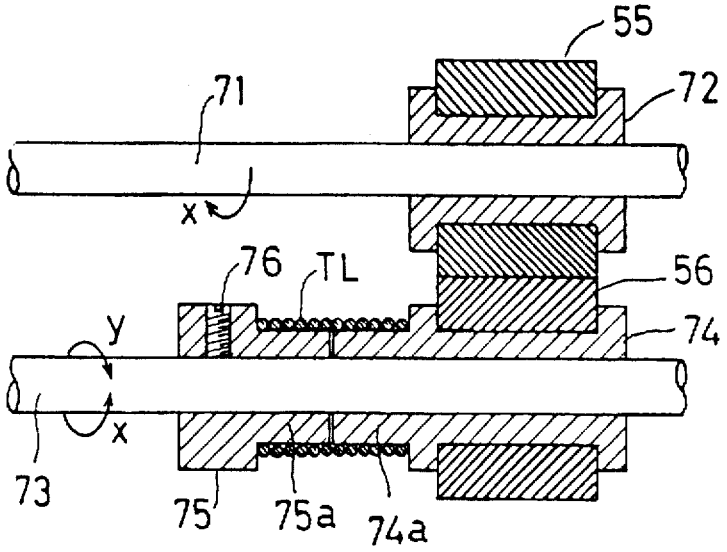
Fig.6(B)
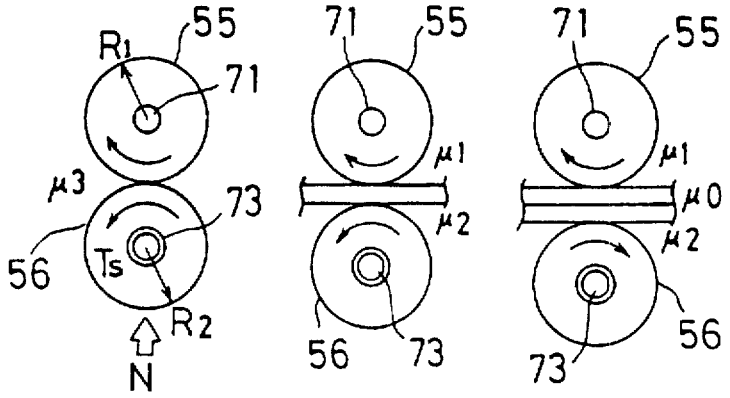
FIG.6(A) FIG.6(C)

51
D3
D2
D1
54
D4

D3
D2
54
55
D1
59a
56
58
SE12
D4

60
D3
D2
29
D4
SE14
P
D1

O
60
29
D4
D3
O'
D2
D1
54
SE14
58
SE13

51
D1
D2
D3
D4
54
55
SE12
53
56
58
59a
60
29
SE14
P
O

DOCUMENT FEEDING APPARATUS HAVING IMPROVED FORWARDING MEANS

This application is a divisional, of application Ser. No. 08/135,730, filed Oct. 13, 1993 now abandoned.

BACKGROUND OF THE INVENTION

1. Technical Field of the Invention

The present invention relates to a document feeding apparatus, and more particularly, to a document feeding apparatus for feeding a bunch of stacked documents in one direction by picking them up one by one.

2. Description of Related Art

In recent years, it has widely been practiced to construct a copying system in an electrophotographic copying machine by combining an automatic document feeder for the purpose of improving efficiency in a copying operation. Accompanied with a requirement for speeding up a copy sheet feeding process in the main body of a copying machine, a high-speed document feeding technology is desired for an automatic document feeder as well.

In a document feeding technology, there are extremely delicate and difficult problems in providing a document feeding mechanism for surely separating and feeding a bunch of stacked documents in a fixed direction one by one without having oblique movement of the sheets, and there is a limit in speeding up a document feeding operation. In order to solve the problems, it is arranged to provide a feeding means possessed of sheet registering function, for instance, a register roller, at downstream side in a document feeding direction of separating means wherein a sheet of original separated into one sheet is brought in contact with a nip section of a pair of rollers of the register roller to form a loop at the leading end portion of the sheet, and after a posture of the original is adjusted, the original is fed at a high speed accompanied with a start of rotation of the register roller.

When a document feeding is started at a high speed by the register roller, however, if a separating means provided at upstream side in a document feeding direction is not being driven, the separating means acts largely on the document feeding operation as a large load until an original passes through the separating means to cause to damage the original, and generate a noise in a moment when a loop at the leading end portion of the original is dissolved. In order to solve such inconveniences, it is proposed that the separating means needs to be rotationally driven even when the original is fed at a high speed by the register roller whereby the damage of originals and the loop dissolving noise may be reduced. However, the separation capability of the separating means is lowered, and it may cause to induce an accompanied document feeding with other document.

More particularly, the separating means is arranged to obstruct the advance of second and third originals which tend to be fed together with a first original when the first original is fed by a transport velocity (first velocity) at the time of a separation process. However, when the first original is fed by the register roller at a second velocity which is higher than the first velocity, second and third originals are also run into the separating means with the second velocity together with the first original. The separation capability of the separating means does not effectively act on the following original being fed with the second velocity, and it is likely that the following original slips out of the separating means.

In order to cope with a high-speed document feeding operation, there is developed a preliminary document feeding technology wherein when an original picked up from a tray is fed, the following original is immediately picked up and fed to a predetermined position to stand by for the next operation. In this case, pickup means is set at an original pressing position when the original is picked up, and after the original is registered, the pickup means is retracted to a pressure releasing position. Further, when a preceding original is transported with a start of rotation of the register roller, the pickup means is moved to the document pressing position at a timing that the rear end of the original is detected by a sensor so that the above-mentioned troubles of original damage and the accompanied document feeding with other document can be prevented since the rear end portion of the preceding original is not remained on the tray. However, if a time is wasted for starting the pickup means until the rear end of the preceding original passes through a detecting point of the sensor, a document feeding process for the following original is delayed. It further takes time for original exchange to obstruct a high-seed copying operation in the main body of copying machine.

There is also developed a 2-in-1 mode as a high-speed processing technology when a plurality of originals are copied in the copying system. In the 2-in-1 mode, two sheets of originals are fed to an exposure position side by side on a platen glass, and images of two sheets of the originals are formed simultaneously on one copy sheet. In this 2-in-1 mode, the number of copy sheets can be decreased to half relative to the number of originals.

In the 2-in-1 mode, it is required to make a gap zero between two sheets of originals placed at an exposure position since stains of a transport belt is copied onto a copy sheet if there is a gap between the originals. Heretofore, it has been practiced to provide the register roller just in front of the platen glass, and under a state that the rear end of a preceding original is positioned at a nip section of the register roller, the original is temporarily stopped, and after the leading end of a succeeding original is brought in contact with the nip section of the register roller, both originals are simultaneously transported onto the platen glass side by side. In such apparatus, however, it is difficult to solve a problem of the appearance of a little gap between two sheets of originals by the width of the nip section of the register roller.

There is also introduced a type of apparatus wherein a preceding original is once transported onto a platen glass, and at the same time, a succeeding original is transported to the entrance to the platen glass. Then, the preceding original is backed to adjust the rear end of the original to the leading end of the succeeding original, and after they are transported simultaneously, both originals are placed side by side on the platen glass. However, it will take a longer time for an original exchange process since the original has to be switched back, and eventually copying efficiency is lowered.

SUMMARY OF THE INVENTION

A primary object of the present invention is to provide a document feeding apparatus which is capable of coping with a requirement for transporting copy sheets at a high speed in the main body of a copying machine in the case, for instance, when a copying system which is combined with the main body of a copying machine is adapted.

Another object of the present invention is to provide a document feeding apparatus which is capable of starting a document feeding process at an early stage without damaging documents and interfering document feeding operations.

A further object of the present invention is to provide a document feeding apparatus whose document separating capability is not lowered even when documents are fed at a high speed.

A still further object of the present invention is to provide a document feeding apparatus which is capable of quickly setting two sheets of originals at an exposure position on a platen glass without having any gap between two sheet of originals in 2-in-1 mode.

These and other objects and features of the present invention will become more apparent from the following description taken in conjunction with the accompanying drawings which illustrate specific embodiments of the invention.

BRIEF DESCRIPTION OF THE DRAWINGS

FIG. 5 is a cross-sectional view showing separating rollers.

FIGS. 6(A)–6(C) are explanatory views showing a state of contact of the separating rollers.

DESCRIPTION OF THE PREFERRED EMBODIMENT

An embodiment of a document feeding apparatus related to the present invention will be described hereinafter referring to accompanying drawings.

Figure 1:
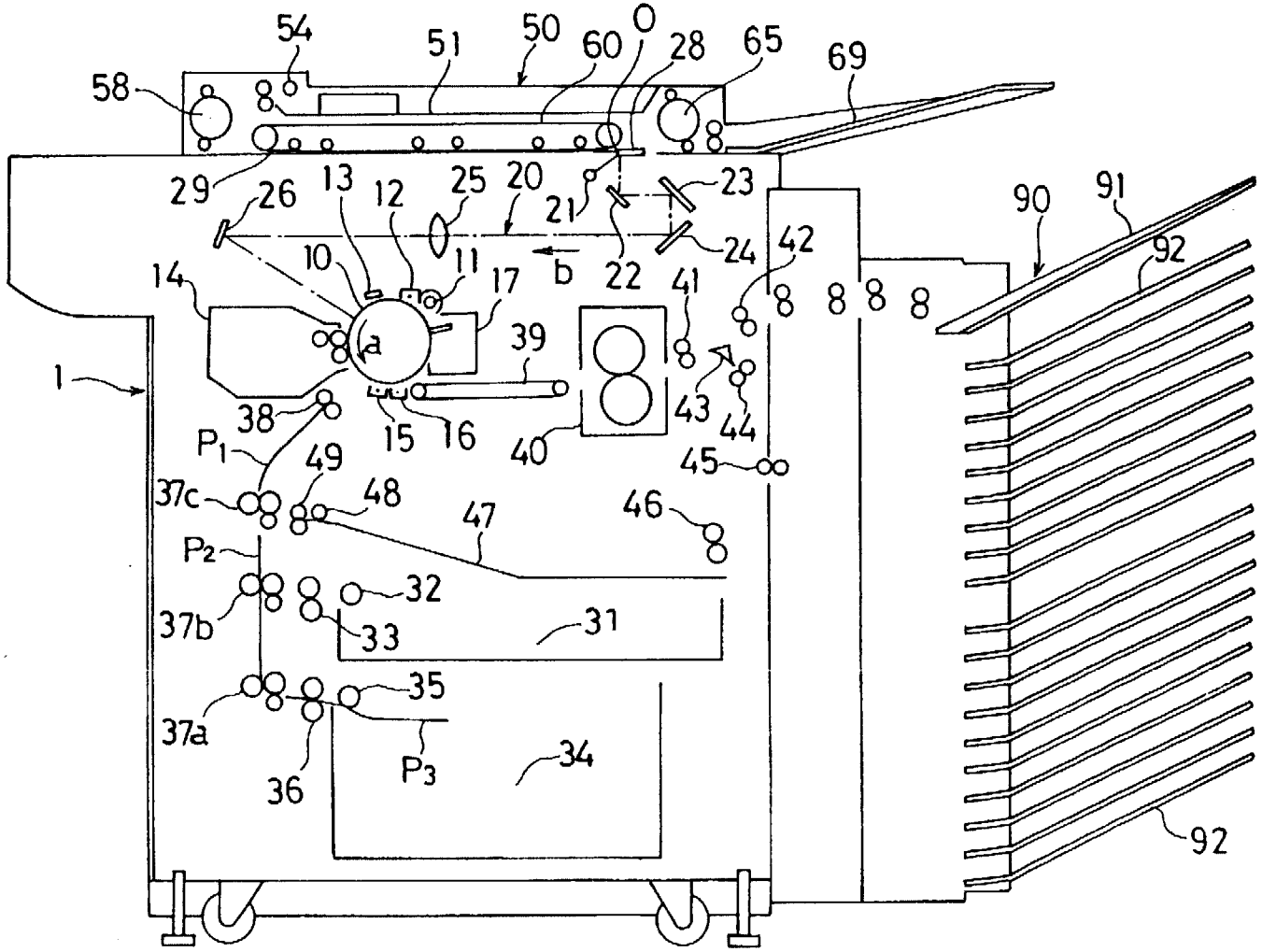
FIG. 1 is a schematic structural view showing an automatic document feeder (ADF) and the main body of a copying machine in an embodiment of the present invention.

FIG. 1 shows an automatic document feeder 50 (hereinafter called as ADF) which is one of embodiments of the present invention, the main body of a copying machine 1 and a sorter 90.

Substantially at the central portion of the main body of the copying machine 1, a photoconductive drum 10 is rotatably disposed to be driven at a predetermined circumferential speed v in the direction of arrow a. Around the photoconductive drum 10, there are disposed along the direction of rotation of the drum a main eraser 11, charger 12, suberaser 13, magnetic brush type developing unit 14, transfer charger 15, separation charger 16 and blade type cleaner 17. Above the photoconductive drum 10, there is provided an optical system 20.

The photoconductive drum is provided with photosensitive layer on the surface thereof which is known well, and accompanied with a rotation in the direction of arrow a, electricity is charged or discharged by the main eraser 11, charger 12 and suberaser 13, an image of original placed on a platen glass 29 is exposed by the optical system 20. An electrostatic latent image formed on the photoconductive drum 10 by the exposure is then developed into a toner image by the developing unit 14.

The optical system 20 is provided immediately under the platen glass 29 to scan an image of original placed on the platen glass 29 on the surface of the photoconductive drum 10. More particularly, when the image is scanned, an exposure lamp 21 and a first mirror 22 are unitedly moved in the direction of arrow b at a velocity of v/m (where m is a copying magnification) relative to a circumferential speed v (irrespective of equal magnification or variable magnification) of the photoconductive drum 10. At the same time, a second mirror 23 and a third mirror 24 are moved at a velocity of v/2 m in the direction of arrow b. When a copying magnification is changed, a projection lens 25 is moved on an optical axis and a forth mirror 26 is swingably moved to rectify an optical path length.

Copy sheets are accommodated in an upper feed section 31 and a lower feed section 34, and the sheets are fed one by one from either one of the feed sections based on the selection made by an operator. In each one of the feed sections 31, 34, there are provided feed rollers 32, 35, and separating rollers 33, 36, comprised of a regular roller and a reversing roller.

A sheet fed from the upper feed section 31 is forwarded through transport rollers **37*b*, 37*c*, to a timing roller 38 disposed immediately before an image transfer section. A sheet fed from the lower feed section 34 is forwarded to the timing roller 38 through transport rollers 37*a*, 37*b*, 37*c***.

Immediately above the upper feed section 31, there is provided an intermediate tray 47 for processing both-sided/composite copying operation. A sheet fed from the intermediate tray 47 again by a refeed roller 48 and separated by a separating roller 49 is forwarded to the timing roller 38 through the transport roller **37*c*. The sheet forwarded to the timing roller 38 is temporarily stopped thereat, and is then forwarded to a transfer section when the timing roller 38 is turned on synchronously with a formation of an image on the photoconductive drum 10. The sheet is brought in close contact with the photoconductive drum 10 in the transfer section, and a toner image is transferred by corona discharge from the transfer charger 15. The sheet is then separated from the photoconductive drum 10 by corona discharge from the separation charger 16 and the inflexibility of the sheet itself. Thereafter, the sheet is forwarded into a fixing unit 40 through a transport belt 39, and toner is fixed to be accommodated in the sorter 90 through transport rollers 41, 42**.

On the other hand, the photoconductive drum 10 keeps its rotation in the direction of the arrow a even after the transfer process, and a remained toner is removed by the cleaner 17. A remained electric charge is also erased by the main eraser 11 to be ready for the next copying process.

In a composite copy mode, a sheet on which an image of odd-numbered original is transferred is directed downward in a feeding direction by a changeover claw 43, and is accommodated on the intermediate tray 47 through transport rollers 44, 45, 46. The sheet is thereafter fed again from the intermediate tray 47 for both-sided/composite copying operation on an image of original of even-numbered original.

In a double-sided copy mode, a sheet is once transported to the entrance to the sorter 90, and is then switched back by reversing the transport roller. Feeding direction of the sheet is altered to downward by the changeover claw 43, and the sheet is accommodated on the intermediate tray 47 through the transport rollers 44, 45, 46. Thereafter, the sheet is fed again from the intermediate tray 47 for both-sided/composite copying process to copy an image of even-numbered original.

In the main body of a copying machine 1, a copying operation is started. When a first copy sheet is waiting for a copying process at immediately before the timing roller 38, a preliminary feeding process is conducted wherein not only a second sheet but third sheet are preliminarily fed to a feed path.

In the case of a feeding process from the lower feed section 34, for instance, a second copy sheet P2 is forwarded to the feed path following a first copy sheet P1, and further, a third sheet P3 is also forwarded to a position immediately before the transport roller **37*a*. Such a feeding process is performed in a single-sided copy mode as well wherein the ADF50** is utilized in order to improve efficiency for a high-speed copying operation.

The sorter 90 is provided with a non-sorting tray 91 and a sorting tray 92 composed of 20 stages. Since the sorter of this type is known well, detailed description will be omitted.

Now, description will be made on the ADF50.

Figure 2:
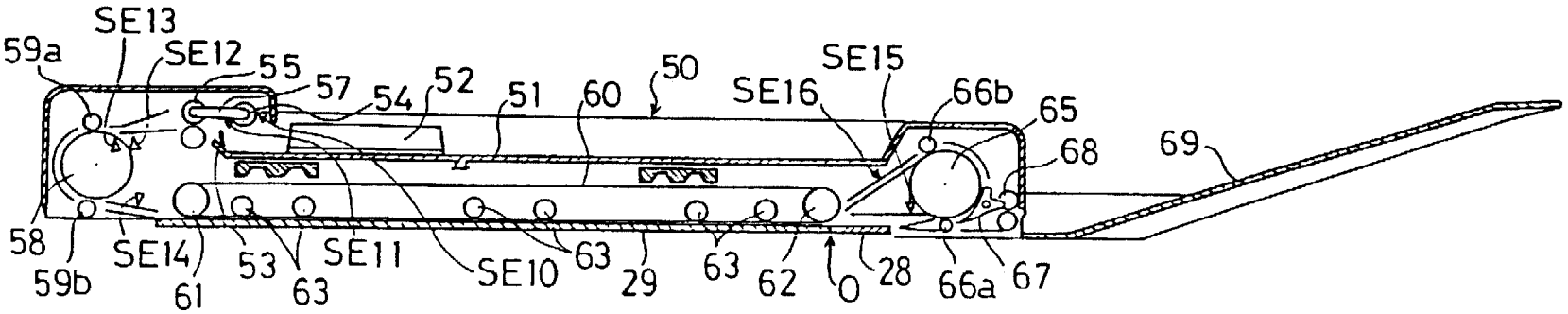
FIG. 2 is a cross-sectional view showing an internal structure of the ADF.

FIG. 2 schematically shows a structure of the ADF50. The ADF50 roughly comprises an original tray 51, pickup roller 54, register roller 58, transport belt 60, reversing/discharge roller 65 and discharge tray 69. The ADF50 is placed on the upper surface of the main body of the copying machine in a manner to position the transport belt 60 above the platen glass 29 so that the platen glass 29 can be opened with a hinge metal (not shown) when an operator sets an original. The opening and closing of the ADF50 is detected by an unillustrated magnetic sensor. Upon detecting a state by the sensor that the ADF50 is accurately closed, the ADF50 becomes ready for starting an operation.

The original tray 51 is provided with a pair of side regulating plates 52 and a leading-end stopper 53. An original is placed on the tray 51 with a first page faced upward. The leading-end stopper 53 is retracted from a regulating position swinging downward when an original is fed. The pickup roller 54 is attached to the leading end of a lever 57 which is rotatable around the shaft of the regular separating roller 55 as a fulcrum, and presses the upper surface of the original descending together with the lever 57 when an original is fed. The reverse separating roller 56 elastically presses the regular separating roller 55. In order to improve the separability of originals, the pressing force is arranged to be changed over in two stages by an electromagnetic solenoid SL (refer to FIGS. 3 and 5) whose will be described in detail hereinafter.

The register roller 58 is provided with pinch rollers 59*a*, 59*b* above and below. The leading edge of an original forwarded thereto is once positioned at a nip section between the pinch roller 59*a*, and then, the original is transported to the entrance section to the platen glass 29 by reversing the original. The transport belt 60 is endlessly stretched between a driving roller 62 and a driven roller 61 to cover the whole surface of the platen glass 29. Inside the transport belt 60, a multiplicity of backup rollers 63 are rotatably disposed in order to bring the surface of the belt 60 in contact with the platen glass 29 at a fixed pressure. Generally, the transport belt 60 is rotationally driven in the direction of arrow c, and the original is stopped at an exposure standard position O which is a boundary line between a scale 28 and the platen glass 29 adjusting the leading end of the original thereto.

Now, description will be made on original feeding, transportation, suspension, and discharge processes.

For stopping an original document at an exposure standard position O, there are two methods of scale mode and pulse control mode. In the scale mode, the leading end of the scale 28 is projected from the surface of the platen glass 29 to forcibly stop an original transported thereto by the transport belt 60 by bringing the leading end of the original in contact with the scale 28. In the pulse control mode, the scale 28 is retracted to the under surface of the platen glass 29, and the amount of transport of an original is counted based on the rotational frequency of a driving motor, and the rotation of the transport belt 60 is stopped to cause the leading end of the original to reach the exposure standard point O. In the present ADF50, the pulse control mode is adopted.

Reverse/discharge roller 65 is provided with pinch rollers 66*a*, 66*b* above and below, and is also provided with a changeover claw 67 for changing over a feed path in order to reverse a double-sided original at the periphery of the reverse/discharge roller 65. More particularly, when an original is reversed, the changeover claw 67 is positioned away from the surface of the roller 65 as shown in the FIG. 2 to guide the original discharged from the platen glass 29 to the outer periphery of the roller 65. The original is reversed around the roller 65, and is returned onto the platen glass 29 again. At this stage, the transport belt 60 is rotationally driven in the direction opposite to the arrow c. On the other hand, when the original is discharged, the leading edge of the changeover claw 67 is brought in contact with the outer periphery of the roller 65, and the original is guided by the changeover claw 67 to be discharged onto the tray 69 through a discharge roller 68.

Figure 15:
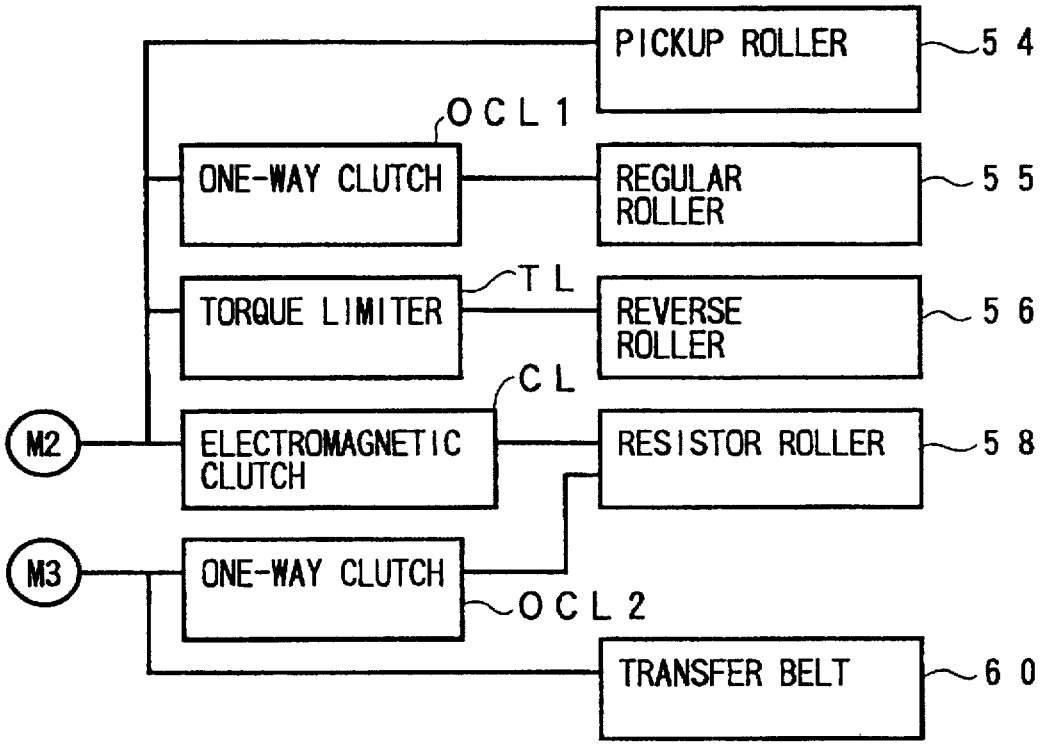
FIG. 15 is a block diagram showing a driving system.
Figure 17:
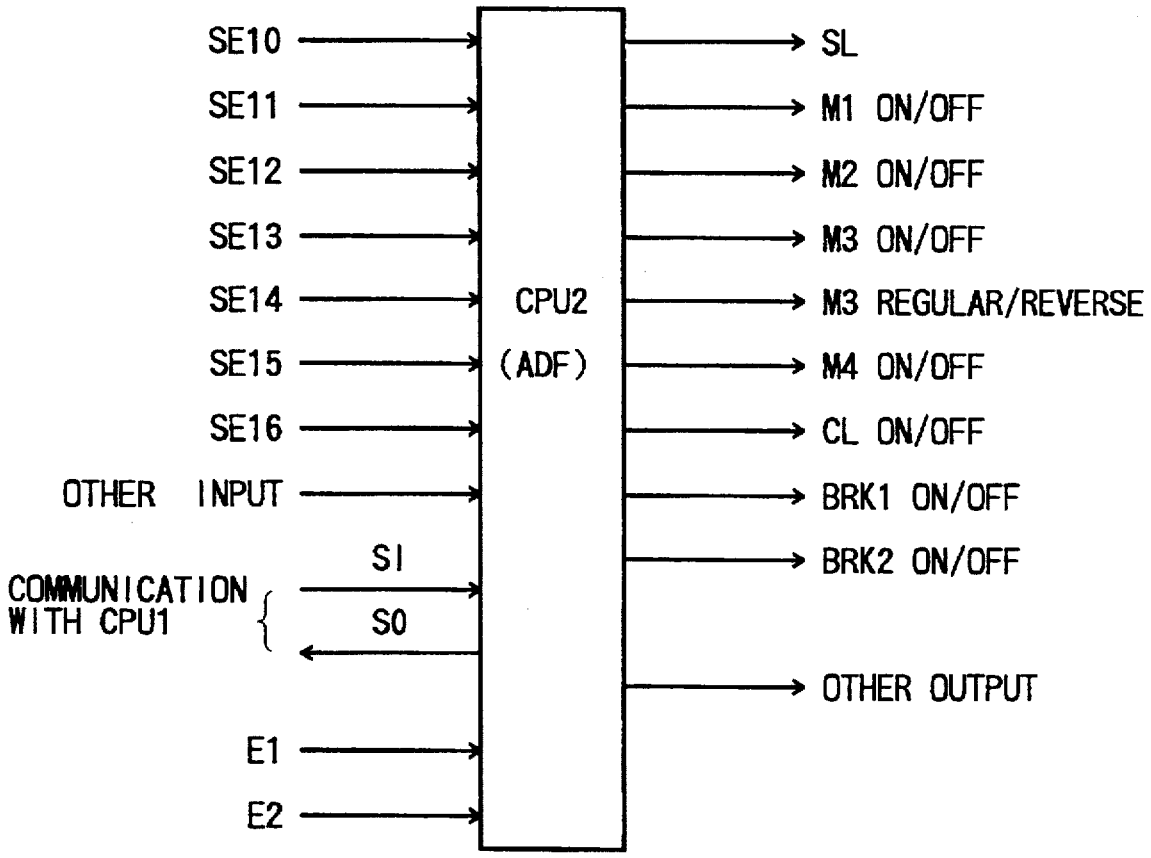
FIG. 17 is a block diagram showing a CPU2 which controls an ADF.

The ADF50 is driven and controlled by a variety of motors, clutches and sensors as shown in FIGS. 15 and 17. More particularly, the pickup roller 54 is elevated by a cam (not shown) which is rotationally driven by a pickup motor M1, and a descending position is detected by a pickup sensor SE10 which is turned on and off by a notch of the cam.

As shown in FIG. 15, the pickup roller 54 and separating rollers 55, 56, are rotationally driven by a feed motor M2, while the transport belt 60 is driven by a main motor M3 which can be rotated reversely. Between the feed motor M2 and regular separating roller 55, there is provided a one-way clutch OCL1, and between the motor M2 and the reverse separating roller 56, there is provided a torque limiter TL. The reverse/discharge roller 65 and discharge roller 68 are rotationally driven by a reverse/discharge motor M4. The register roller 58 is rotationally driven by the feed motor M2 by turning of an electromagnetic clutch CL when an original is fed. When an original is transported by the transport belt 60, the electromagnetic clutch CL is turned off and is rotationally driven by the main motor M3.

Between the main motor M3 and register roller 58, there is provided a one-way clutch OCL2, and only when the motor M3 is rotated regularly, the register roller 58 is rotated. It is arranged not to transmit a rotational force when the motor M3 is reversely rotated. An electromagnetic brake BRK1 is attached to a shaft of the register roller 58, and to the shaft of the driving roller 62 of the transport belt 60, an electromagnetic brake BRK2 is attached respectively so that unnecessary rotation of the register roller 58 and transport belt 60 is prevented.

To each one of the motors M2, M3, encoders E2, E3 which generate rotational pulse signal are attached to detect rotational frequency of the motors, and the pulse signal is inputted into microcomputer CPU2. The pulse signal is used for detecting the length of an original and controlling a position where the original is stopped.

In the ADF50, there are provided detecting sensors to detect the following original. An empty sensor SE11 is disposed adjacent to the pickup roller 54 to detect the existence of original on the tray 51. A register sensor SE12 is disposed immediately before the register roller 58 to detect an original forwarded from the tray 51. A width sensor SE13 is disposed on the side of the sensor SE12 substantially at the same position to detect the size of an original in lateral direction. A timing sensor SE is disposed at the entrance section to the platen glass 29 to standardize transport control of an original and also to detect the length of an original. A discharge sensor SE15 is arranged to detect an original discharged from the platen glass 29 , and a sensor SE16 detects an original reversed by the reverse/discharge roller 65.

Description will be made on the separating mechanism.

Figure 3:
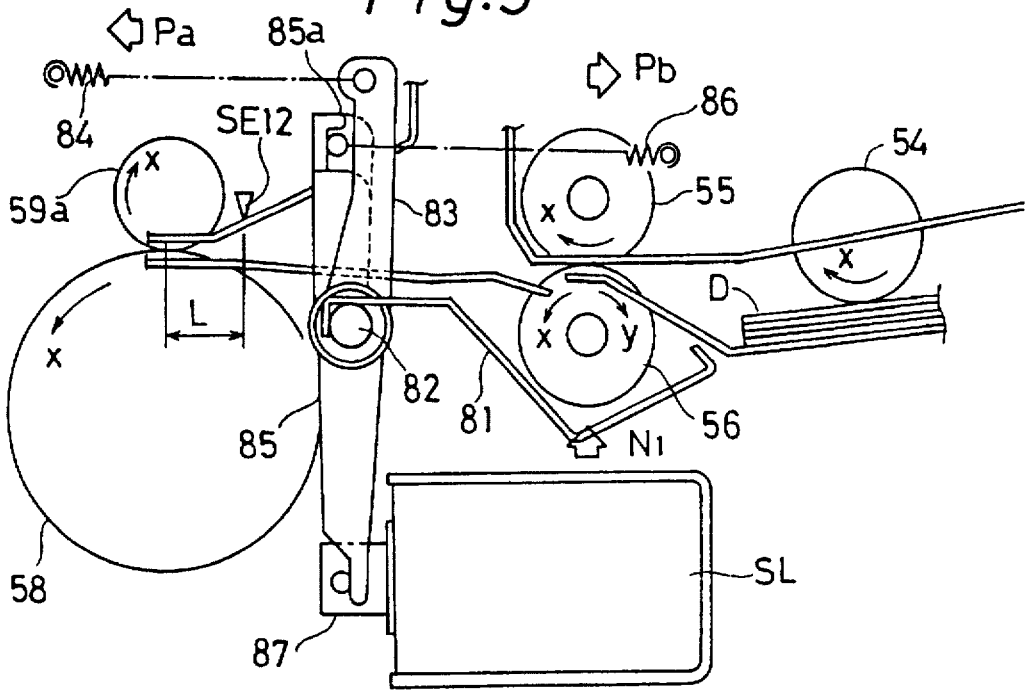
FIG. 3 is a front view showing an original separating mechanism before an original is registered.

As illustrated in FIG. 3, an original D is fed to the left. A rotating direction for conveying an original is designated as x, and a rotating direction for forcing back the original is designated as y respectively. The pickup roller 54 is rotationally driven at a circumferential speed $v_1$, in the direction of x. The regular separating roller 55 is rotationally driven at a circumferential speed $v_1$, in the direction of x. On the other hand, the reverse separating roller 56 is rotationally driven in the direction of y. The register roller 58 is rotationally driven at a circumferential speed of $v_2$ ($V_2>V_1$) in the direction of x, and accompanied with the driving, the pinch roller 59*a* is rotated in the direction of x.

If a frictional force between originals is designated as $\mu_0$, a frictional force between a sheet and the separating roller 55 is $\mu_1$, and a frictional force between the sheet and the reverse separating roller 56 is $\mu_2$, respectively, a following equation is set, $\mu_1>\mu_2>\mu_0$. Accordingly, when a plurality of originals exist between the rollers 55 and 56, the original on the uppermost is conveyed to downstream side at a velocity of $v_1$ with a rotation of the separating roller 55 in the direction of x, and originals on and after a second sheet are forced back to upstream side.

As shown in FIG. 5, the separating roller 55 is attached to a shaft 71 through a holder 72, and is rotationally driven by the feed motor M2 at a circumferential speed $v_1$ in the direction of x. One-way clutch OCL1 is also provided with the roller 55 and motor M2. When an original is conveyed by the register roller 58 at the high speed of $v_2$, the one-way clutch OCL1 allows the separating roller 55 to be rotated at a velocity $V_2$ accompanied with the transportation of the original.

The reverse separating roller 56 is fixed on a holder 74, and the holder 74 is rotatably fixed on a shaft 73 in the direction either x or y. To the shaft 73, a driving holder 75 is fixed with a screw 76 adjacent to the holder 74. A coil spring which functions as a torque limiter TL is pressed in contact and wound around boss sections 74*a*, 75*a*, of the holders 74 and 75. One end of the torque limiter TL is connected to the driving holder 75, and when the holder 75 is rotated with the shaft 73 in the direction of y, the torque limiter TL is wound in the direction to tighten the boss section 74*a* of the holder 74. With a torque of Ts at this stage, the reverse separating roller 56 is rotationally driven in the direction of y. When the reverse separating roller 56 is in direct contact with the regular separating roller 55, or they are in contact with each other through a sheet of original and receive a force in the direction of x at a velocity of $v_1$ or $v_2$, if a torque is set larger than a torque Ts3 of the torque limiter TL, the reverse separating roller 56 is rotationally driven in the direction of x. However, when a second, and third original enter into the gap between rollers 55 and 56, the torque which the reverse separating roller 56 receives is less than the torque Ts, so that the rotation of the roller 56 is changed over to a rotation in the direction of y to force back the second and third originals toward upstream side.

Description will now be made on a pressing force between the separating rollers 55 and 56, and given functions.

In the present embodiment, a pressing force $N_2$ when an original is conveyed by the register roller 58 at a velocity $V_2$ is set lower than a pressing force $N_1$ when an original is transported by the regular separating roller 55 at a velocity of $v_1$ whereby separation capability is not lowered at the velocity of V2 on which description will be made hereinafter.

Figure 4:
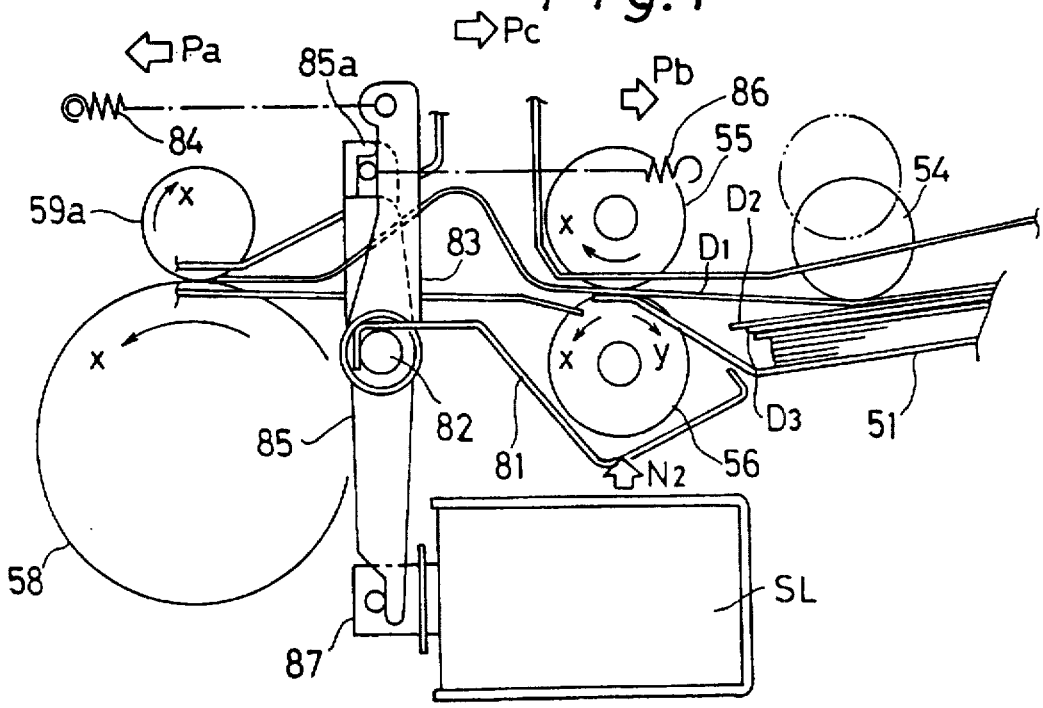
FIG. 4 is a front view showing an original separating mechanism after an original is registered.

FIG. 3 shows a state of $N_1$ when a pressing force is large, and FIG. 4 shows a state of $N_2$ when a pressing force is small. More particularly, the reverse separating roller 56 is supported by a holding plate 81, and the base of the holding plate 81 is unitedly connected with a lever 83 through a rotatable shaft 82. At the upper end of the lever 83, a coil spring 84 is connected to energize the lever 83 with a spring force Pa counterclockwise. On the other hand, a regulating lever 85 is rotatably attached to the shaft 82. The lower end of the regulating lever 85 is connected to a plunger 87 of electromagnetic solenoid SL, and the upper end is positioned adjacent to the side of said lever 83 and connected with a coil spring 86. The coil spring 86 energizes the regulating lever 85 clockwise with a spring force Pb.

With such a construction as described above, when the electromagnetic solenoid SL is turned on (refer to FIG. 3), the plunger 87 is pulled in, and the regulating lever 85 is moved counterclockwise against a spring force Pb of the coil spring 86. At this stage, the upper protrusion 85*a* of the regulating lever 85 is positioned away from the side of the lever 83, and the lever 83 receives a spring force Pa of the coil spring 84. Based on the spring force Pa, the reverse separating roller 56 is pressed on the regular separating roller 55 with a force $N_1$.

On the other hand, when the electromagnetic solenoid SL is turned off (refer to FIG. 4), the plunger 87 is projected, and the regulating lever 85 is rotated clockwise with a spring force Pb of the coil spring 86. The spring force Pb is set larger than Pa, and the upper protrusion 85*a* of the regulating lever 85 presses the side of the lever 83 so that the lever 83 is rotated clockwise with a spring force Pc (Pb–Pa). The clockwise rotation of the lever 83 weakens a pressing force of the reverse separating roller 56 against the separating roller 55. A pressing force $N_2$ at this stage is smaller than a pressing force $N_1$ when the electromagnetic solenoid SL is turned on.

Description will be made on an original feeding operation.

When an original D is placed on the tray 51 and a copying start signal is transmitted, the pickup roller 54 is brought down to press the original D. Then, the feed motor M2 is turned on, and the pickup roller 54, and the regular separating roller 55 is rotationally driven in the direction of x, while the reverse separating roller 56 is rotationally driven in the direction of y. At the same time, the electromagnetic solenoid SL is turned on, and the regulating lever 85 releases a control on the lever 83. Receiving a spring force Pa by the coil spring 84, the reverse separating roller 56 is pressed in contact with the regular separating roller 55 with a force of $N_1$.

When an original is not fed into a gap between the rollers 55 and 56, the reverse separating roller 56 is rotationally driven in the direction of x since a driving force receiving from the regular separating roller 55 which is rotated in the direction of x at a circumferential speed $v_1$ is larger than torque Ts of the torque limiter TL. When a sheet of original is fed into a gap between the rollers 55 and 56, the original is conveyed to downstream side at a velocity of $v_1$ by the regular separating roller 55. At this stage, the reverse separating roller 56 receives a driving force in the direction of x through a sheet of original. The driving force at this stage is larger than a torque Ts of the torque limiter TL, and the rotation in the direction of x is maintained. When a second and third originals are fed together into a gap between rollers 55 and 56, a driving force the reverse separating roller 56 receives in the direction of x through a plurality of originals is decreased than the torque Ts, and the reverse separating roller 56 is immediately changed over to the rotation in the direction of y. With this rotation, the second and third originals are forced back to the upstream side, and only an original (first original) placed on the uppermost is surely separated and conveyed to the nip section between the register roller 58 and pinch roller 59*a*.

At this stage, the electromagnetic clutch CL is turned off and a driving force from the feed motor M2 is not transmitted to the register roller 58, and by turning on the electromagnetic brake BRK1, the roller is locked. The leading end of an original separated into one sheet is brought in contact with the nip section between the register roller 58 and pinch roller 59*a*, and a loop is formed on the leading end portion (refer to FIG. 4). After the leading end of the original is detected by the register sensor SE12, the feed motor M2 is once turned off for a fixed time which is counted by a timer T102. The timer T102 is set a little longer than the time the original is conveyed at a velocity of $v_1$ for a distance L (refer to FIG. 3) from a detecting point by the SE12 to the nip section of the rollers 58 and 59*a* during which period of time a loop is formed on the leading end portion of the original to correct an oblique movement.

Then, the electromagnetic brake BRK1 relative to the register roller 58 is turned off, and the feed motor M2 is turned on whereby the register roller 58 is rotationally driven in the direction of x at a circumferential speed $v_2$ (larger value than $v_1$), and the pickup roller 54, separating rollers 55 and 56 respectively are rotationally driven again. Synchronously with a timing that the feed motor M2 is turned on, the electromagnetic solenoid SL is turned off, and the lever 83 is controlled by the regulating lever 85 to weaken a pressing force of the reverse separating roller 56 to a pressing force $N_2$ relative to the regular separating roller 55 (refer to FIG. 4).

Under such a state, a first original D1 being registered in the nip section between the rollers 58 and 59*a* is conveyed at a velocity of $v_2$ with rotation of the register roller 58. At this stage, the pickup roller 54 is moved upward to release a pressed contact with the original. The regular separating roller 55 is given a driving force from the original D1 of a velocity $v_2$ which is higher than $v_1$ in the direction of x, and with an action of the one-way clutch OCL1, the roller 55 is rotated at a velocity of $v_2$ in the direction of x. The reverse separating roller 56 is also given a driving force of a velocity $v_2$ from the original D1 in the direction of x. Under the relationship between the driving force and the torque Ts of the torque limiter TL, the reverse separating roller 56 is either rotationally driven in the direction of x, or stopped, or reversely rotated in the direction of y.

Since the pressing force $N_2$ is set smaller than $N_1$, a driving force which is received from the original D1 is not so large. Accordingly, even if a second original D2 is fed into the gap between the rollers 55 and 56 together with the original D1, a driving force which is received from the second original D2 is smaller than torque T3. Even if the reverse separating roller 56 is rotationally driven in the direction of x, the roller is immediately changed over to a reverse rotation in the direction of y to force back the original D2 toward upstream side. Even when the original D1 is conveyed at a velocity of $v_2$, if a larger pressing force $N_1$ is acted, a changeover of the reserve separating roller 56 for reverse rotation is delayed, and it may cause a problem that the leading end portion of the original D2 passes through the gap between the rollers 55 and 56 during the delayed period (decrease in separation capability). Further, when a third original D3 is fed into the gap between the rollers 55 and 56, the second original D2 is further conveyed during the reverse separating roller 56 forces back the third original D3, and the second original D2 is conveyed to downstream side together with the first original D1 by the register roller 58. This is an example when an accompanied feeding is generated.

Such an accompanied feeding is remarkably observed when a transport velocity $v_2$ by the register roller 58 is set higher than a transport velocity $v_1$ by the separating roller 55 to meet a requirement for a high-speed feeding. In the present embodiment, the decrease in separation capability by the reverse separating roller 56 is prevented by weakening a pressing force from $N_1$ to $N_2$.

When a transport operation is restarted for a separated original by the register roller 58, simultaneously with a timing that the register roller 58 is driven, the separating rollers 55 and 56 are also driven. If the separating rollers 55 and 56 are stopped when a transport operation is restarted, a loop formed on the leading end portion of original is instantly dissolved by a transporting force of a velocity $v_2$, and a big noise is generated when the loop is dissolved. Moreover, it may cause to damage an image plane of original. However, since the separating rollers 55 and 56 are driven simultaneously with a timing the register roller 58 is driven, not only an accompanied feeding is prevented but a loop is gradually dissolved eliminating loop dissolving noise and the damage of originals. The time for starting the rotation of the rollers 55 and 56 again may be set at a time at least when a loop at the leading end portion of an original is dissolved. It may, however, be preferable to set the time longer than a time a loop is dissolved if a preventive function for an accompanied feeding is considered.

Description will be made hereinafter on the relationship between pressing force of the separating rollers 55 and 56 and torque of the torque limiter TL.

As shown in FIG. 6, assume a frictional force between sheets as $\mu_0$, frictional force between a sheet and the separating roller 55 $\mu_1$, frictional force between a sheet and the reverse separating roller 56 $\mu_2$, frictional force between the rollers 55 and 56 $\mu_3$, pressing force between the rollers 55 and 56 N(g), torque of the torque limiter TL Ts (g-cm), diameter of the separating roller 55 $R_1$ (cm), diameter of the reverse separating roller 56 $R_2$ (cm), respectively.

The force which act on the reverse separating roller 56 are the following two forces.

Fa: Reversely forced driving force from the shaft 73, and

Fb: Regular driving force from the regular separating roller 55.

As illustrated in (A), (B) and (C) in FIG. 6, the regular driving force Fb may be classified as follows:

(A) $Fb_1$: Sheet does not exist between the rollers.

(B) $Fb_2$: One sheet exists between the rollers.

(C) $Fb_3$: More than two sheets exist between the rollers.

Depending on the above three classified conditions and a kind of sheet, the regular driving force Fb is varied. On the other hand, the reversely forced driving force Fa is always constant as long as the reverse torque Ts is constant. The following equations are accordingly established.

$$(A)\ Fb_1=\mu_3 N \quad (1)$$

$$(B)\ Fb_2=\mu_2 N \quad (2)$$

$$(C)\ Fb_3=\mu_0 N \quad (3)$$

A regular torque Tf (g-cm) which is given to the reverse separating roller 56 from the regular separating roller 55 is, $$(A)\ Tf_1=Fb_1R_2=\mu_3 NR_2 \quad (4)$$

$$(B)\ Tf_2=Fb_2R_2=\mu_2 NR_2 \quad (5)$$

$$(C)\ Tf_3=Fb_3R_2=\mu_2 NR_2 \quad (6)$$

On the other hand, a reverse torque Ts is constant in either one of the cases of (A), (B) and (C).

$$Ts:\text{const} \tag{7}$$

In other words, the reverse separating roller 56 is reversely rotated at Ts>Tf, and is regularly rotated at Ts<Tf. Practically, however, the reverse separating roller 56 for generating inertia torque Tα and friction loss Tβ is, $$Ts>Tf+T\alpha+T\beta:\text{reverse rotation}$$

$$Ts<Tf+T\alpha+T\beta:\text{regular rotation}$$

The friction loss Tβ is substantially constant, however, inertia torque Tα is proportional to a sheet transport speed v.

Now, consideration is given to conditions for surely separating sheets and giving sufficient sheet transporting force.

(A) When sheet does not exist.

When sheet does not exist, the rollers 55 and 56 are brought in direct contact with each other as shown by (A) in FIG. 6, and the reverse separating roller 56 need to be rotated regularly. A condition is expressed by the following equation (8);

$$\mu_3 N>Ts/R_2 \tag{8}$$

At this stage, if the reverse separating roller 56 is rotated reversely, a friction force which is generated between the rollers 55 and 56 becomes large to eventually shorten their lives. Further, if a sheet run into a gap between the rollers 55 and 56, it may possibly be caught in the reverse separating roller 56. It is, therefore, required to satisfy the equation (8).

(B) When one sheet does exist.

As shown by (B) in FIG. 6, when a sheet exists between the rollers 55 and 56, the reverse separating roller 56 may be rotated either regularly or reversely, and a condition is expressed as follows.

(B1) When reverse separating roller is rotated reversely.

$$Ts>Tf+T\alpha+T\beta$$

$$\therefore Ts/R_2>\mu_2 N+T\alpha+T\beta$$

Figure 7:
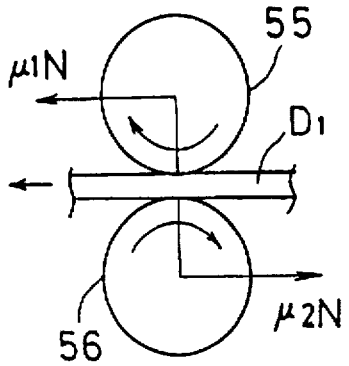
FIG. 7 is an explanatory view showing a state when one sheet of original exists between the separating rollers.

Under such a condition, a transport force Ff which acts on a sheet D1 shown in FIG. 7 is:

$$Ff=\mu_1 N \tag{9}$$

and a separating force Fr which act on the sheet D1 is:

$$Fr=\mu_2 N \tag{10}$$

A condition for securely transporting the sheet D1 based on the equations (9) and (10) is accordingly expressed by the following equation (11). Fmin represents a minimum transport force required.

$$F=Ff-Fr$$

$$=(\mu_1-\mu_2)N>\text{Fmin} \tag{11}$$

(B2) When the reverse separating roller is rotated regularly.

$$Ts<Tf+T\alpha+T\beta$$

$$\therefore Ts/R_2<\mu_2 N+T\alpha+T\beta$$

Figure 8:
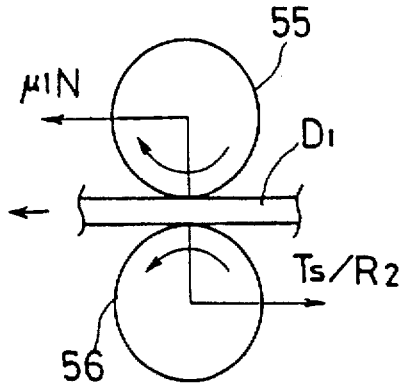
FIG. 8 is an explanatory view showing a state when one sheet of original exists between the separating rollers.

Under such a condition, a transporting force Ff which acts on a sheet D1 shown in FIG. 8 is:

$$Ff=\mu_1 N \tag{9}$$

A separating force Fr which acts on the sheet D1 is:

$$Fr=Ts/R_2 \tag{12}$$

A condition for securely transporting the sheet D1 based on the equations (9) and (12) is accordingly expressed by the following equation.

$$F=Ff-Fr$$

$$=\mu_1 N-Ts/R_2>\text{Fmin} \tag{13}$$

(C) When two sheets exists.

As shown by (C) in FIG. 6, when there are two sheets in a gap between the rollers 55 and 56, the reverse separating roller 56 need to be either stopped or rotated reversely, and the condition is expressed as follows.

Figure 9:
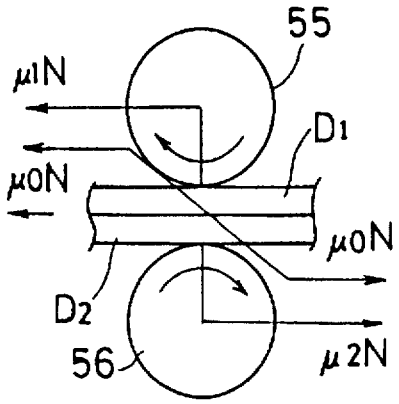
FIG. 9 is an explanatory view showing a state when two sheets of original exists between the separating rollers.

According to the equation (6) stated above, a regular torque Tf which is given to the reverse separating roller 56 from the regular separating roller 55 is NR. A transporting force Ff which acts on a first sheet D1 shown in FIG. 9 is:

$$Ff=\mu_1 N-\mu_0 N \tag{14}$$

A separating force Fr which acts on a second sheet D2 is:

(C1) When reverse separating roller is rotated reversely.

$$Fr=\mu_2 N-\mu_0 N \tag{15}$$

(C2) When reverse separating roller is stopped.

$$Fr=Ts/R_2-\mu_0 N \tag{16}$$

from the above equation (14), $$Ff=\mu_1 N-\mu_0 N>\text{Fmin}$$

$$\therefore N>\text{Fmin}/(\mu_1-\mu_2) \tag{17}$$

where $$\mu_1-\mu_0>0$$

from the above equation (15), $$Fr=\mu_2 N-\mu_0 N>F\ \text{rmin}$$

$$\therefore N>F\ \text{rmin}/(\mu_1-\mu_0) \tag{18}$$

where $$\mu_1-\mu_0>0$$

from the above equation (16), $$Ts/R_2\mu_0 N>0$$

$$\therefore N<Ts/R_2\mu_0 \tag{19}$$

Now, for settling conditions for securely separating and transporting a sheet, it only requires for pressing force N to satisfy the following equations.

$$N>Ts/R_2\mu_3 \tag{8'}$$

$$N>\text{Fmin}/(\mu_1-\mu_2) \tag{11'}$$

$$N>(\text{Fmin}+Ts/R_2)/\mu_1 \tag{13'}$$

$$N>\text{Fmin}/(\mu_1-\mu_0) \tag{17}$$

$$N>\text{Frmin}/(\mu_2-\mu_0) \tag{18}$$

$$N>Ts/R_2\mu_0 \quad (19)$$

Figure 10:
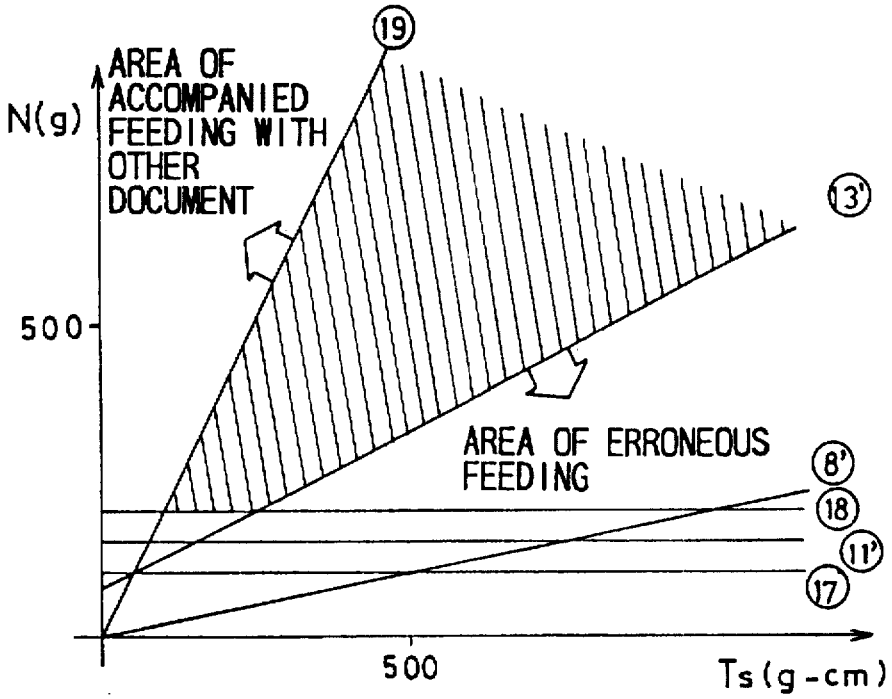
FIG. 10 is a graph showing a relationship between a torque Ts and a pressing force N of rollers.

FIG. 10 shows a relation between a pressing force N and a torque Ts when it is exhibited graphically. When the pressing force N and torque Ts are set within an area shown by a hatching in FIG. 10, there will be no accompanied sheet feeding nor erroneous sheet feeding. In the present embodiment, the following values are set.

$\mu_0$:0.5

$\mu_1$:2.0

$\mu_2$:1.0

$\mu_3$:5.0

$R_1$, $R_2$:R:1.0 cm

Fmin: 150 g

Frmin: 100 g

In such a separating mechanism as arranged above, a torque Ts of the torque limiter TL is lowered by inertia torque Tα of the reverse separating roller 56 and friction loss Tβ as mentioned above. The inertia torque Tα especially depends on a transport velocity. If a Tα at a transport velocity $v_1$ by the regular separating roller 55 is assumed to be $T\alpha_1$, and a Tα at a transport velocity V2 by register roller 58 to be $T\alpha_2$ respectively, the foregoing equations (8'), (13') and (19) may be rewritten as follows.

$$N>(Ts-T\alpha-T\beta)/R_2\mu_3 \quad (8")$$

$$N>(Fmin+(Ts-T\alpha-T\beta)/R_2)/\mu_1 \quad (13")$$

$$N>(Ts-T\alpha-T\beta)/R_2\mu_0 \quad (19')$$

Figure 11:
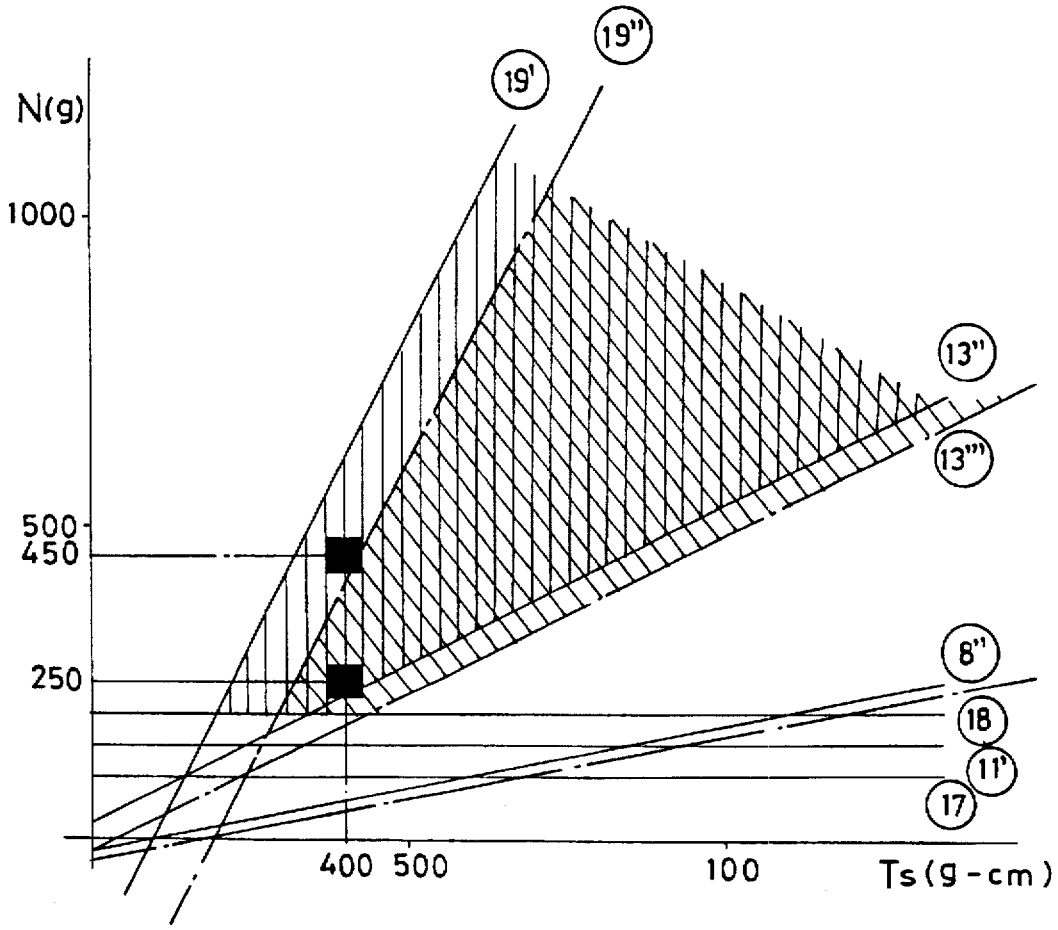
FIG. 11 is a graph showing a relationship between a torque Ts and a pressing force N of rollers.

In the present embodiment, $T\alpha_1$: 150 g–cm $T\alpha_2$: 50 g–cm $T\alpha_3$: 50 g–cm When the graph in FIG. 10 is corrected based on the above-stated values, a graph shown in FIG. 11 is obtained. In the FIG. 11, a slanting hatching shows an appropriate area at a transport velocity v1, and a vertical hatching shows an appropriate area at a transpor velocity v2.

In the present embodiment, in order to reduce a stress against an original as much as possible when it is transported and separated (at transport velocity v1), torque Ts is set to 400 g–cm, and pressing force N1 is set to 450 g. Pressing force N at a time when it is transported after registration (transport velocity V2) is set to 250 g. In other words, when an original transport velocity in a gap between the rollers 55 and 56 becomes large and it tends to easily generate an accompanied feeding, the pressing force between the rollers 55 and 56 is lowered to prevent the decrease in the separation capability.

In the present embodiment, the ADF50 is capable of transporting originals in the following three modes, i.e. one-sided normal feeding mode, preliminary step feeding mode and 2-in-1 mode. First, description will be made in detail on one-sided normal feeding mode and original feeding/transporing/discharging processes in a preliminary step feeding mode by the ADF50.

An original is placed on a tray 51 with its first page faced upward, and both sides are regulated by a side regulating plate 52 with the leading end of the original regulated by a stopper 53. The original is detected by an empty sensor SE11 to be ready for a copying operation (original feeding operation). When a print key is pressed by an operator, a pickup motor M1 is turned on for a fixed time to bring down a pickup roller 54 onto an original D1, and the stopper 53 is retracted (refer to (a) in FIG. 12). At the same time, an electromagnetic solenoid SL is turned on to bring a reverse separating roller 56 in pressing contact with a regular separating roller 55 with a first pressing force N1.

After a predetermined period of time, a feed motor M2 is turned on to rotationally drive rollers 54, 55 and 56 whereby a first original D1 is separated into one sheet to be sent out of the rollers 55 and 56, and then, the leading end of the original is brought in contact with a nip section between register roller 58 and pinch roller 59*a*. An original transport velocity is v1 at this stage. When the leading end of the original D1 is detected by a register sensor SE12, an electromagnetic brake BRK1 is turned on to lock the register roller 58 whereby the register roller 58 is protected from being driven by the contact with the leading end of the original D1.

Figures 12A, 12B, 12C, 12D:
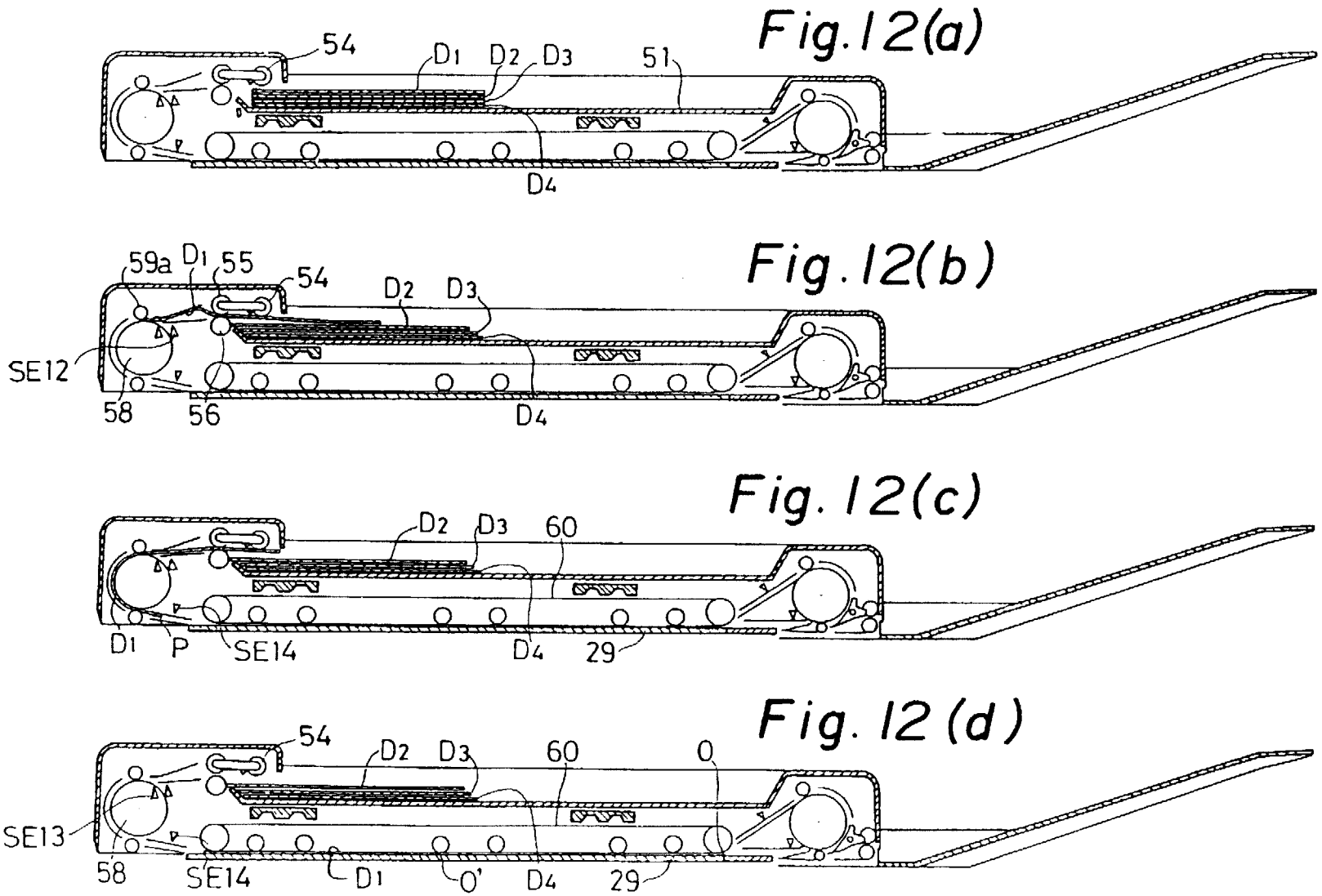
FIGS. 12(*a*)–12(*d*) are explanatory views showing how an original is transported at a preliminary step mode.

After a predetermined period of time after the leading end of the original is detected by the sensor SE12, when a loop is formed immediately before the register roller 58 at the leading end portion of the original D1 (refer to (b) in FIG. 12), the feed motor M2 is turned off, and oblique movement of the original D1 is corrected. On the other hand, the pick-up motor M1 is turned on for a fixed time to bring up the pickup roller 54. At the same time, the electromagnetic solenoid SL is turned off to lower a pressing force between the rollers 55 and 56 to N2.

Then, an electromagnetic clutch CL is turned on, and at the same time, the electromagnetic brake BRK1 is turned off, and feed motor M2 is turned on. A transport of an original D1 started by the register roller 58 at a velocity v2, and at the same time, separating rollers 55 and 56 are rotationally driven. With the rotation of the separating rollers 55 and 56, a noise which is generated when a loop is dissolved and a damage of original are prevented as described above. By decreasing the pressing force between rollers 55 and 56 to N2, the separation capability for the following originals D2, D3 may also be protected from being lowered.

Simultaneously with a timing that the feed motor M2 is turned on, rotational pulse number of the motor M2 transmitted from an encoder E2 is counted, and at the time when nl pulse is counted, the motor M2 is turned off, and the electromagnetic brake BRK1 is turned on to stop the register roller 58. Thereafter, the electromagnetic brake BRK1 and electromagnetic clutch CL are turned off. In the course of this process, a preliminary feeding process for a first original D1 is completed (refer to (c) in FIG. 12), and the leading end of the original D1 is positioned at the entrance section to the platen glass 29, more particularly, at the position immediately before a timing sensor SE14 (preliminary feeding standard point P).

When a preliminary feeding for the original D1 is completed,then, a main motor M3 is turned on for regular rotation. At this time, the electromagnetic clutch CL is turned off, and the register roller 58 is rotationally driven with a transport belt 60 to convey the original D1 onto the platen glass 29 (refer to (d) in FIG. 12). During the transport, timing sensor SE14 starts detecting the leading end of the original D1, and the number of rotational pulse of the motor M3 transmitted from encoder E3 is counted simultaneously. When the rear end of the original D1 is detected by sensor SE14, pickup motor M1 is turned on for a predetermined period of time, and the pickup roller 54 is brought down to press an original D2 for the next feeding process.

In the present embodiment, it is arranged to rotationally drive the register roller 58 and transport belt 60 by the main motor M3 when an original is transported onto the platen glass 29 from a preliminary feeding position because of the reason that if they are driven by respective motors, it is hard to have their drive start timing and original transport speed synchronize each other, which eventually requires a special control for a synchronization. If a driving source is designated to one, such a difficulty in synchronization can be eliminated.

The length of an original in the direction of transport is detected by summing up the number of pulses counted by encoder E2 during a preliminary feeding and the number of pulses counted by encoder E3 until register sensor SE12 is turned off (the time when the rear end of original is detected). The width of an original is detected by turning on and off the timing sensor SE13 whereby the size of an original is judged.

The platen glass 29 is provided with an area corresponding to a sheet of the A3 size. When a single-sided original is placed on the tray 51, and if the length of the original is less than 216 mm, the original is stopped when its leading end has reached an intermediate standard point 0' (refer to (d) in FIG. 12), and the following preliminary step mode is executed which will be described hereinafter. On the other hand, if the length of the original exceeds 216 mm, the original is transported until its leading end reaches an exposure standard point 0, and an ordinary single-sided normal mode is executed.

In the preliminary step mode, if an original needs to be stopped at a preliminary step position, it is necessary to turn off main motor M3 at a time when n3 pulse is counted from encoder E3, and at the same time, electromagnetic brake BRK2 is turned on to stop the transport belt 60. The present embodiment is designed to have the leading end of the original D1 stopped at an intermediate standard point 0' when the rotation of the transport belt is stopped.

Figure 13:
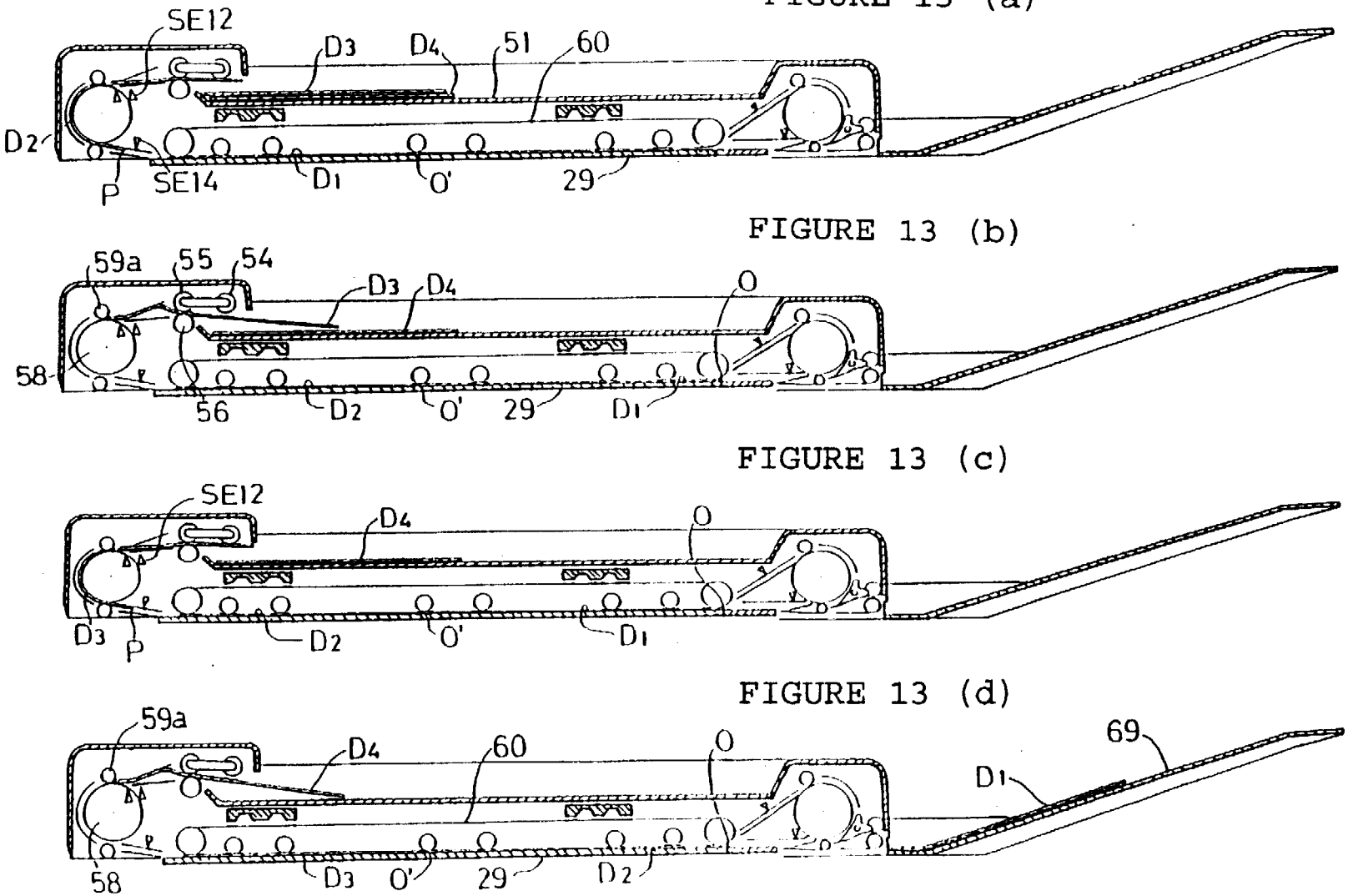
FIGS. 13(*a*)–13(*d*) are explanatory views showing how an original is transported at a preliminary step mode, continuation of FIG. 12.

Then, a second original D2 on the tray 51 is fed to a preliminary feeding position (refer to (a) in FIG. 13). Preliminary feeding process at this stage is principally the same as described above. At a time point when n1 pulse is counted by turning on a feed motor M2 after the original D2 is registered, the feed motor M2 is turned off, and the original D2 is stopped at the preliminary feeding position.

Thereafter, the original D1 is transported from the preliminary step position to a position where the leading end of the original is positioned at an exposure standard point 0. Main motor M3 is first turned on whereby transport of the originals D1 and D2 is started again, and the number of pulses from the encoder E3 is counted simultaneously with the turning on of the motor M3. In this embodiment, it is arranged to have the leading end of an original reach an exposure standard point 0 from an intermediate standard point 0' at the time when a pulse from the encoder E3 is counted by n5 after the main motor M3 is turned on. Accordingly, at a time point when a pulse from the encoder E3 is counted by n5 pulse, the main motor M3 is turned off, and at the same time, electromagnetic brake BRK2 is turned on to stop the transport belt 60. The leading end of the original D1 is thus stopped at an exposure position where the leading end is positioned at an exposure standard point 0. The leading end of the second original D2 is stopped when it has reached an intermediate standard point 0' (refer to (b) in FIG. 13).

Simultaneously with a start of transporting originals D1 and D2 (turning on of the main motor M3), the pickup motor M1 is turned on to start bringing down the pickup roller 54 from its upper home position to bring down the pickup roller 54 in pressed contact with the surface of a third original D3. As mentioned above, a pressing process for the second original D2 is started after the rear end of the original D1 is detected by register sensor SE12. When a preliminary feeding for a third original D3 is conducted, the size of the first original D1 is already detected to be less than 216 mm, and the size of the second original D2 is considered also the same.

In the present ADF50, in the case when the length of an original is less than 216 mm, it is designed to start pulling down the pickup roller 54 simultaneously with a timing that the main motor M3 is turned on, and even if the rear end of a original D3 is not passed through the pickup roller 54 at the time the pickup roller 54 started descending, the original D3 passes through a pressing point of the pickup roller 54 before the pickup roller 54 is completely pulled down even if the rear end of the original D3 is not passed through a detecting point of register sensor SE12. If it is arranged to start pulling down the pickup roller 54 as early as possible and turn on the feed motor M2 simultaneously to rotationally drive the rollers 54, 55 and 56, original feeding process can be started at an earlier stage. In this case, the rear end portion of the original D2 is not pressed with the pickup roller 54, and a feeding process for the original D3 is not obstructed. A start timing for pulling down the pickup roller 54 is not necessary be a timing when the preceding originals D1 and D2 are started for transport. If it is done earlier than a timing the rear end of the preceding original D2 is detected by the register sensor SE12 as conventionally practiced, an earlier original feeding process can be performed.

The register sensor SE12 is also provided with a function to detect a jam caused by erroneous feeding. More particularly, if the rear end of an original is not detected by the sensor SE12 within a predetermined period of time after the pick-up roller 54 has started feeding operation, it is judged that the original is not being transported properly to cause a jam trouble. At this stage, the pickup roller 54 is started descending to press the following original D3, and therefore, the roller is immediately stopped to be returned to the upper home position as stated above.

In the present ADF50, when a value of n5 pulse from encoder E3 is counted and the leading end of the original D1 is reached at an exposure standard point 0, the leading end of a second original D2 reaches an intermediate standard point 0'. At a time point when main motor M3 is turned on, the leading end of a third original D3 is not reached the nip section between the register roller 58 and pinch roller 59*a*, however, it reaches the nip section with a little delayed timing (refer to (b) in FIG. 13), and stand ready for the folowing process.

An image exposure of the first original D1 is performed hereat by the optical system 20. During the image exposure operation, the feed motor M2 is turned on to preliminarily feed a third original D3 (refer to (c) in FIG. 13). It is a prerequisite condition that the preliminary feeding process should be completed before the image exposure for the first original D1 is finished in order not to lower a copying speed in the main body of the copying machine when a single-sided original is copied on one copy sheet using the ADF.

In order to accomplish said condition, it is required to either increase a feeding speed or quicken a feeding start timing. However, if a feeding speed is increased, it may cause to invite larger damage of originals, oblique movement, and separating capability of the reverse separating roller 56 is lowered. In this embodiment, the timing for pulling down the pickup roller 54 is more expedited than an ordinary timing (the timing when the rear end of the preceding original is detected by register sensor SE12) on and after a third original to satisfy the above-mentioned condition.

Then, main motor M3 and discharge motor M4 are turned on whereby a first original D1 is discharged onto the tray 69, and a second original D2 is transported to an exposure position with a third original D3 transported to a preliminary step position (refer to (d) in FIG. 13). More particularly, simultaneously with a timing that the main motor M3 is turned on, a counting process for the number of pulses from encoder E3 is started, and at a time point that a value of n5 pulse is counted, the motor M3 is turned off, and at the same time electromagnetic brake BRK2 is turned on to stop the transport belt 60.

On the other hand, in synchronous with a timing that the main motor M3 is turned on, the pickup roller 54 presses a fourth original D4, and the feed motor M2 is turned on to have the leading end of the original D4 temporarily stand for the next process at the nip section between the register roller 58 and pinch roller 59*a* (refer to (d) in FIG. 13). An image exposure is conducted for the second original D2 hereat, and at the same time, the feed motor M2 is turned on to perform a preliminary feed process for the fourth original D4 (refer to (a) in FIG. 14). Even in this preliminary feed process, the feed motor M2 is turned off at a time point when n1 pulse is counted after the motor M2 is turned on.

Figure 14:
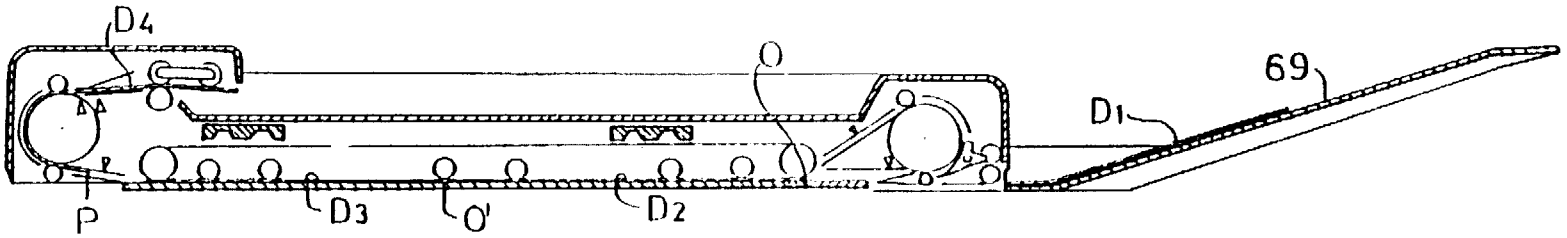
FIGS. 14(*a*)–14(*d*) are explanatory views showing how an original is transported at a preliminary step mode, continuation of FIG. 13.
Figure 14:
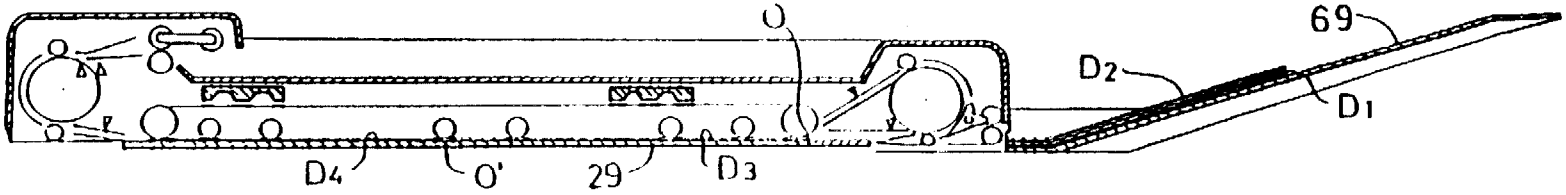
Figure 14:
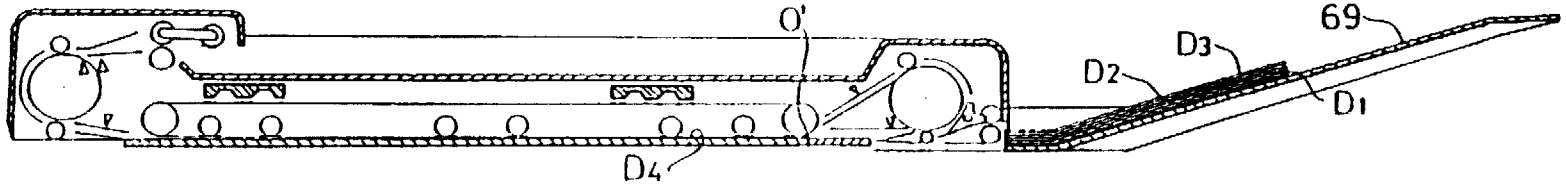
Figure 14:
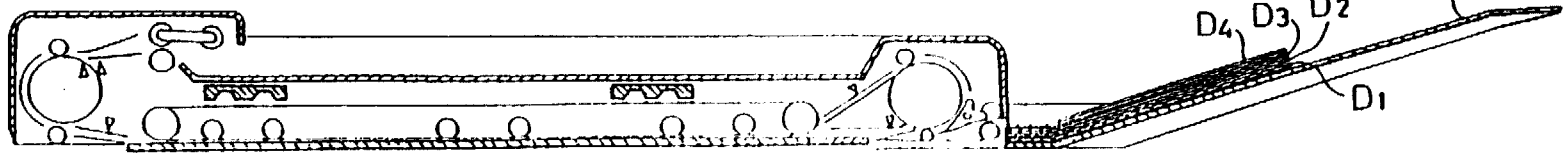

The same operation as described above is repeatedly executed, and with a second original D2 discharged onto the tray 69, a third original D3 is transported to the exposure position, and a fourth original D4 is conveyed to the preliminary step position (refer to (b) in FIG. 14). When an image exposure for the original D3 is finished, the original D3 is discharged onto the tray 69, and at the same time, a fourth original D4 is transported to the exposure position and is stopped thereat (refer to (c) in FIG. 14). Further, on completion of image exposure for the original D4, the original D4 is discharged onto the tray 69 (refer to (d) in FIG. 14).

On the other hand, in the case when the length of an original exceeds 216 mm, single-sided normal mode is executed. In this case, when the rear end of a first original is detected by the register sensor SE12, the pickup roller 54 is brought down. After the leading end of the first original is detected by the timing sensor 14, at a time point that pulse n7 from encoder E3 of the main motor M3 is counted, the motor M3 is turned off, and electromagnetic brake BRK2 is turned on to stop the transport belt 60. The leading end of the first original is thus transported to an exposure position where an exposure standard point 0 is positioned, and is stopped thereat. An image exposure operation for the first original is conducted hereat, and at the same time, a preliminary feeding of a second original is performed. More particularly, at a predetermined period of time after the main motor M3 is stopped, the feed motor M2 is turned on to separate the second original from other originals, and the leading end of the original is brought in contact with the nip section between the register roller 58 and pinch roller 59*a* to correct an oblique movement. Thereafter, in synchronous with a timing that electromagetic clutch CL is turned on, the feed motor M2 is turned on again to rotate the register roller 58. The second original D2 is accordingly transported to a preliminary feeding position, and when the leading of the original is detected by the sensor SE14, pulses from the encoder E2 is counted. At a time point when pulse n9 is counted, the motor M2 is turned off, and at the same time, electromagnetic brake BRK1 is turned on to complete a preliminary feed process for the second original.

Upon completion of the image exposure for the first original, main motor M3, discharge motor M4 are turned on to discharge the first original onto the tray 69, and at the same time, the second original is transported to the exposure position from the preliminary feeding position. Thereafter, the same operation as described above is repeated until the last original is discharged onto the tray 69.

In the foregoing preliminary step mode, description is omitted on how the preliminary feeding of originals D2, D3, D4 are performed, however, it is performed in the same method as the paper feed process for the first original D1 wherein the pressing forces N1 and N2 between the separating rollers 55 and 56 are changed over by turning on and off the electromagnetic solenoid SL, and the separating rollers 55 and 56 are driven even when an original is transported after registration. Such a control as described herein is also executed in an original feeding process under the single-sided normal mode.

Description will now be made on original feeding/transporting/discharging processes by the ADF50 under 2-in-1 mode.

An original is placed on the tray 51 with its first page facing upward, and both sides are regulated by the side regulating plates 52 with the leading end of the original regulated by the stopper 53. The original is detected by empty sensor SE11 to be ready for a copying operation (original feeding action). The 2-in-1 mode for a single-sided original is selected by an operator, and with a print key pressed, pickup motor M1 is turned on for a predetermined period of time to bring down the pickup roller 54 on an original D1, and the stopper 53 is retracted (refer to (a) in FIG. 18).

After a predetermined period of time, the feed motor M2 is turned on to rotationally drive the rollers 54, 55, and 56, and the first original D1 is separated into one sheet from other originals to be sent out of the rollers 55 and 56. Then, the leading end of the original is brought in contact with the nip section between the register roller 58 and pinch roller 59*a*. When the leading end of the original D1 is detected by the register sensor SE12, electromagnetic brake BRK1 is turned on to lock the register roller 58 so that the register roller 58 is protected from being rotationally driven by the contact with the leading end of the original D1.

Figures 18A, 18B, 18C, 18D:
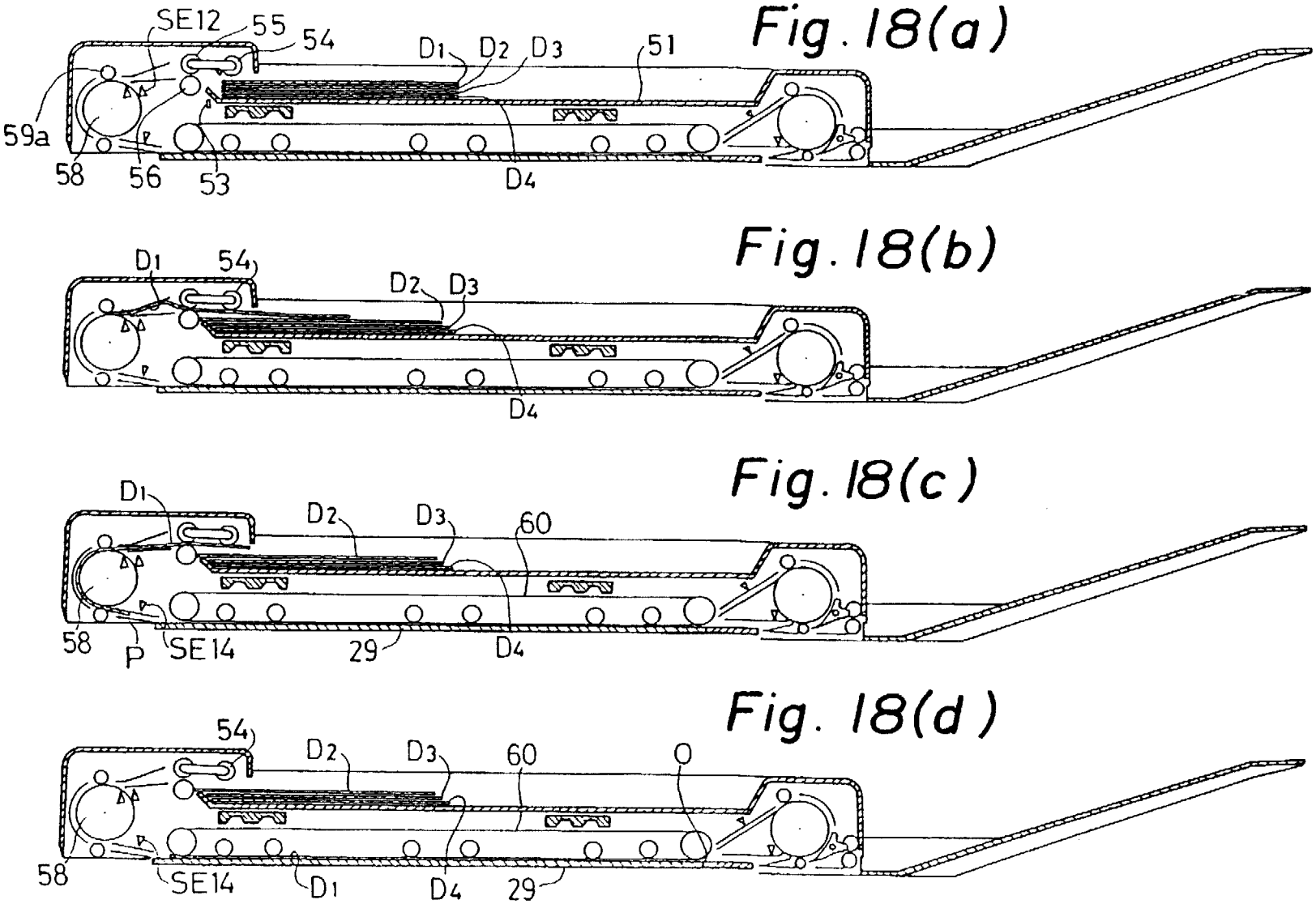
FIGS. 18(*a*)–18(*d*) are explanatory views showing how an original is transported at a preliminary step mode.

After a predetermined period of time from the time the leading end of the original is detected by the sensor SE12, when a loop is formed by the leading end portion of the original D1 at the position immediately before the register roller 58 (refer to (b) in FIG. 18), the feed motor M2 is turned off, and an oblique movement of the original D1 is corrected. The pickup motor M1 is turned on again for a predetermined period of time, and the pickup roller 54 is brought up.

In synchronous with a timing that electromagnetic clutch CL is turned on, electromagnetic brake BRK1 is turned off, and feed motor M2 is turned on whereby the original D1 is transported by the register roller 58. Simultaneously with a timing that feed motor M2 is turned on, the number of rotational pulses of the motor M2 transmitted from encoder E2 is counted, and at a time point that n1 pulse is counted, the feed motor M2 is turned off, and at the same time, electromagnetic brake BRK1 is turned on to stop the register roller 58. Thereafter, the electromagnetic brake BRK1 and electromagnetic clutch CL are turned off whereby a preliminary feeding process for the first original D1 is completed (refer to (c) in FIG. 18), and the leading end of the original D1 stand ready for the next process at the entrance section to the platen glass 29, more particularly, at a position immediately before the timing sensor SE14 (a preliminary feed standard point P of an odd-numbered original).

With a completion of the preliminary feed process for the first original D1 as above described, main motor M3 is turned on for regular rotation. At this stage, the electromagnetic clutch CL is turned off, and the register roller 58 is rotationally driven together with the transport belt 60 to deliver the original D1 onto the platen glass 29 (refer to (d) in FIG. 18). In transit of the original, the leading end of the original D1 is detected by timing sensor SE14, and the number of rotational pulses of the main motor M3 transmitted from the encoder E3 is counted simultaneously. When the rear end of the original D1 is detected by the sensor SE14, the pickup motor M1 is turned on for a predetermined period of time, and the pickup roller 54 is brought down to press a second original D2 to be ready for the following process.

Figure 21:
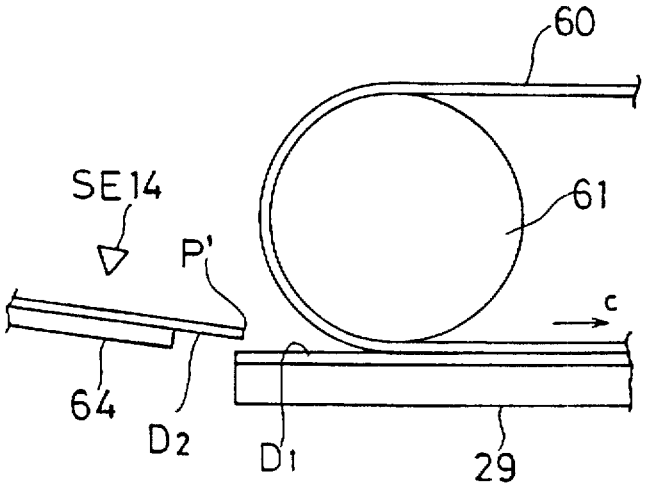
FIG. 21 is an explanatory view showing a state when an original is stopped at the entrance to a platen glass.

In the 2-in-1 mode, the following operation is conducted to stop an odd-numbered original at an intermediate waiting position. First, after the rear end of the odd-numbered original D1 is detected by the timing sensor SE14, the main motor M3 is turned off at a time point that n13 pulse is counted from the encoder E3, and at the same time, the electromagnetic brake BRK2 is turned on to stop the transport belt 60. When the rotation of the transport belt 60 is stopped, the original D1 is stopped with its rear end positioned at the end of the platen glass 29 as shown in FIG. 21.

Figure 19:
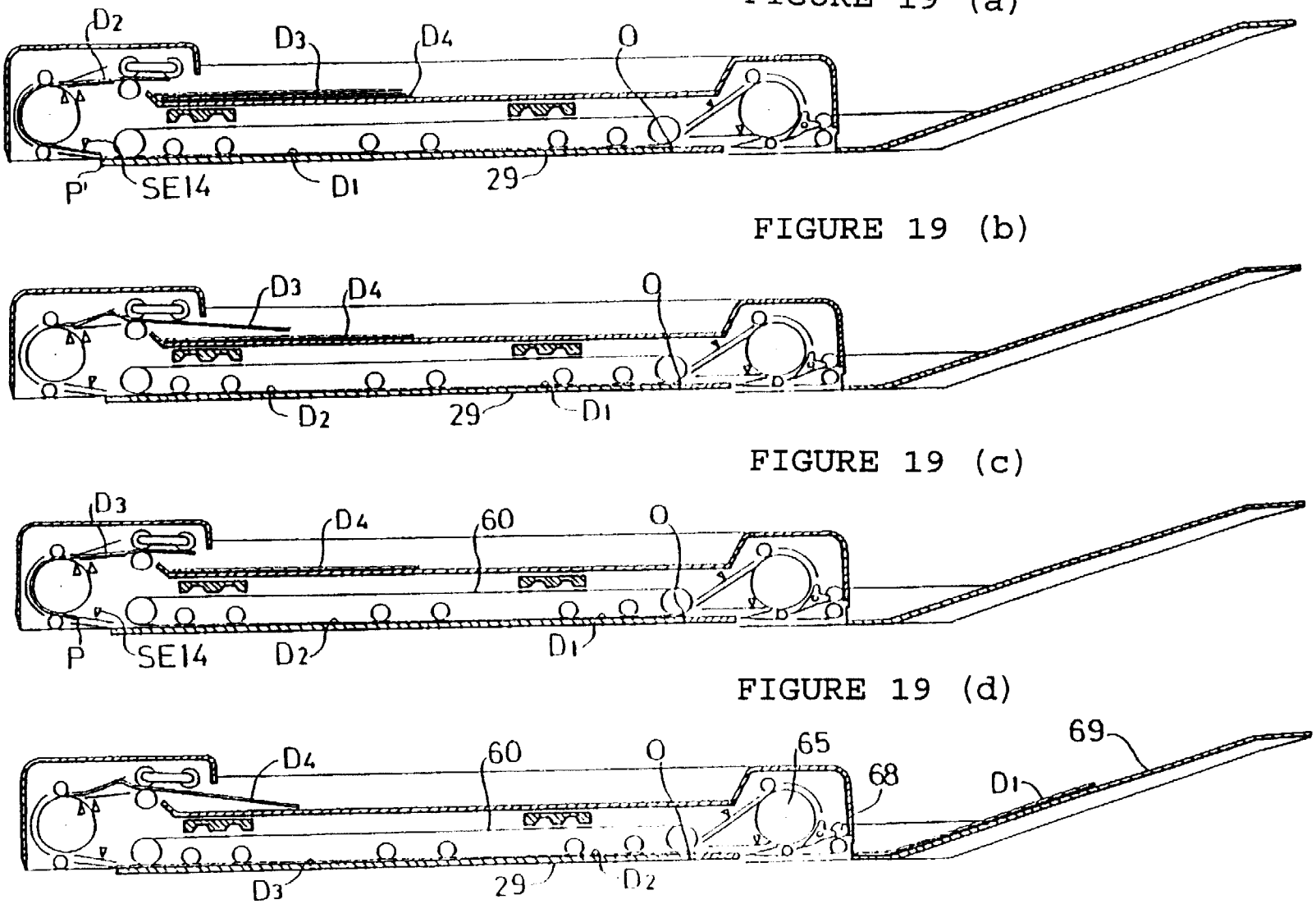
FIGS. 19(*a*)–19(*d*) are explanatory views showing how an original is transported at a preliminary step mode, continuation of FIG. 18.

Then, an even-numbered original D2 placed on the tray 51 is forwarded to a preliminary feeding position (refer to (a) in FIG. 19). A preliminary feeding process for an even-numbered originals is principally the same as the process for an odd-numbered originals, i.e., after the leading end of the original D2 is detected by timing sensor SE14, feed motor M2 is turned off at a time point that n13 from encoder E2 is counted, and at the same time, electromagnetic brake BRK1 is turned on to stop register roller 58. In other words, after the leading end of an even-numbered original D2 is detected by timing sensor SE14, the original D2 is transported for a distance equivalent to the amount of transport (n13 pulse) which is counted from a time the rear end of the preceding odd-numberd original D1 is detected by the timing sensor SE14 to a time it is stopped, and the original D2 is stopped. More particularly, a stop position P' of the leading end of the original D2 (a preliminary feed standard position of an even-numbered original) corresponds with a position of the rear end of the original D1 which is being stopped at an intermediate waiting position. With such a transport process, the gap between the original D1 and D2 becomes zero. As a result, the leading of the original D2 which has been preliminarily fed is projected from a lower guide plate 64 and is positioned at a location immediately above the rear end of the original D1 as illustrated in FIG. 21. In order to make the gap between the originals zero, if the original D2 is preliminarily forwarded to a point where the leading end of the original D2 corresponds with the rear end of the original D1 on the same plane, there is a possibility that the original D2 may hit the original D1 to cause an oblique movement of either original D1 or original D2. However, when there is provided a difference in level between the height of the rear end of the original D1 and the height of the leading end of the original D2 as arranged in the present embodiment, such a crash of originals as mentioned above can be surely avoided.

The originals D1, D2 are then forwarded to an exposure position where the leading end of the original D1 is positioned which is an exposure standard position O. Main motor M3 is first turned on, and with this action, feeding process of the originals D1, D2 is restarted. Simultaneously with a timing that the motor M3 is turned on, counting of the number of pulses from encoder E3 is started.

In the present embodiment, it is arranged to have the leading end of the D1 reached an exposure standard position 0 when the sum of pulse numbers is reached n7, wherein the number of pulses counted from a time the leading end of the original D1 is detected by timing sensor SE14 until it is transported to an intermediate waiting position and the number of pulses counted from a time the transport of the original D1 is restarted are summed up. At a time when pulse n7 is counted from encoder E3, main motor M3 is turned off, and at the same time, electromagnetic brake BRK2 is turned on to stop transport belt 60 whereby the originals D1, D2 are set at an exposure position without generating any gap therebetween (refer to (b) in FIG. 19).

On the other hand, simultaneously with a turning on of main motor M3 for transporting originals D1, D2 to an exposure position, pickup motor M1 is turned on for a predetermined period of time to bring pickup roller 54 in pressed contact with the surface of a third original D3. With electromagnetic clutch CL turned off, feed motor M2 is turned on whereby pickup roller 54, and separating rollers 55 and 56 are rotationally driven to forward the third original D3 out of the tray 51, and the leading end of the original temporarily stands ready for the following process at the nip section of register roller 58 and pinch roller 59*a* (refer to (b) in FIG. 19). Image exposure process for the originals D1, D2 are conducted hereat by the optical system 20. During the image exposure process, feed motor M2 is turned on for a preliminary feed process for a third original D3 (refer to (c) in FIG. 19). Since the preliminary feed process is conducted for an odd-numbered original at this stage, the leading end of the original D3 is temporarily stopped when it has reached a preliminary feed standard position P which is immediately before timing sensor SE14 just like the first original D1 as described above.

With completion of the image exposure process for the originals D1, D2, main motor M3 and discharge motor M14 are turned on for discharging the original D1 from the platen glass 29 and feeding an original D3 onto the platen glass 29. The main motor M3 is turned off at a time point when n13 pulse is counted after the rear end of the original D3 is detected by sensor SE14, just like the case the original D1 is transported to the intermediate waiting position. At this stage, the original D1 is slipped off the transport belt 60, and is discharged onto the tray 69 by reverse/discharge roller 65 and discharge roller 68. The leading end of the original D2 is stopped at a position where it has passed through an exposure standard position 0, and the third (an odd-numbered) original D3 is stopped at the intermediate waiting position (refer to (d) in FIG. 19).

On the other hand, when the rear end of the original D3 is detected by register sensor SE12, just like the case as described above, a fourth (an even-numbered) original D4 is pressed with pickup roller 54, and at the same time, feed motor M2 is turned on. The leading end of the fourth original D4 temporarily stands ready for the following process at the nip section between register roller 58 and pinch roller 59*a* (refer to (d) in FIG. 19). Then, the fourth original D4 is preliminarily fed (refer to (a) in FIG. 20). Since the preliminary feed process is conducted for an even-numbered original, the original D4 is forwarded to a position where the leading end of the original D4 corresponds with the rear end of the original D3 which is a preliminary feed standard point P' for an even-numbered original.

Figure 20:
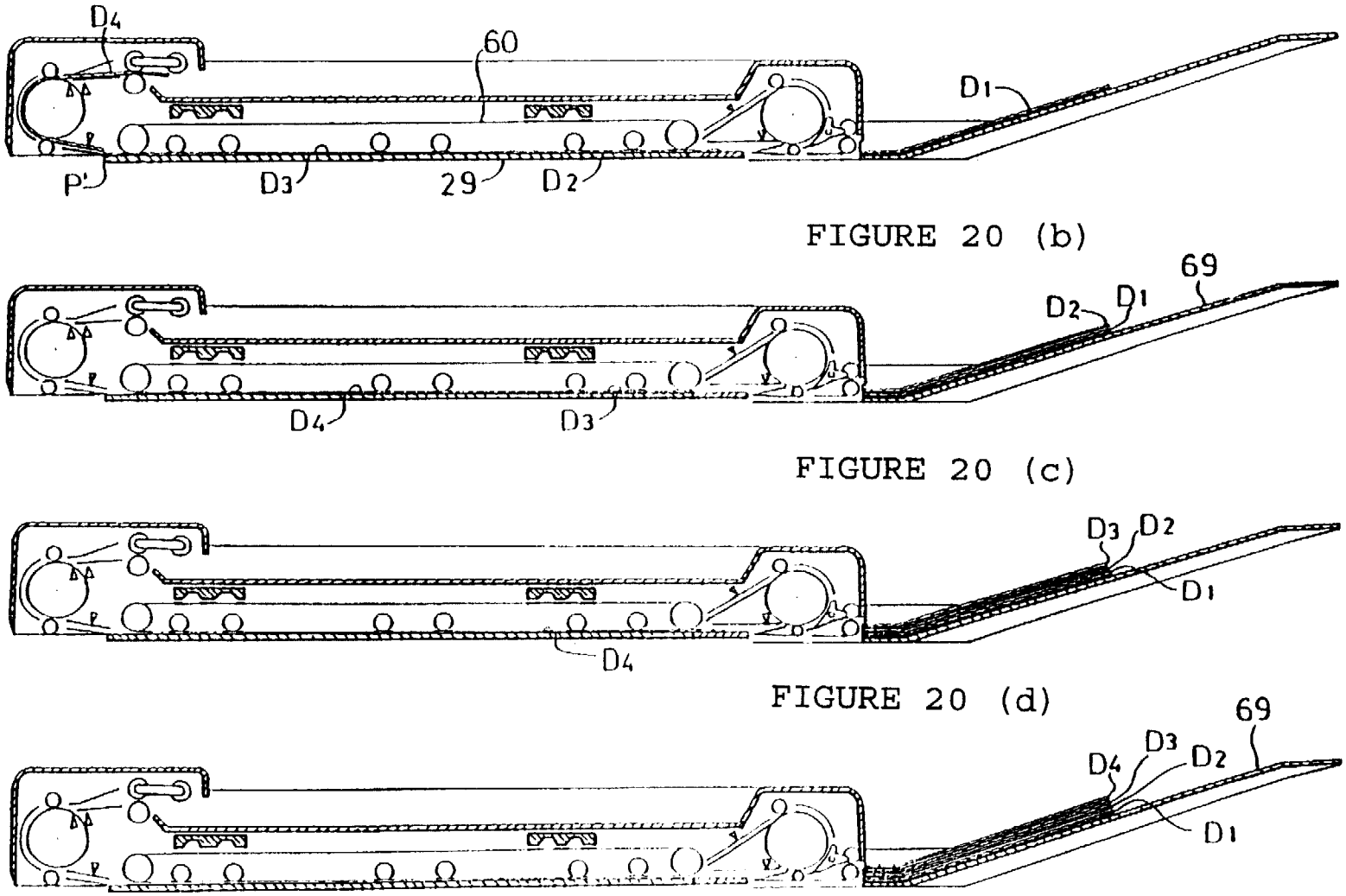
FIGS. 20(*a*)–20(*d*) are explnatory views showing how an original is transported at a preliminary step mode, continuation of FIG. 19.

Thereafter, the same operations as described above are repeatedly executed wherein a second original D2 is discharged onto the tray 69, and at the same time, originals D3, D4 are fed to an exposure position (refer to (b) in FIG. 20). With completion of image exposure process for originals D3, D4, the original D3 is first discharged onto the tray 69

(refer to (c) in FIG. 20), and the original D4 is further discharged onto the tray 69 (refer to (d) in FIG. 20).

Now, description will be made hereinafter how the ADF50 is controlled.

Figure 16:
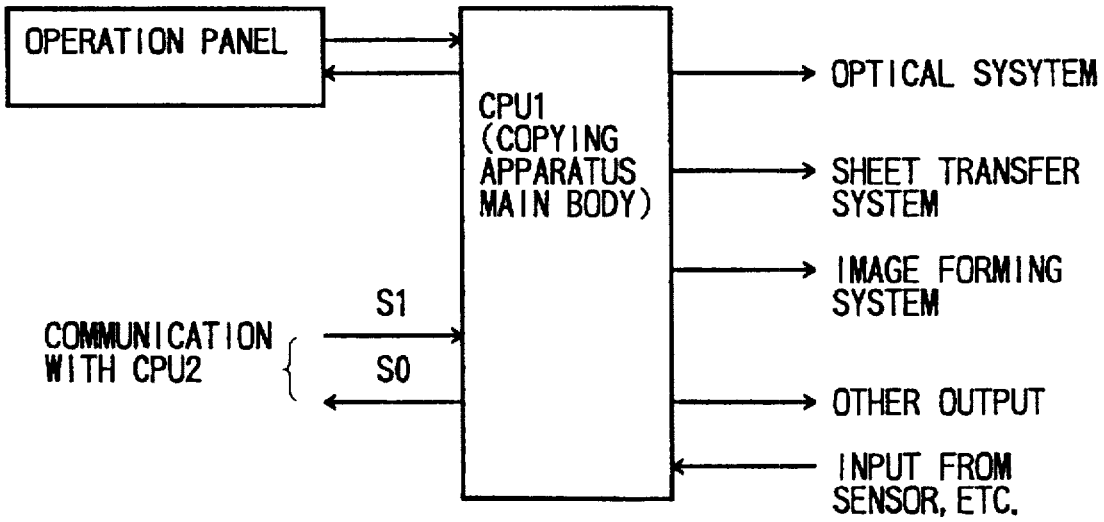
FIG. 16 is a block diagram showing a CPU1 which controls the main body of a copying machine.

Control operation is conducted by CPU1 (refer to FIG. 16) provided for controlling the main body of copying machine and by CPU2 (refer to FIG. 17) provided for controlling the ADF50. The CPUL and CPU2 exchange information at a timing whenever necessary. In a description which will be made on control procedure hereinafter, on-edge means that sensors, flags, signals and the like are changed from off-state to on-state, while off-edge means that they are changed from on-state to off-state.

Figure 22:
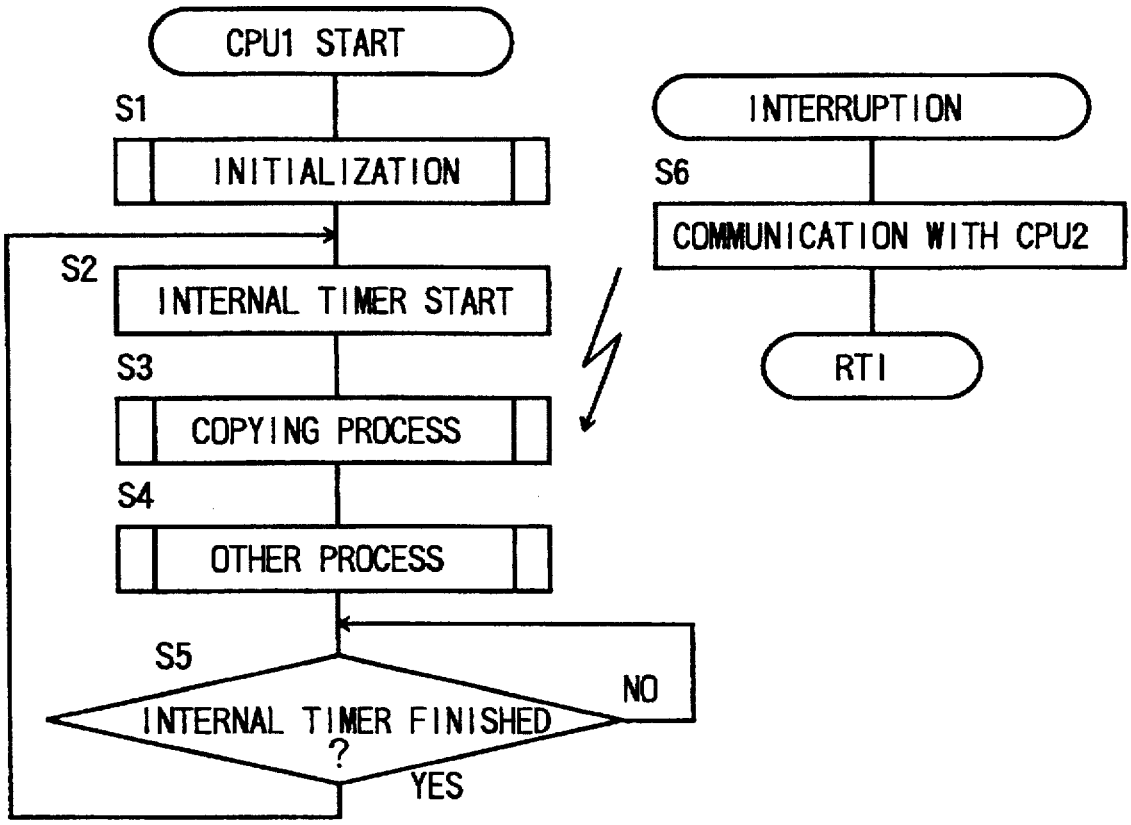
FIG. 22 is a flowchart showing a main routine of CPU1.

FIG. 22 shows a main routine of CPU1 which controls the main body of a copying machine.

With an electric source turned on, the CPU1 is reset to start a program. At step S1, RAM is cleared, and initialization for resetting various registration, and setting various apparatus to an initial mode is performed. Then, an internal timer is started at step S2. The internal timer is provided for determining a time required for one routine in the main routine, and the value is set at step S1. Various timers used in each subroutine are counted based on this internal timer.

Then, each subroutine is successively called at steps S3 and S4 to perform necessary processing, and the program returns to step S2 on completion of the internal timer at step S5. The step S3 is a subroutine provided for executing a copying process. At step S4, other processes, for instance, control of toner fixing device 40, detection of jam and the like are processed.

The CPU1 is connected with the CPU2 through serial communication line, and its transmission is performed by interruption process at step S6.

Now, description will be made on a control procedure of the CPU2 which controls the ADF50.

Figure 23:
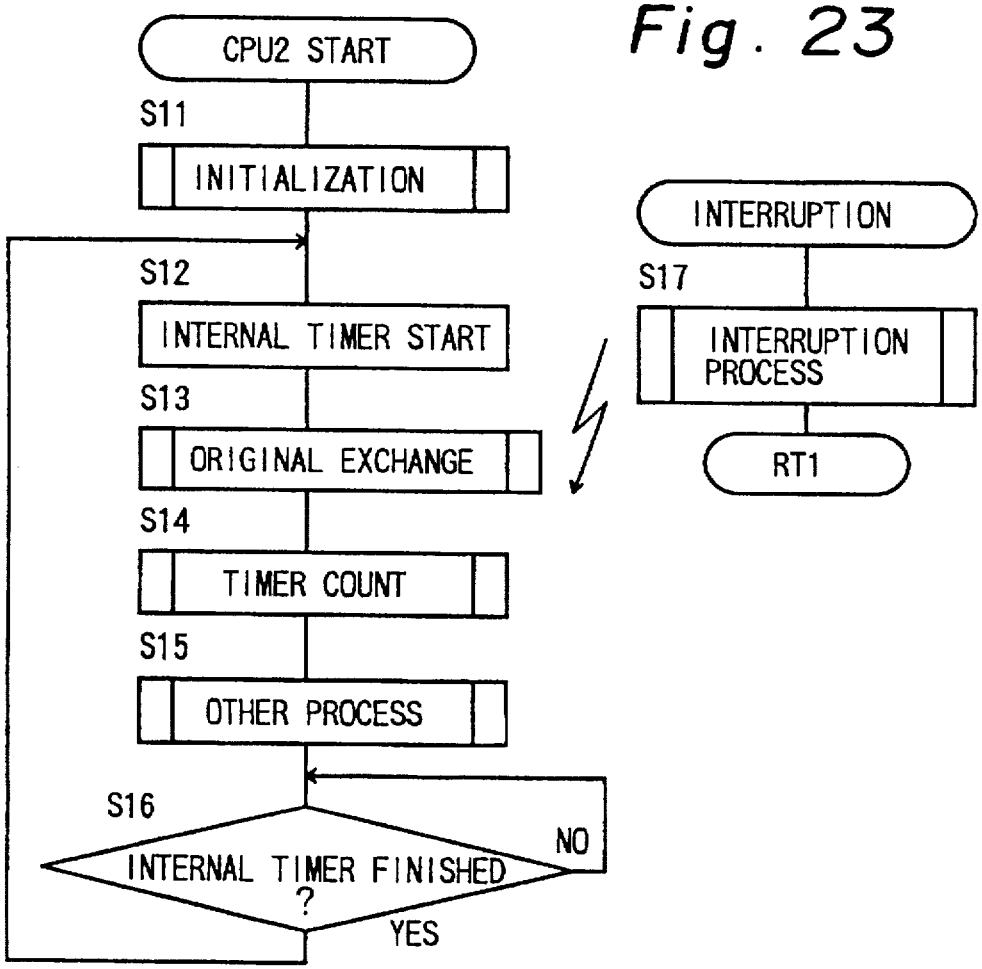
FIG. 23 is a flowchart showing a main routine of CPU2.

FIG. 23 shows a main routine of the CPU2 which controls the ADF50.

With an electric source turned on, the CPU2 is reset to start a program. At step S11, RAM is cleared, and an initialization process is performed for resetting various registration and setting various devices to a initialization mode. Then, an internal timer is started at step S12. The internal timer is provided for determining a time required for one routine in the main routine, and its value is set at step S11. Various timers used in the subroutines which will be described hereinafter are counted based on the internal timer.

Each subroutine is successively called at steps S13–S15 to perform required processing, and with completion of the internal timer at step S16, the program returns to step S12. Step S13 is a subroutine provided for exchanging originals on platen glass 29, and step S14 is a subroutine provided for counting various timers. At step S15, other processing such as A/D conversion, input process, output process, and jam detection are processed.

Figure 24A:
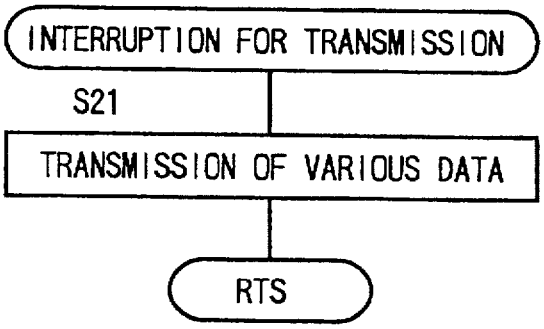
FIGS. 24(A) and 24(B) are flowcharts showing subroutines of interruption process in CPU2.
Figure 24B:
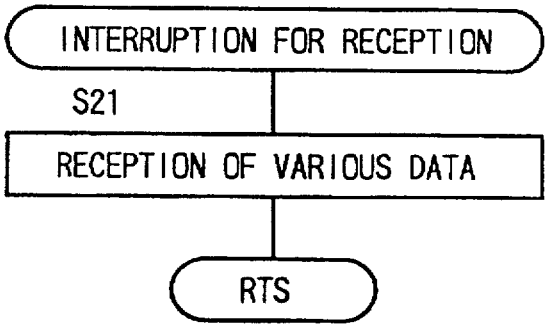

In an interrupting process relative to the CPU2, such various procedures as controlling main motor M3 at step S17, data transmission and data receiving processes at steps S21 and S22 as shown in FIG. 24 are properly conducted irrespective of the processing conducted in the main routine of the CPU2.

Figure 25:
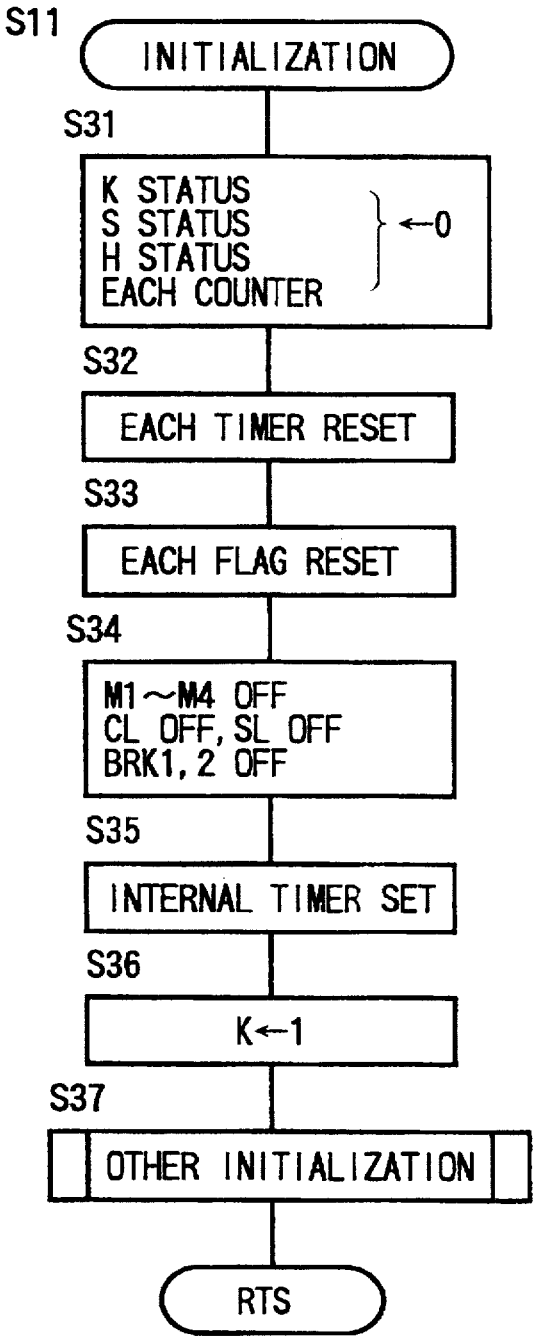
FIG. 25 is a flowchart showing a subroutine of initialization in CPU2.

FIG. 25 shows a subroutine of initialization which is executed at step S11.

At step S31, each data and each counter in RAM is cleared. At step S32, timers T101, T103, T201, T301, T302 and T303 are reset. At step S33, each flag which will be described hereinafter is reset. At step S34, each motor M1, M2, M3, M4, electromagnetic solenoid SL, electromagnetic clutch CL, electromagnetic brake BRK1, BRK2 are turned off. At step S35, internal timer is set to a fixed value. At step S36, feeding status K is set to '1', and at step S37, other initialization are processed.

Figure 26:
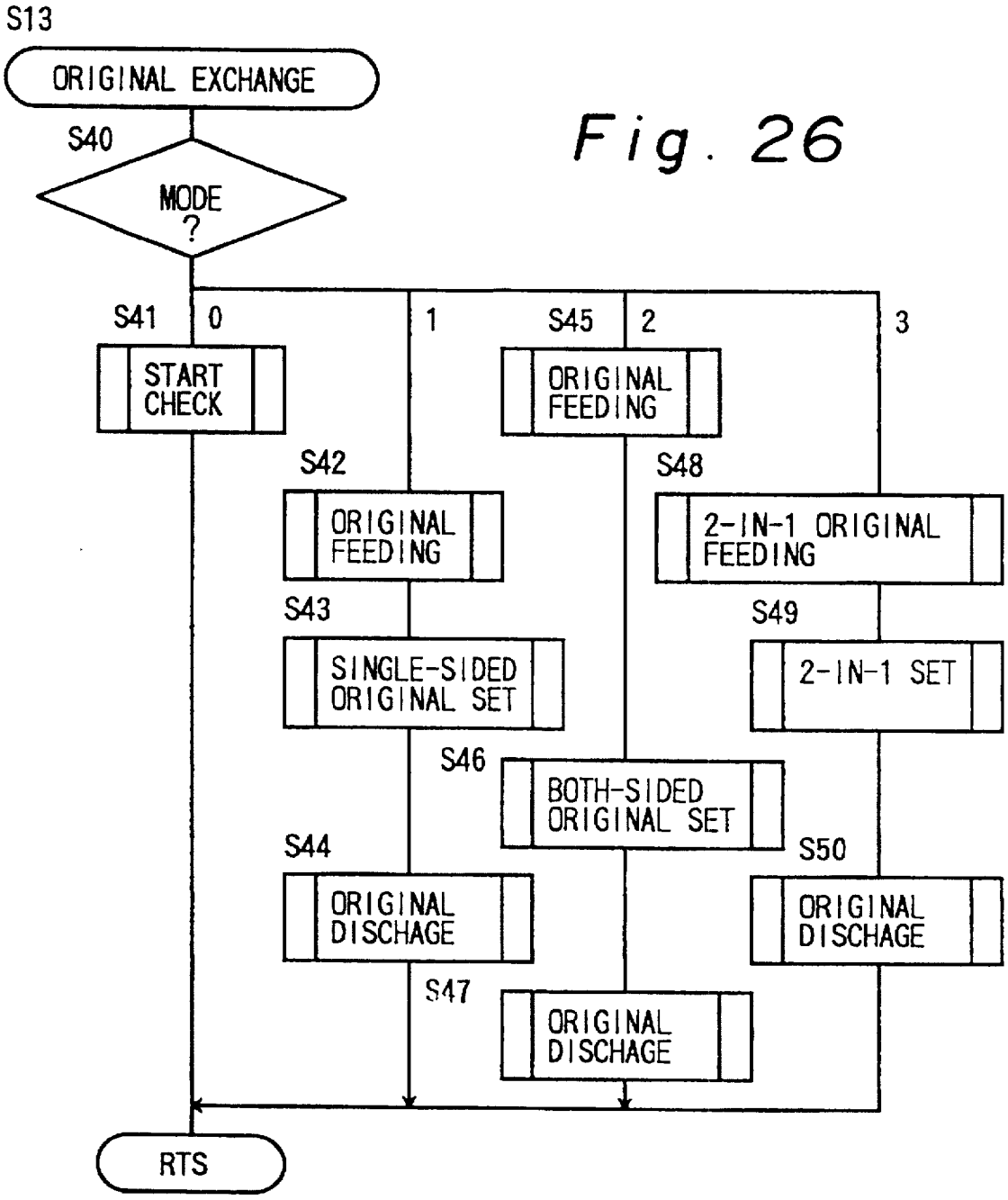
FIG. 26 is a flowchart showing a subroutine of an original exchange process in CPU2.

FIG. 26 shows an original exchange subroutine which is executed at step S13.

In the subroutine, MODE is first checked at step S40, and the following processes are performed based on the value checked. At an initial stage, the MODE is reset to '0', and at this stage, start check is processed at step S41. In a subroutine at step S41, a MODE is set to a fixed value depending on a mode of original transport selected by an operator (refer to steps S68, S69, S70 in FIG. 27).

When the MODE is '1', it means a transport mode of single-sided original, wherein an original is forwarded to a preliminary feed position from the tray 51 at step S42. Then, at step S43, either a preliminary step feed for transporting a single-sided original to a preliminary position and exposure position or a single-sided original normal feed for transporting a single-sided original directly to an exposure position is processed. Further, at step S44, a process for discharging an original from an exposure position onto the tray 69 is performed.

When the MODE is '2', it means a transport mode of double-sided original. At step 45, an original is fed, and at step S46, a double-sided original is set at an exposure position. At step S47, the original is discharged. Detailed description on the above-described processes will be omitted.

When the MODE is '3', it means the 2-in-1 mode. In the 2-in-1 mode, two sheets of originals are successively placed on the platen glass 29 as one set, and images of two originals are copied on one copy sheet. In this case, a sheet is fed at step S48, and at step S49, two originals are placed on the platen glass 29, and they are discharged at step S50.

Figure 27:
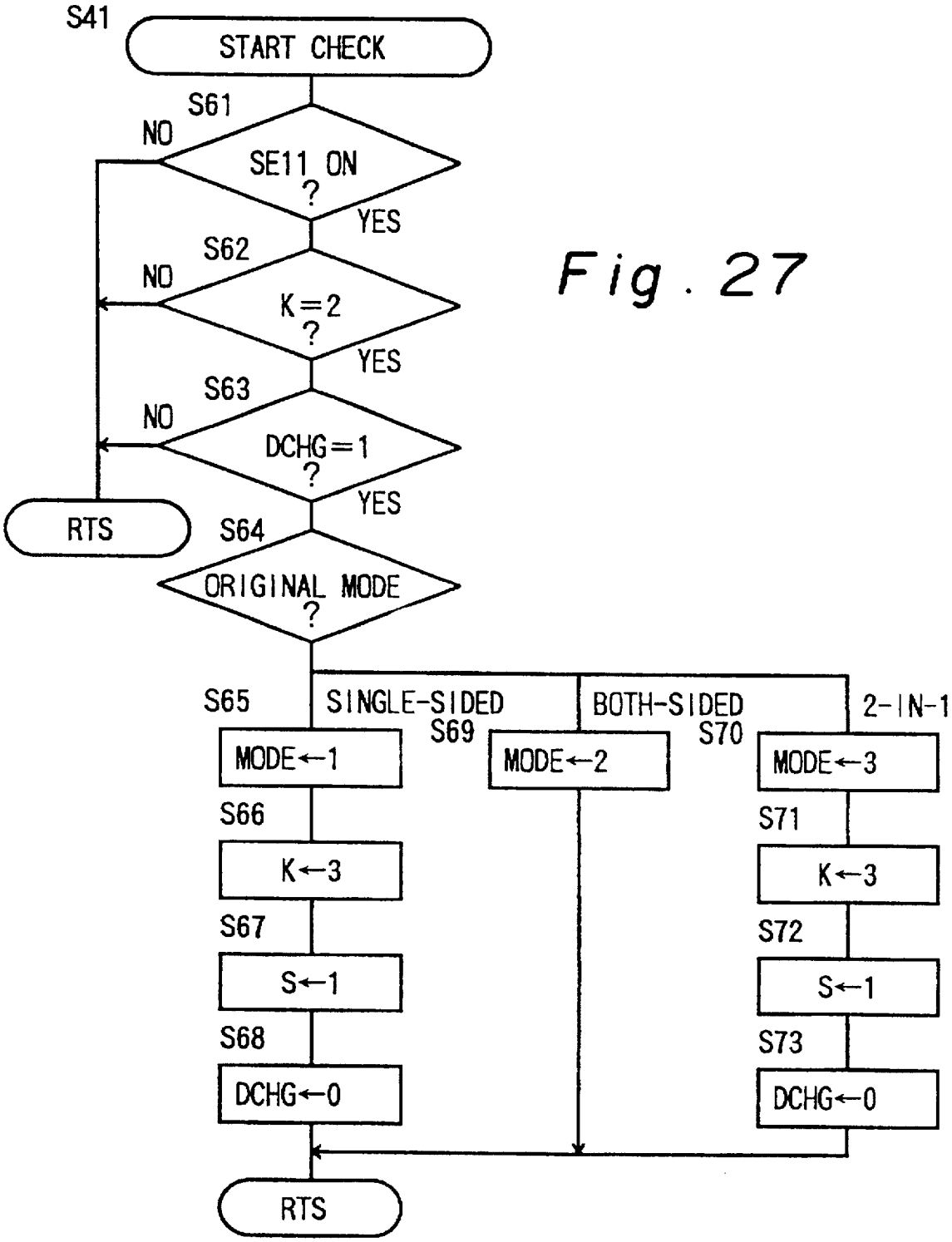
FIG. 27 is a flowchart showing a subroutine of start check in CPU2.
Figure 28:
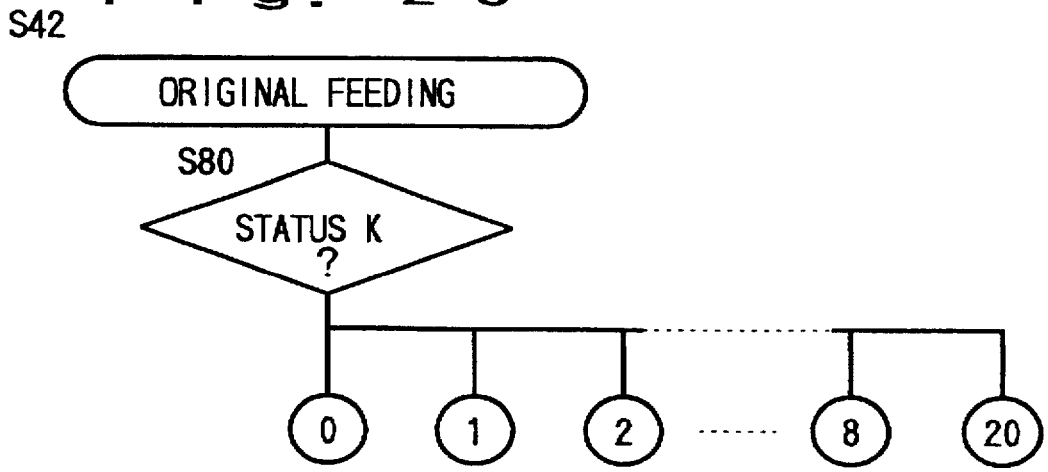
FIG. 28 is a flowchart showing a subroutine of document feeding in CPU2.
Figure 29:
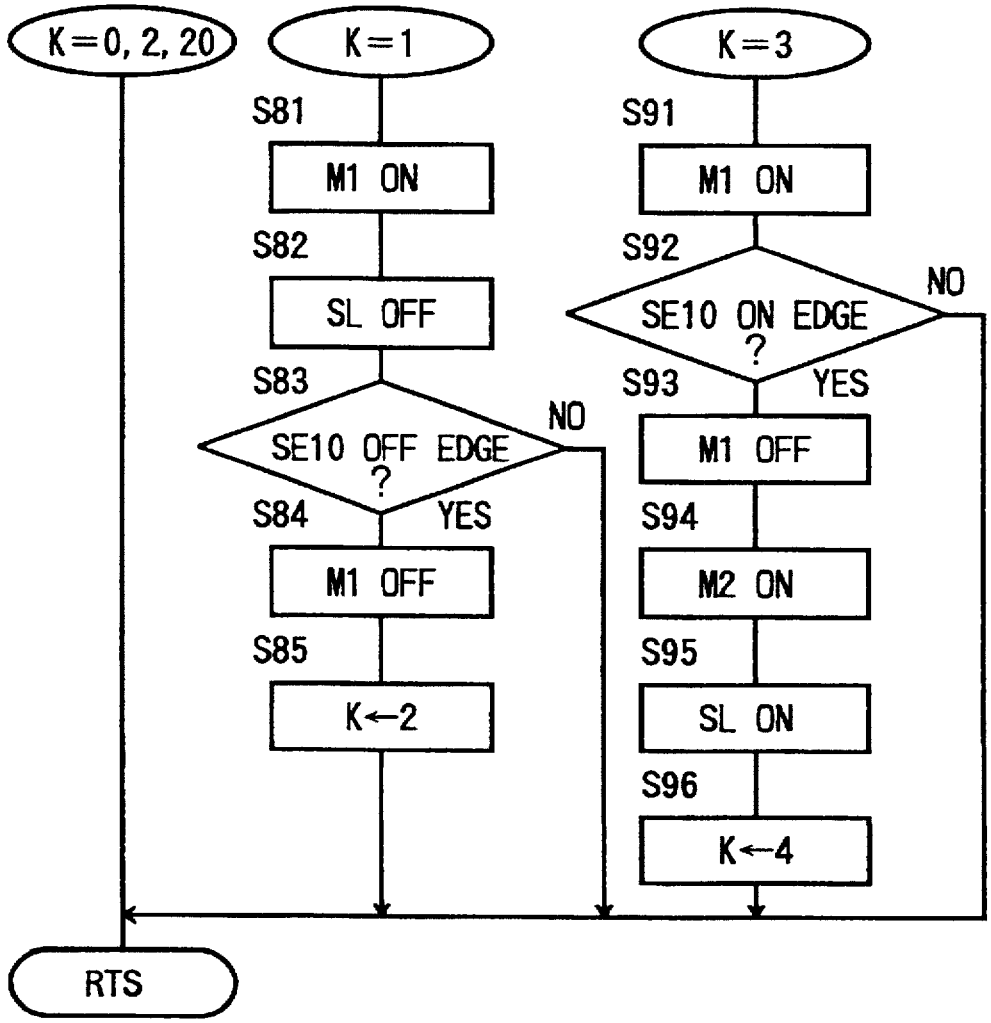
FIG. 29 is a flowchart showing a subroutine of document feeding in CPU2, continuation of FIG. 28.
Figure 30:
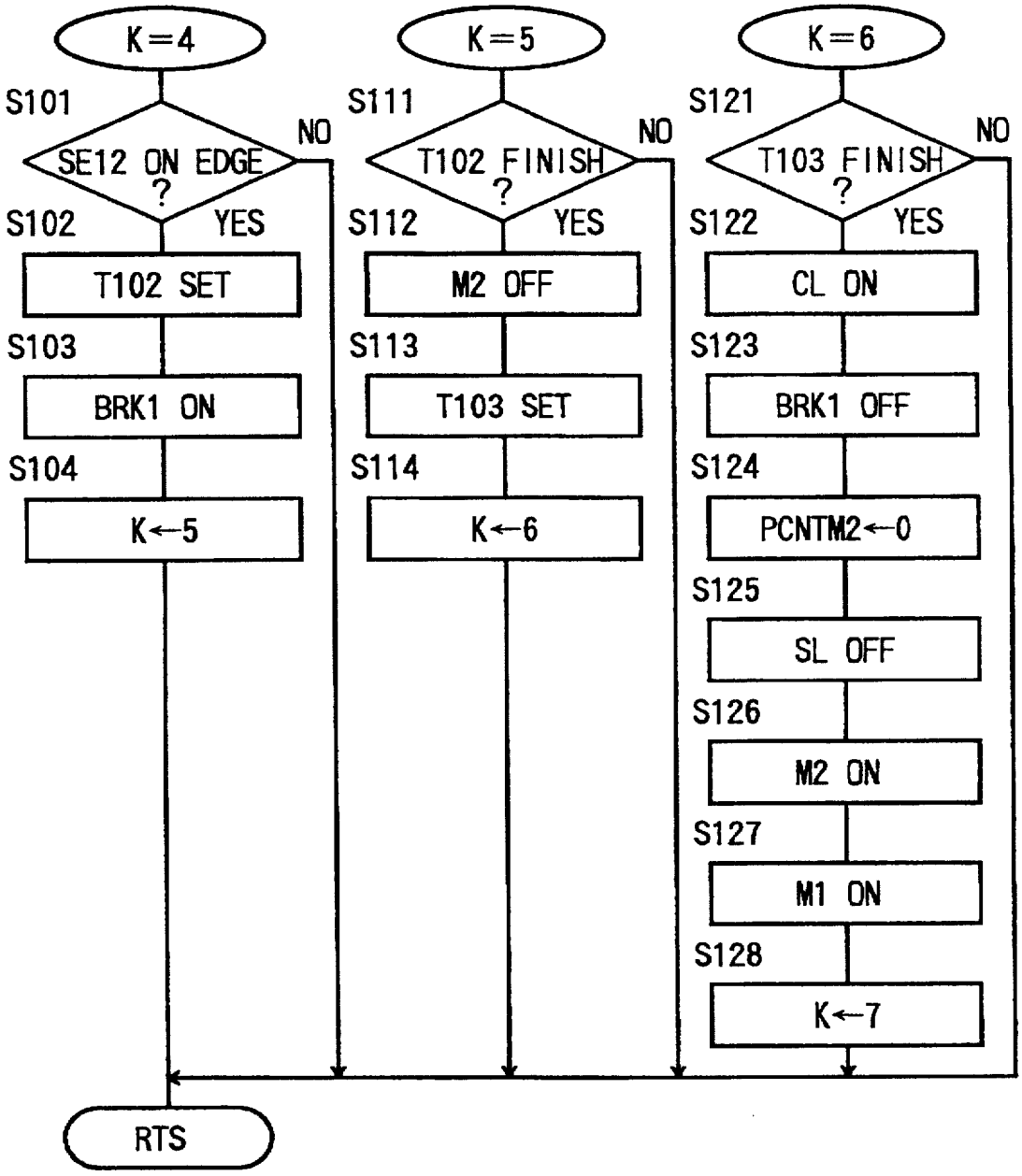
FIG. 30 is a flowchart showing a subroutine of document feeding in CPU2, continuation of FIG. 29.
Figure 31:
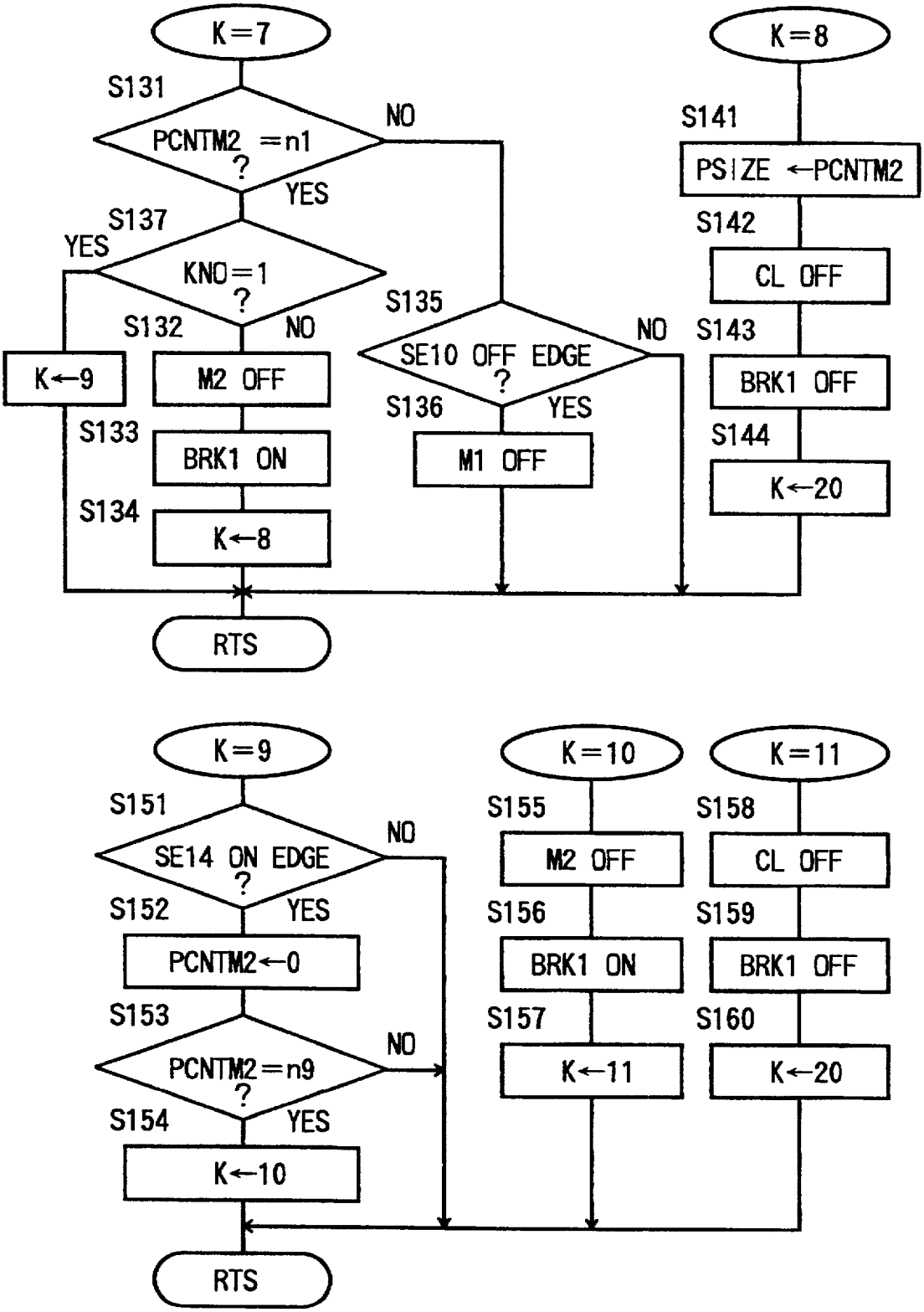
FIG. 31 is a flowchart showing a subroutine of document feeding in CPU2, continuation of FIG. 30.
Figure 32:
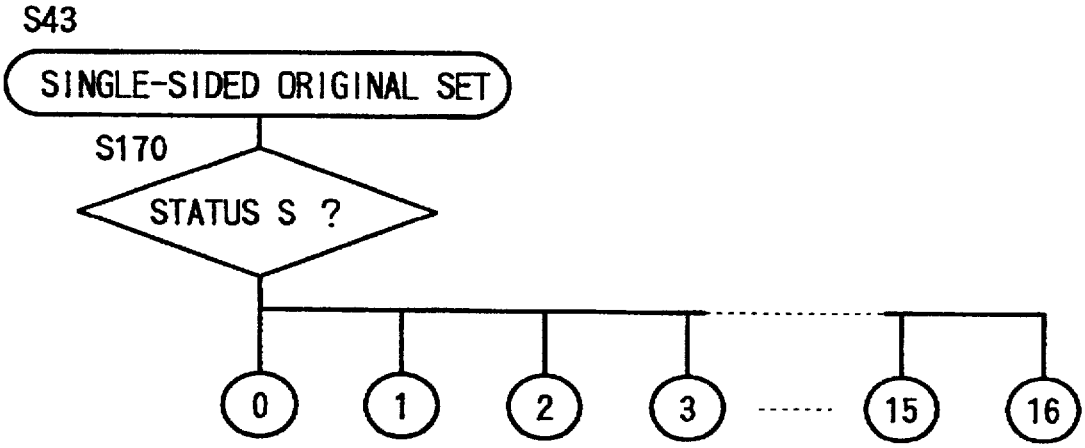
FIG. 32 is a flowchart showing a subroutine for setting a single-sided original in CPU2.
Figure 33:
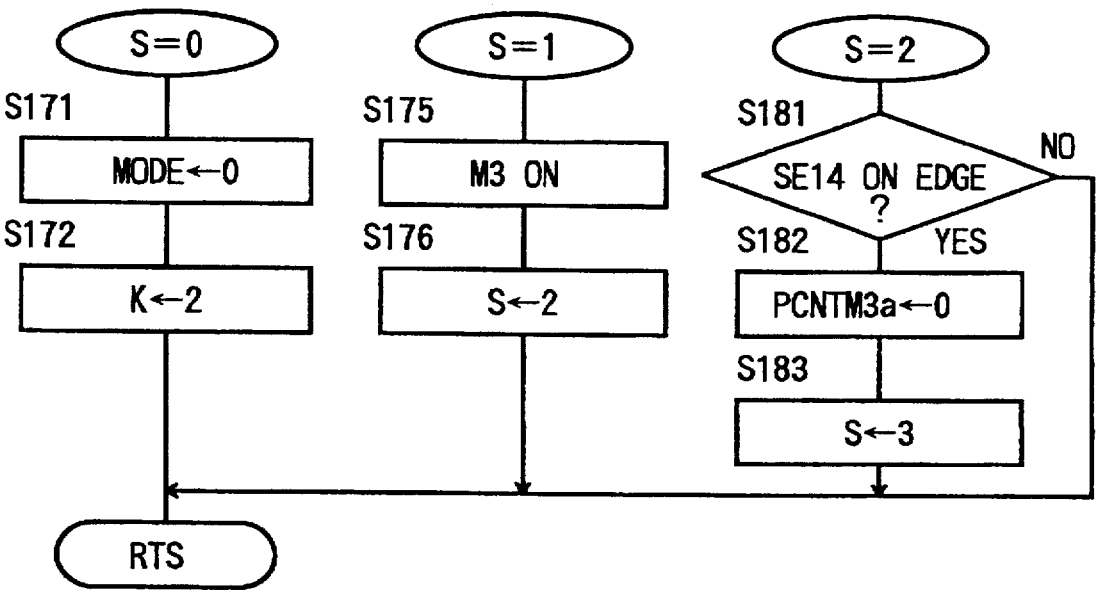
FIG. 33 is a flowchart showing a subroutine for setting a single-sided original in CPU2, continuation of FIG. 32.
Figure 34:
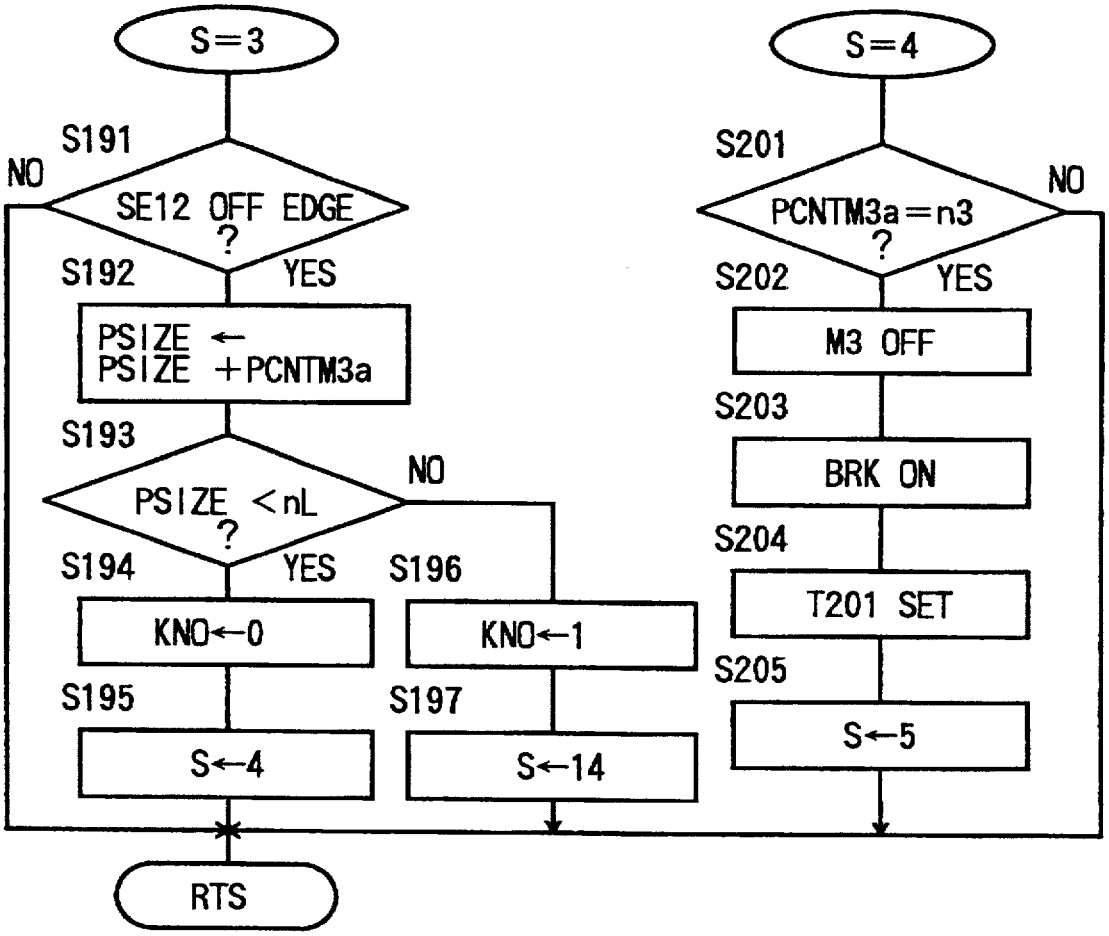
FIG. 34 is a flowchart showing a subroutine for setting a single-sided original in CPU2, continuation of FIG. 33.
Figure 35:
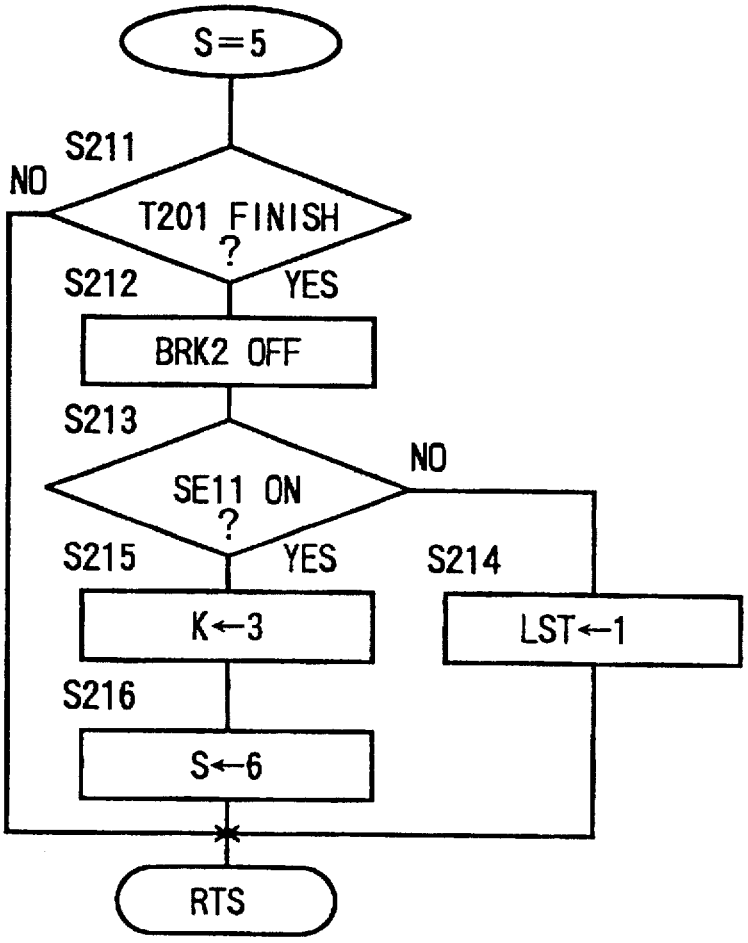
FIG. 35 is a flowchart showing a subroutine for setting a single-sided original in CPU2, continuation of FIG. 34.
Figure 36:
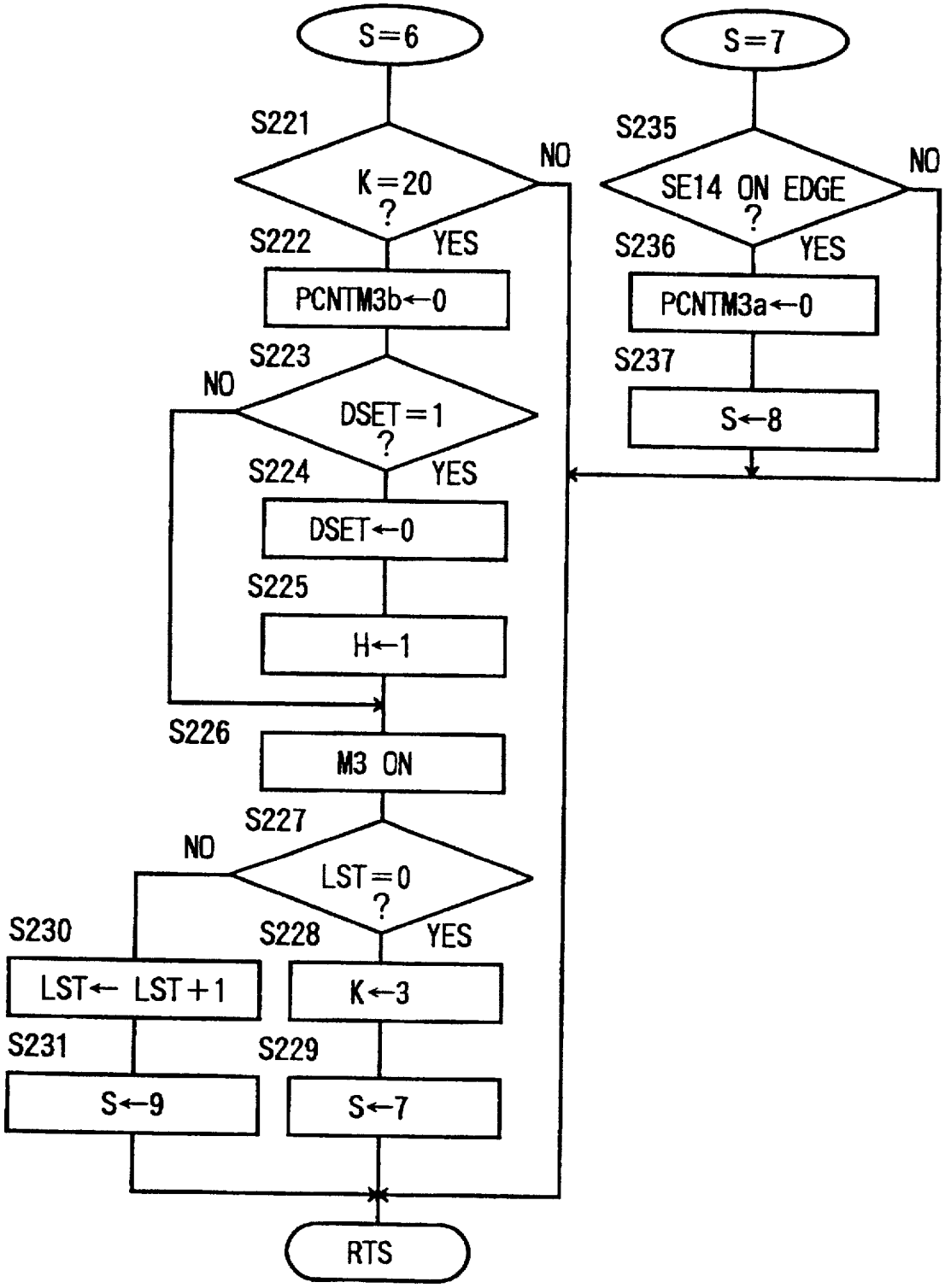
FIG. 36 is a flowchart showing a subroutine for setting a single-sided original in CPU2, continuation of FIG. 35.
Figure 37:
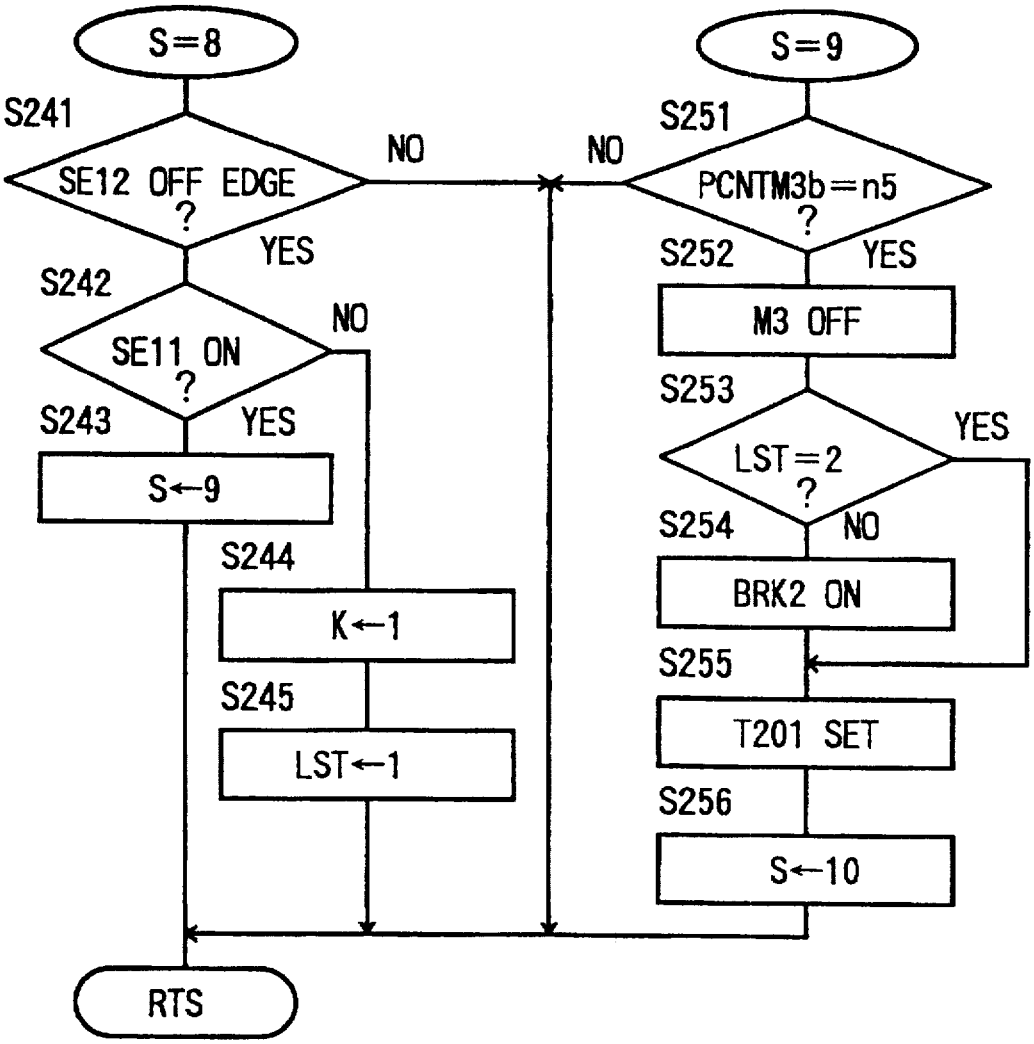
FIG. 37 is a flowchart showing a subroutine for setting a single-sided original in CPU2, continuation of FIG. 36.
Figure 38:
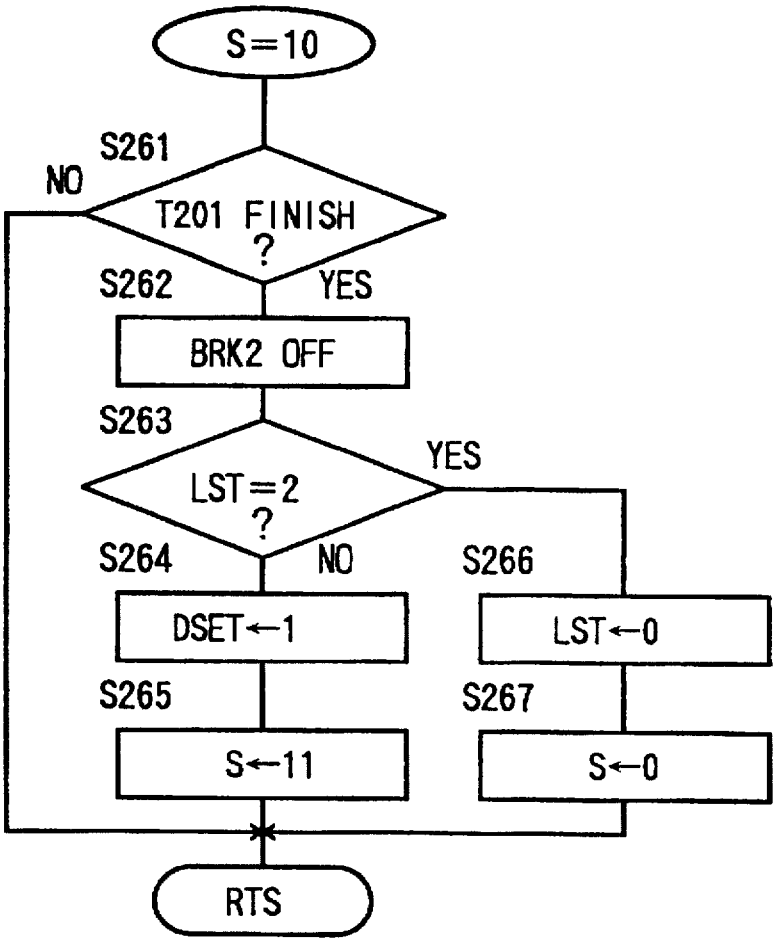
FIG. 38 is a flowchart showing a subroutine for setting a single-sided original in CPU2, continuation of FIG. 37.
Figure 39:
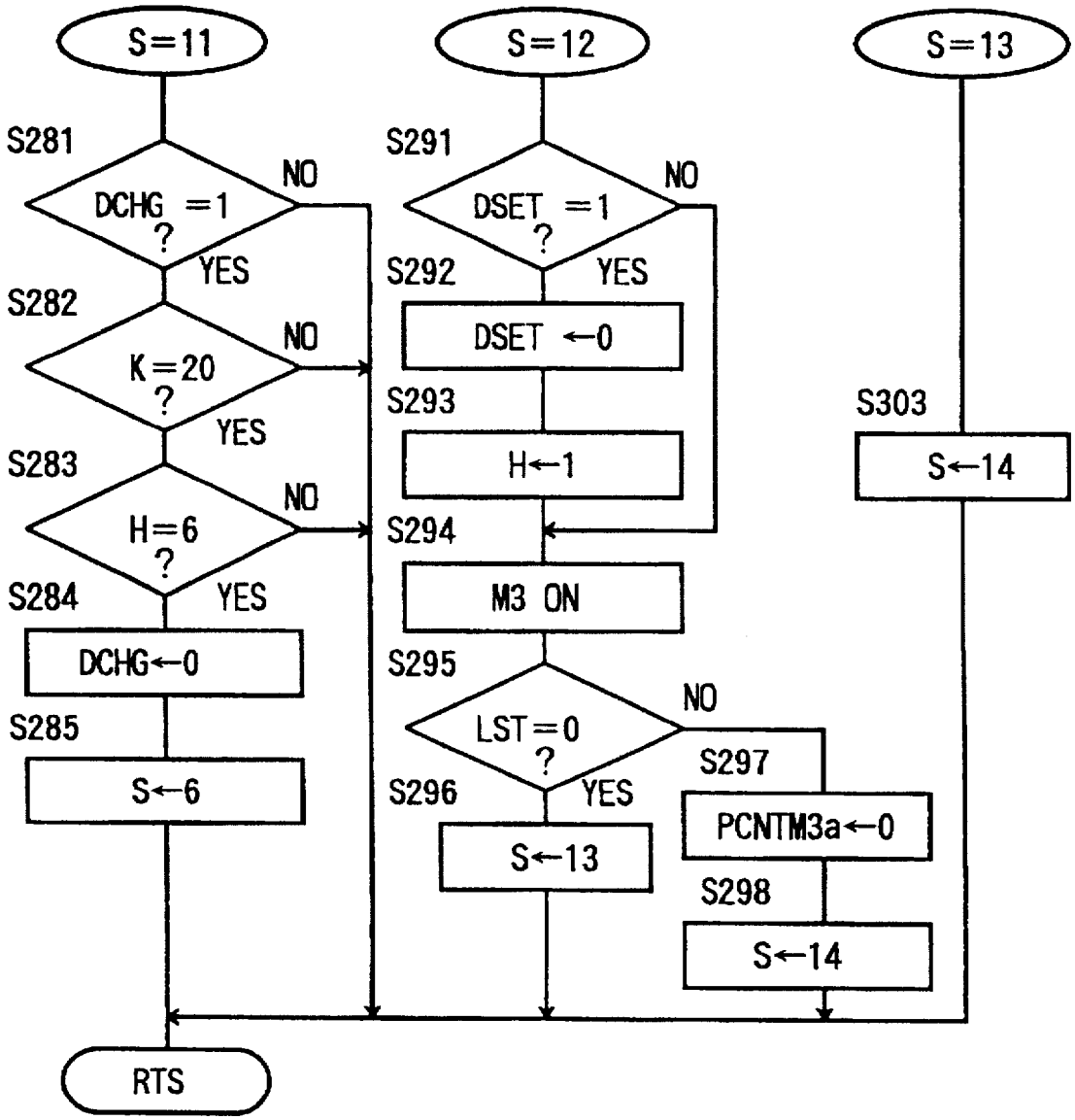
FIG. 39 is a flowchart showing a subroutine for setting a single-sided original in CPU2, continuation of FIG. 38.
Figure 40:
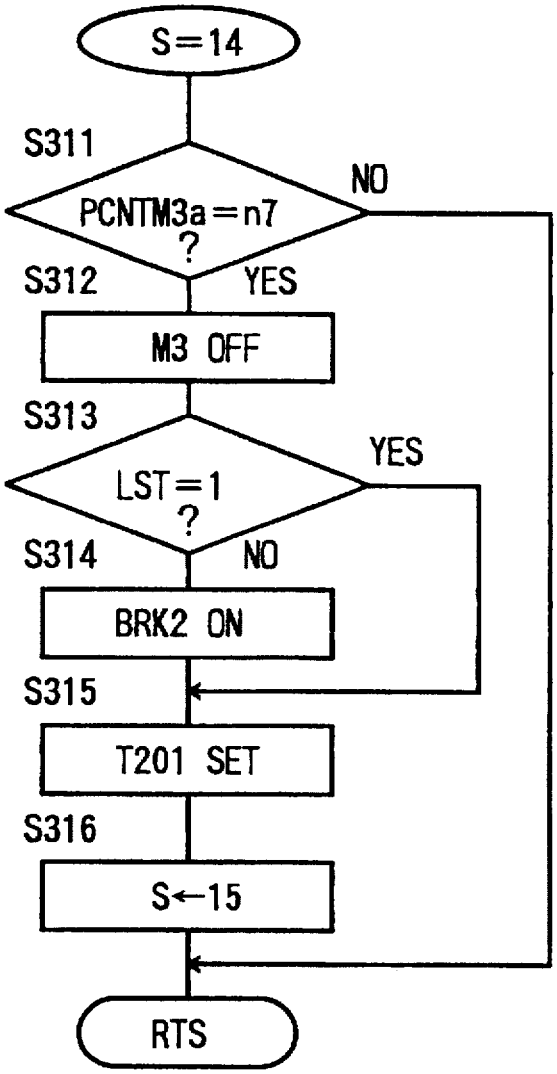
FIG. 40 is a flowchart showing a subroutine for setting a single-sided original in CPU2, continuation of FIG. 39.
Figure 41:
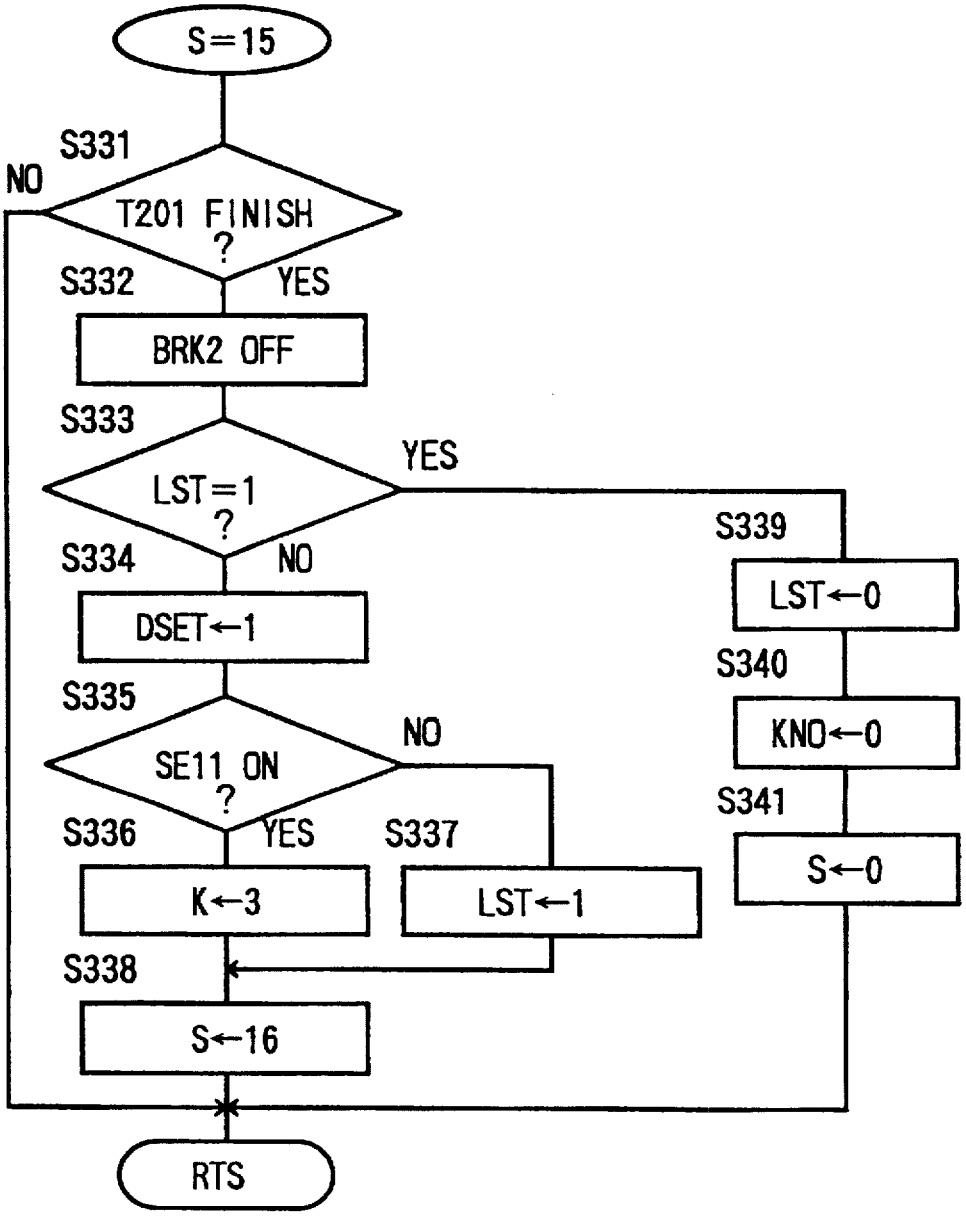
FIG. 41 is a flowchart showing a subroutine for setting a single-sided original in CPU2, continuation of FIG. 40.
Figure 42:
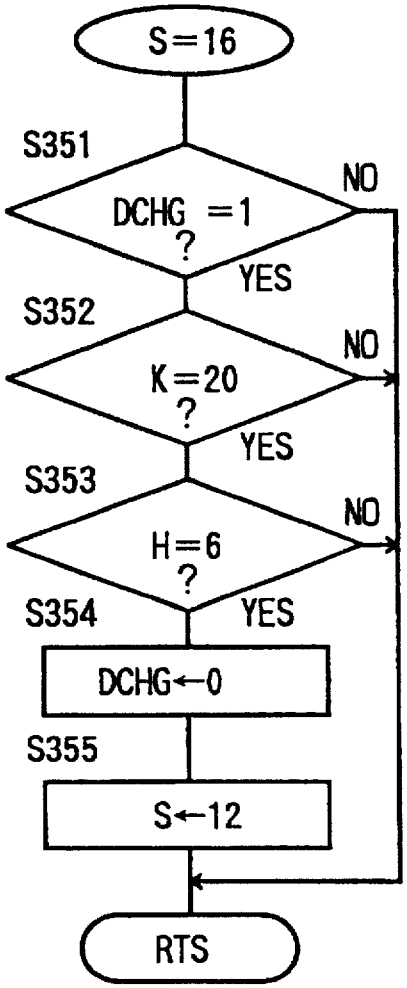
FIG. 42 is a flowchart showing a subroutine for setting a single-sided original in CPU2, continuation of FIG. 41.

FIG. 27 shows a subroutine of start check which is executed at step S41. The subroutine is processed in the case when MODE is '0', i.e. when the ADF50 is standing by for the following process.

At step 61, it is first judged whether empty sensor SE11 is turned on or not. If it is not turned on, it means a state that original is not set in the tray 51, and this subroutine is immediately finished. When the sensor SE11 is turned on (when original is set in the tray 51), it is judged whether feed status K is '2' or not at step S62. When the feed status K is '2', pickup roller is returned to its home position and is standing ready for original exchange. When feed status K is '2', a judgment is made whether flag DCHG is '1' or not at step S63. The flag DCHG is a command for requesting an exchange of originals when it is '1', and is transmitted from the CPU1. The flag DCHG is set to '1' when print key is turned on and at a time point when image scanning for a portion to be copied is finished (return starting time point). If, therefore, when the flag DCHG is '1', it is considered that a command for requesting original exchange is issued, and a check for original transport mode is conducted at step S64.

In the case of a single-sided mode, MODE is set to '1' at steps S65–S68, and feed status K is set to '3' to start a preliminary feeding from original tray, and set status S is set to '01', and by resetting the flag DCHG to '0', this routine is finished.

In the case of a double-sided original, MODE is set to '2' at step S69 to finish this rouble. In the case of 2-in-1 mode, MODE is set to '3' at steps S70–S73, and feed status K is set to '3' to start a preliminary feeding from original tray. Set status S is set to '01', and by resetting the flag DCHGE to '0', this subroutine is finished.

Description will then be made on original feeding/transporting/discharging processes in a preliminary step mode and single-sided normal mode which are executed in subroutines S42–S44 shown in FIG. 26. Counter, pulse and timer which are used in these modes are described first.

Counter PCNTM2: An increment is made every time one pulse is output from encoder E2 of feed motor M2.

Counter PCNTM3*a*: An increment is made every time one pulse is output from encoder E3 of main motor M3.

Counter PCNTM3*b*: An incremenat is made every time one pulse is output from encoder E3 of main motor M3.

Counter PSIZE: Stores the number of pulses which is equivalent to the length of an original.

Counter LST: Displays the number of sheet of originals positioned inside the ADF50. When '0' is shown, it indicates that an original is positioned at a preliminary feed position, preliminary step position and exposure position, and when '1' is shown, it indicates that an original is positioned at a preliminary step position and exposure position (in other words, it indicates that there are two last originals). When '2' is shown, it indicates that an original is positioned only at an exposure position (in other words, it indicates that the original is the last one.)

Pulse n1: The number of pulses from the time the feed motor M2 is turned on to the time the motor is turned off when a preliminary feed process is performed.

Pulse n3: The number of pulses from the time the leading end of a first original is detected by timing sensor SE14 to the time main motor M3 is turned off to stop the original at a preliminary step position.

Pulse n5: The number of pulses from the time the main motor M3 is turned on for transporting an original from a preliminary step position to an exposure position to the time the motor is turned off.

Pulse n7: The number of pulses from the time an original is detected by timing sensor SE14 to the time main motor M3 is turned off to stop the original at an exposure position in a single-sided normal mode.

Pulse nL: The number of pulses when the length of an original corresponds to 216 mm. This is used when a judgment is made whether a preliminary step mode is executed or not comparing with the number of pulses stored in the counter PSIZE.

Pulse n9: The number of pulses from the time an original is detected by timing sensor SE14 to the time feed motor M2 is turned off to stop the original at a preliminary feed position in a single-sided normal mode.

Timer T102: A time is set for a period from the time the leading end of an original sent out of the tray 51 is detected by register sensor SE12 to the time the original is brought in contact with the nip section of the register roller 58 and pinch roller 59*a* and an oblique movement is corrected.

Timer T103: A time is set for a period from the time feed motor M2 is turned off to the time the motor is stopped.

Timer T201: A time is set for a period from the time the electromagnetic brake BRK2 is turned on to the time the transport belt 60 is stopped.

Timer T301: A time is set for a period to delay the start of original discharge.

Timer T302: A time is set for a period from the time the rear end of an original is detected by discharge sensor SE15 to the time the original is discharged onto the tray 69.

Timer T303: A time is set for a period from the time the discharge motor M4 is turned off to the time the motor is stopped.

Description will now be made on original feeding/transporting/discharging processes in a preliminary step mode and single-sided normal mode.

FIGS. 28 through 31 show flowcharts of step S42 in the subroutine shown in FIG. 26.

When status K is '1' (refer to step S36 in initialization), pickup roller 54 is returned to the upper home position. At step S81, pickup motor M1 is first turned on, and at step S82, electromagnetic solenoid SL is turned off. When off-edge of the pickup sensor SE10 is confirmed at step S83, motor M1 is turned off at step S84 assuming that the pickup roller 54 is returned to the home position, and at step #85, status K is set to '2'. When status K is '2', nothing is processed to stand ready for the following process.

When status K is '3' (refer to step S66 for start check, and steps S215, S228 and S336 for a single-sided original set), an original feeding process is started. First, pickup motor M1 is turned on at step S91. At this stage, the pickup roller 54 is brought down, and when on edge of sensor SE10 is confirmed at step S92, the motor M1 is turned off at step S93 since the pickup roller 54 has been brought down to a predetermined position. At step S94, the feed motor M2 is turned on, and at step S95, electromagnetic solenoid SL is turned on whereby a first pressing force N1 acts on the separating rollers 55 and 56. The pickup roller 54, and separating rollers 55 and 56 are rotated simultaneously to forward an original from the tray 51. An original placed uppermost in the tray is separated and transported toward the register roller 58. At this stage, an original transport velocity is a first speed V1, and with a proper pressing force N1 on the separating rollers 55 and 56, originals are properly separated. Further, at step S96, status K is set to '4'.

When status K is '4', a judgment is made at step S101 whether register sensor SE12 is on edge or not. If it is on edge (if the leading end of an original is detected by the sensor SE12), timer T102 is set at step S102, and electromagnetic brake BRK1 is turned on at step S103 whereby the register roller 58 is locked. Then, status K is set to '5' at step S104.

When status K is '5', feed motor M2 is turned off at step S112 after timer T102 is finished at step S111. At this stage, the leading end of an original is brought in contact with the nip section of the register roller 58 and pinch roller 59*a*, and a predetermined amount of loop is formed to correct an oblique movement. Then, timer T103 is set at step S113, and status K is set to '6' at step S104.

When status K is '6', electromagnetic clutch CL is turned on at step S122 after timer T103 is finished at step S121, and electromagnetic brake BRK1 is turned off at step S123 whereby register roller 58 can be rotationally driven by feed motor M2. Then, counter PCNTM2 is reset to '0' at step S124, and electromagnetic solenoid SL is turned off at step S125. At step S126, feed motor M2 is turned on, and at step S127, pickup motor M1 is turned on. Further, at step S128, status K is set to '7'. With feed motor M2 turned on, transport of an original is started by register roller 58 at a second velocity of V2 which is higher than the velocity of V1, and at the same time, the number of pulses from encoder E2 is counted by the PCNTM2. With pickup motor M1 turned on, pickup roller 54 starts to return upward.

On the other hand, by turning off electromagnetic solenoid SL, a second pressing force N2 acts on a gap between the separating rollers 55 and 56. The second pressing force N2 is smaller than a first pressing force N1, and it serves to improve separability of the following original when a preceding original is transported by the higher second velocity of V2 by register roller 58. Since the separating rollers 55 and 56 are rotationally driven in a transport after registration, a loop formed at the leading end portion of original is gradually dissolved thereby loop dissolving noise and damage of original are prevented.

When status K is '7', a judgment is made whether a count value of PCNTM2 is n1 or not at step S131. Generally, at step S135, sensor SE10 is judged under a state of off edge before the PCNTM2 counts a value n1, and pickup motor M1 is turned off at step S136 whereby the pickup roller 54 is returned to its home position. When the value n1 is counted by the PCNTM2, a judgment is made whether a flag KNO is '1' or not at step S137. When the flag KNO is '1', a single-sided normal mode is executed, while when the flag KNO is '0', a preliminary step mode is executed. When a preliminary feed process is performed for a first original, '0' is set (refer to steps S193–S197 which will be described afterward).

When the flag KNO is '0', it means either a preliminary step mode or a preliminary feed for a first original. At step S132, feed motor M2 is turned off, and at the same time, electromagnetic brake BRK1 is turned on at step S133. At step S134, status K is set to '8' whereby the rotation of the register roller 58 is stopped to complete a preliminary feed process. In the preliminary step mode, the leading end of an original is stopped at a time point when it has reached a preliminary standard point P', more particularly, when the leading of the original has been brought to a position before timing sensor SE14.

On the other hand, when the flag KNO is '1' at step S137, it means a single-sided normal mode, and a status K is set to '9' at step S138.

When status K is '8', a value counted by the PCNTM2 is stored in PSIZE. Then, electromagnetic clutch CL is turned off at step S142, and electromagnetic brake BRK1 is turned off at step S143 whereby the connected state of the register roller 58 with the feed motor M2 is released and freed. Further, at step S144, status K is set to '20'.

When status K is '9', a judgment is made whether a state of timing sensor SE14 is on edge or not at step S151. If the state is judged as on edge (if the leading of an original is detected by SE14), PCNTM2 is reset to '0', and at the same time, counting process is started. Then, at step S153, a judgment is made whether the number of pulses counted by the PCNTM2 is n9 or not, and if the number of pulses is n9, status K is set to '10' at step S154.

When status K is '10', feed motor M2 is turned off at step S155, and at the same time, electromagnetic brake BRK1 is turned on at step S156, and status K is set to '11' at step S157 whereby the rotation of the register roller 58 is stopped to complete a preliminary feed of an original. In the single-sided normal mode, the leading end of an original is stopped at a time point when it has reached a downstream position of the timing sensor SE14, and a predetermined space is maintained between the leading end of the original preliminarily fed and the rear end of an original positioned at an original exposure position. Since a space between originals becomes smaller than the case when the leading end of an original is positioned at the standard point P', exchange of originals can be performed faster than the case when the leading end of an original is positioned at the standard point P'.

When status K is '11', the same processes as performed in steps S142 through S144 are executed at steps S158 through S160.

When status K is '20', no further process is performed, and stand ready for the following process since a preliminary feed process is finished.

FIGS. 32 through 42 show subroutines for placing a single-sided original on a predetermined position of the platen glass 29 which is executed at step S43.

In the subroutine, status S is checked at step S170, and the following processing are performed based on the values '0'–'16'.

When status S is '0' (at an initial stage), MODE is set to '0' at step S171, and feed status K is set to '2' at step S172. When status S is '1', main motor M3 is turned on at step S175, and status S is set to '2' at step S176. At this stage, register roller 58 and transport belt 60 are rotationally driven to start forwarding an original preliminarily fed onto the platen glass 29.

When status S is '2' and the state of timing sensor SE14 is confirmed as on edge, in other words, when the leading end of an original is detected by the sensor SE14, PCNTM3*a* which counts the number of pulses output from encoder E3 of main motor M3 is reset to '0' at step S182, and a counting process is started simultaneously. Then, status S is set to '3' at step S183.

When status S is '3' and the state of timing sensor SE12 is confirmed as off edge, in other words, when the rear end of an original is detected by the sensor SE12, a value counted by PSIZE (refer to step S141) is added to a value counted by PCNTM3*a* at this time point, and the value summed up is stored into PSIZE at step S192. The value corresponds to the length of an original. Then, PSIZE and pulse nL are compared at step S193.

The value nL is the number of pulses which corresponds to the length of an original 216 mm. If PSIZE is smaller than nL, flag KNO is set to '0' at step S194, and status S is set to '4' at step S195 to execute a preliminary step mode. On the other hand, if PSIZE is≧ nL, flag KNO is set to '1' at step S196, and status S is set to '14' at step S197 to execute a single-sided normal mode. When a preliminary step mode is executed, the flag KNO is set to '0', and in the case of a sing-sided normal mode, the flag KNO is set to '1'.

When status S is '4', after confirming that a value counted by PCNTM3 has reached n3 at step S201, main motor M3 is turned off at step S202, and electromagnetic brake BRK2 is turned on at step S203 whereby an original is positioned at a preliminary step position. Then, timer T201 is set at step S204, and status S is set to '5' at step S205.

When status S is '5', after confirming the completion of timer T201 at step S211, in other words, after transport belt 60 has completely stopped, electromagnetic brake BRK2 is turned off at step S212. Then, a judgment is made whether empty sensor SE11 is turned on or turned off at step S213. If the sensor SE11 is turned on, it means that the following original is on the tray 51 so that feed status K is set to '3' at step S215, and status S is set to '6' at step S216. When the sensor SE11 is turned off, it means that all originals on the tray 51 are fed so that LST is set to '1' at step S214, and status S is set to '6' at step S216.

When status S is '16', a judgment is made whether feed status K is '2' or not at step S221. If the status K is set to '20', it means that a preliminary feed process for the next original is completed so that PCNTM3*b* is reset to '0' at step S222, and a counting process is started simultaneously. Then, a judgment is made whether flag DSET is '1' or not at step S223. The flag DSET indicates that an original is set at an exposure position (refer to step S264). When the flag DSET is '0', the program moves to step S226. If the flag DSET is '1', the flag DSET is reset to '0' at step S224, and discharge status H which is used for discharging an original onto the tray 69 is set to '1'. Then, the program moves to step S226.

At step S226, main motor M3 is turned on, and then, a value of counter LST is checked at step S227. The LST indicates the number of originals in the ADF50. If it indicates '0', it means that an original exists at a preliminary feed position. In this case, feed status K is set to '3' at step S228, and status S is set to '7' at step S229 whereby a preliminary feed process on and after third originals is started simultaneously with a timing that main motor M3 is turned on at step S226. If the LST is not '0', it means that an original does not exist at a preliminary feed position. In this case, the LST is increased to '1' at step S230, and status S is set to '9' at step S231.

When status S is '7', after confirming the state of timing sensor SE14 as on edge at step S235, in other words, when the leading end of an original is detected by the sensor SE14, PCNTM3*a* is reset to '0', and a counting process is started. An amount of transport of the following original to a preliminary step position is measured hereat. Then, status S is set to '8' at step S237.

When status S is '8', after the state of register sensor SE12 is confirmed as off edge at step S241, in other words, when the rear end of an original has passed through a detecting location of the sensor SE12, a judgment is made whether empty sensor SE11 is turned on or turned off at step S242. If the sensor SE11 is turned on, it means that the following original is on the tray 51 so that status S is set to '9' at step S243, and the program moves to an original suspending action. When the sensor SE11 is turned off, it means that all the originals on the tray 51 are fed so that feed status K is set to '1' at step S244, and counter LST is set to '1' at step S245.

When status S is '92 , after confirming that a value counted by PCNTM3*b* has reached n5 at step S251, main motor M3 is turned off at step S252, and a value of counter LST is checked at step S253. If the value of LST is other than '2', in other words, if at least two sheets of originals exist on the platen glass 29 before an original transport process is started, electromagnetic brake BRK2 is turned on at step S254, and timer T201 is set at step S255. When the value of LST is '2', it means that only the last original exists at an exposure position before an original transport process is started so that timer T201 is set at step S255 without turning on the electromagnetic brake BRK2 (for the purpose of discharging an original). Then, at step 256, status S is set to '10'.

When status S is '02 , after confirming that timer T201 has finished at step S261, in other words, after transport belt 60 has completely stopped, electromagnetic brake BRK2 is turned off at step S262. Then, a value of counter LST is checked at step S263. If the value is '2', in other words, only when the last original exists at an exposure position, the LST is reset to '0' at step S266, and status S is reset to '0' at step S267 to finish this subroutine. When the LST is other than '2', if at least two sheets of originals exist on the platen glass 29, flag DSET is set to '1' at step S264. The flag DSET indicates that an original is set at an exposure position. Further, at step S265, status S is set to '11'.

When status S is '11', flag DCHG is reset to '0' at step S284 after confirming that flag DCHG is '1' at step S281 (request for original exchange), feed status K is '20' at step S282 (completion of a preliminary feed process), and discharge status H is '6' at step S283 (completion of discharging process). At step S285, status S is set to '6', and original exchange process is restarted.

When status S is '12' (when a single-sided normal mode is executed, refer to step S355), a judgment is made whether flag DSET is '1' or not at step S291. If it is '0', main motor M3 is turned on at step S294. When it is '1', in other words, when an original is set at exposure position, flag DSET is reset to '0' at step S292. Discharge status H is then set to '1' at step S293, and main motor M3 is turned on at step S294 whereby a process for discharging originals from the exposure position is started. Then, a value of counter LST is checked at step S295. When LST is '0', it means that the following original has already been fed preliminarily so that status S is set to '13' at step S296. If the LST is not '0', in other words, if original does not exist at a preliminary feed position, PCNTM3*a* is reset to '0' at step S297, and at the same time, a counting process is started. Then status S is set to '14' at step S298. When status S is '13', status S is set to '14' at step S301.

When status S is '14', main motor M3 is turned off at step S312 after confirming that a value of PCNTM3*a* has reached n7 at step S311, and a value of counter LST is checked at step S313. If the LST is not '1', in other words, when the following original exists at a preliminary feed position, electromagnetic brake BRK2 is turned on at step S314, and the program proceeds to step S315. When the LST is '1', in other words, when original dose not exist in a preliminary feed position and only the last original is set at an exposure position, timer T201 is set at step S315 maintaining the off state of electromagnetic brake BRK2, and status S is set to '15' at step S316.

When status S is '15', electromagnetic brake BRK2 is turned off at step S332 after confirming that timer T201 is finished at step S331, in other words, after transport belt 60 has completely stopped. Then, at step S333, a value of counter LST is checked.

On the other hand, if LST is '1', (if YES at step S333), it means that the last original had already been discharged so that LST is reset to '0' at step S339, and flag KNO is reset to '0' at step S340. Further, status S is reset to '0' at step S341 to complete this subroutine.

When status S is '16', flag DCHG is reset to '0' at step S354 after confirming that flag DCHG is '1' (request for original exchange) at step S351, feed status K is '20' (completion of a preliminary feed process) at step S352, and discharge status H is '6' (completion of discharge process) at step S353. Further, status S is set to '12' at step S355, and a process for exchanging originals is restarted.

Figure 43:
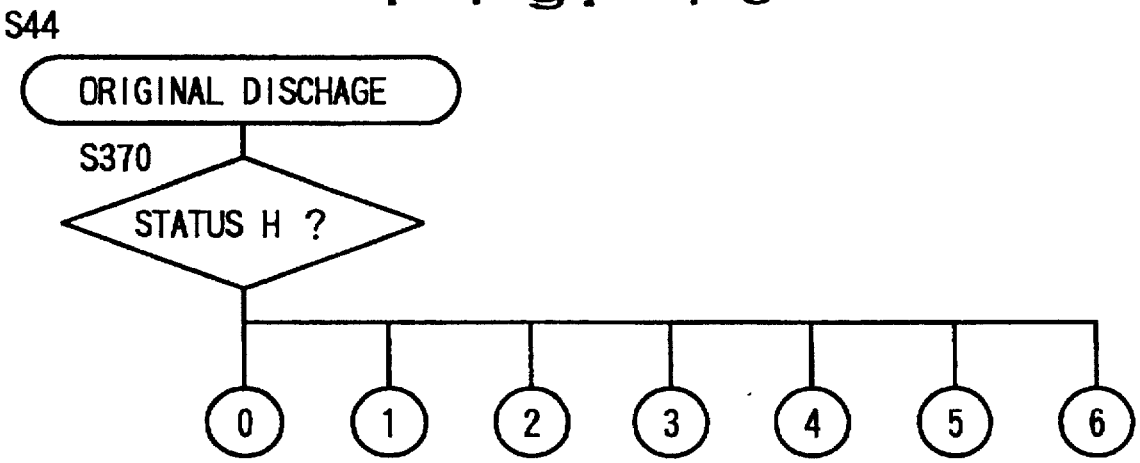
FIG. 43 is a flowchart showing a subroutine of an original discharging process in CPU2.
Figure 44:
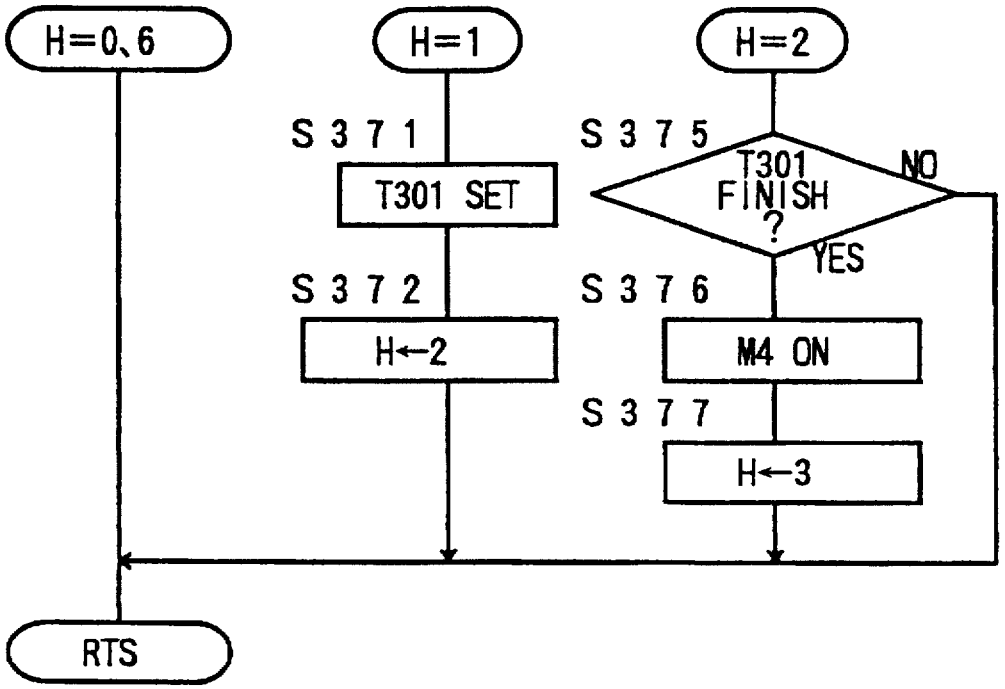
FIG. 44 is a flowchart showing a subroutine of an original discharging process in CPU2, continuation of FIG. 43.
Figure 45:
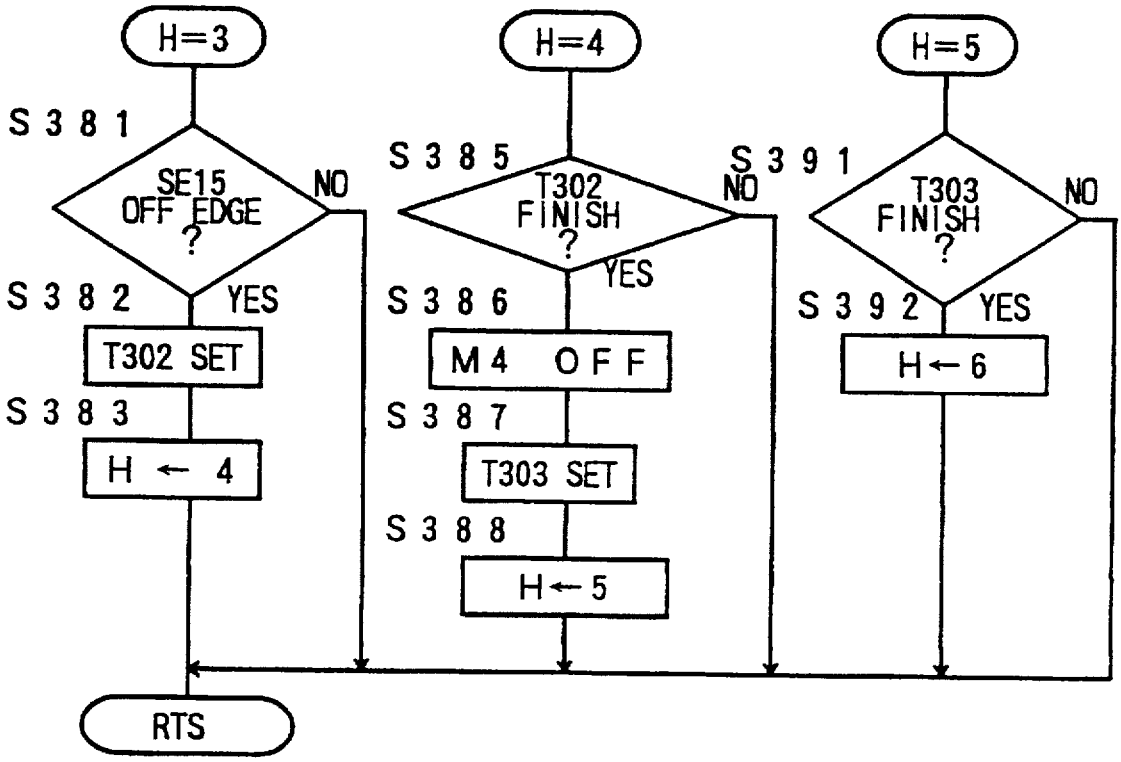
FIG. 45 is a flowchart showing a subroutine of an original discharging process in CPU2, continuation of FIG. 44.
Figure 46:
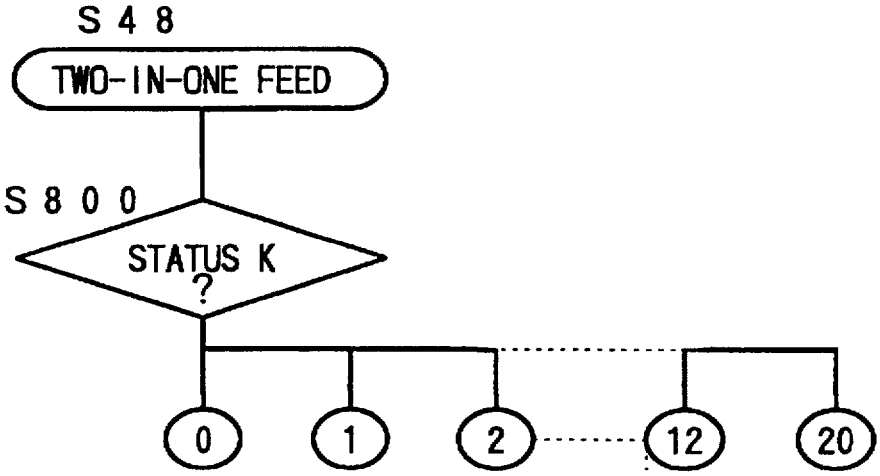
FIG. 46 is a flowchart showing a subroutine for 2-in-1 original feeding process in CPU2.
Figure 47:
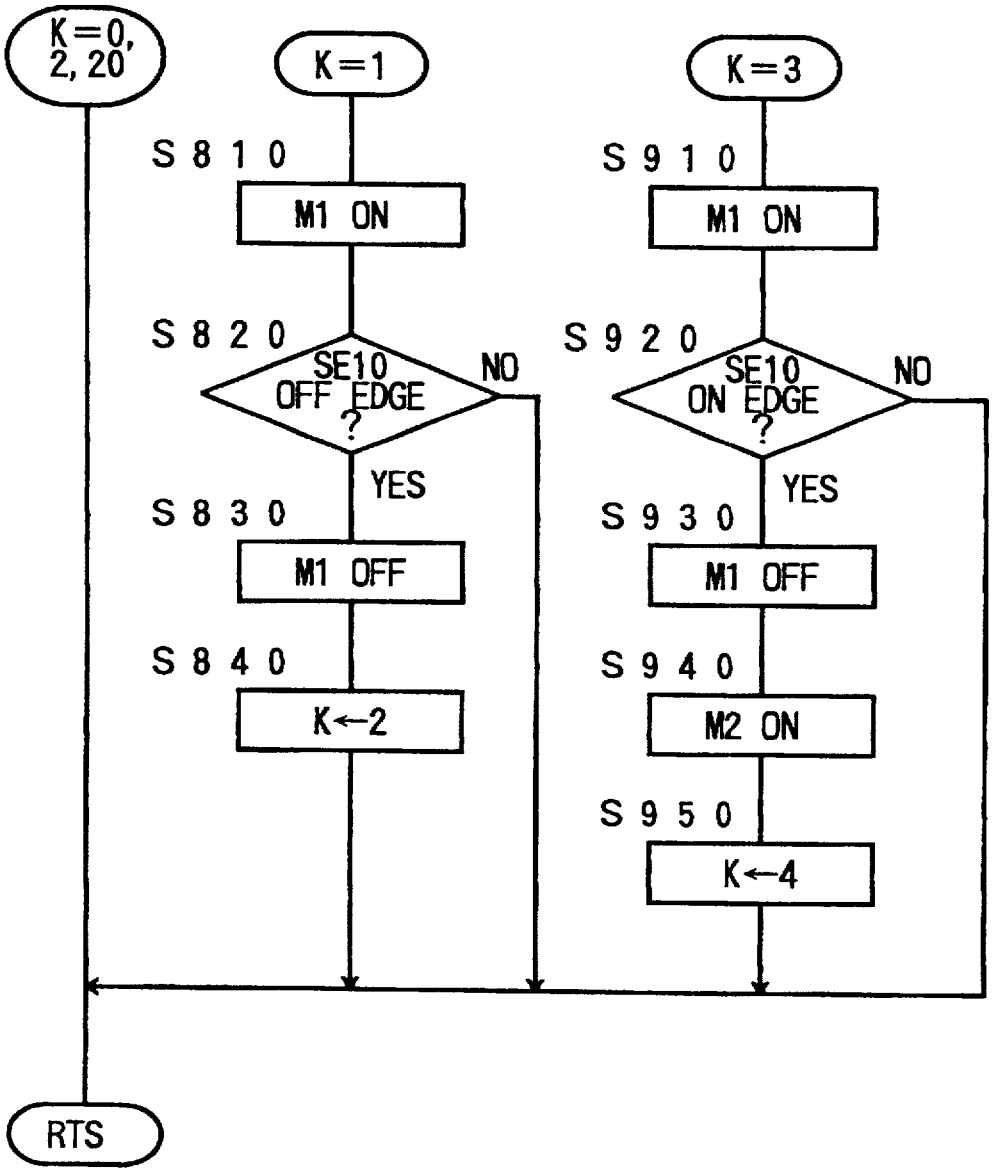
FIG. 47 is a flowchart showing a subroutine for 2-in-1 original feeding process in CPU2, continuation of FIG. 46.
Figure 48:
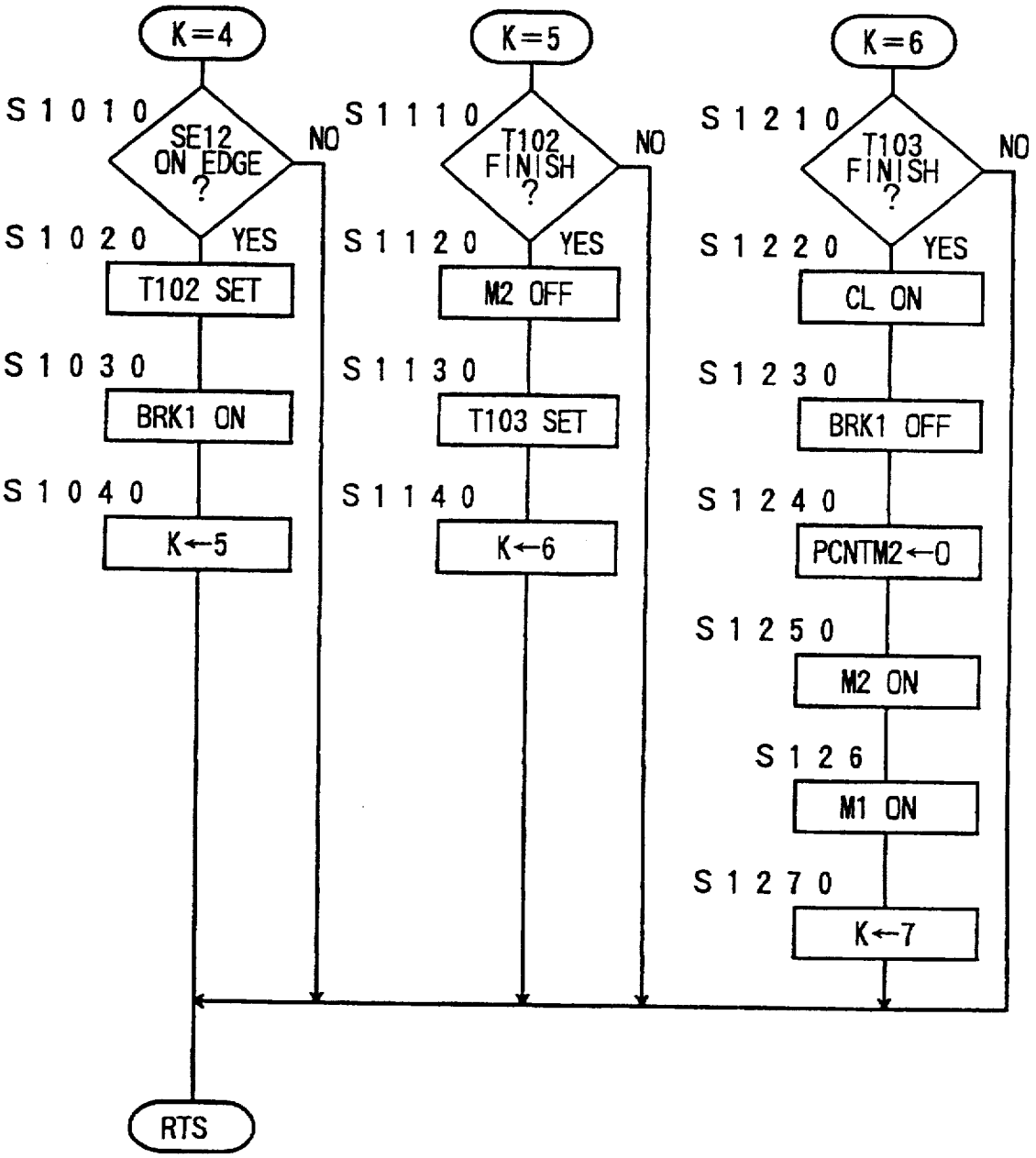
FIG. 48 is a flowchart showing a subroutine for 2-in-1 original feeding process in CPU2, continuation of FIG. 47.
Figure 49:
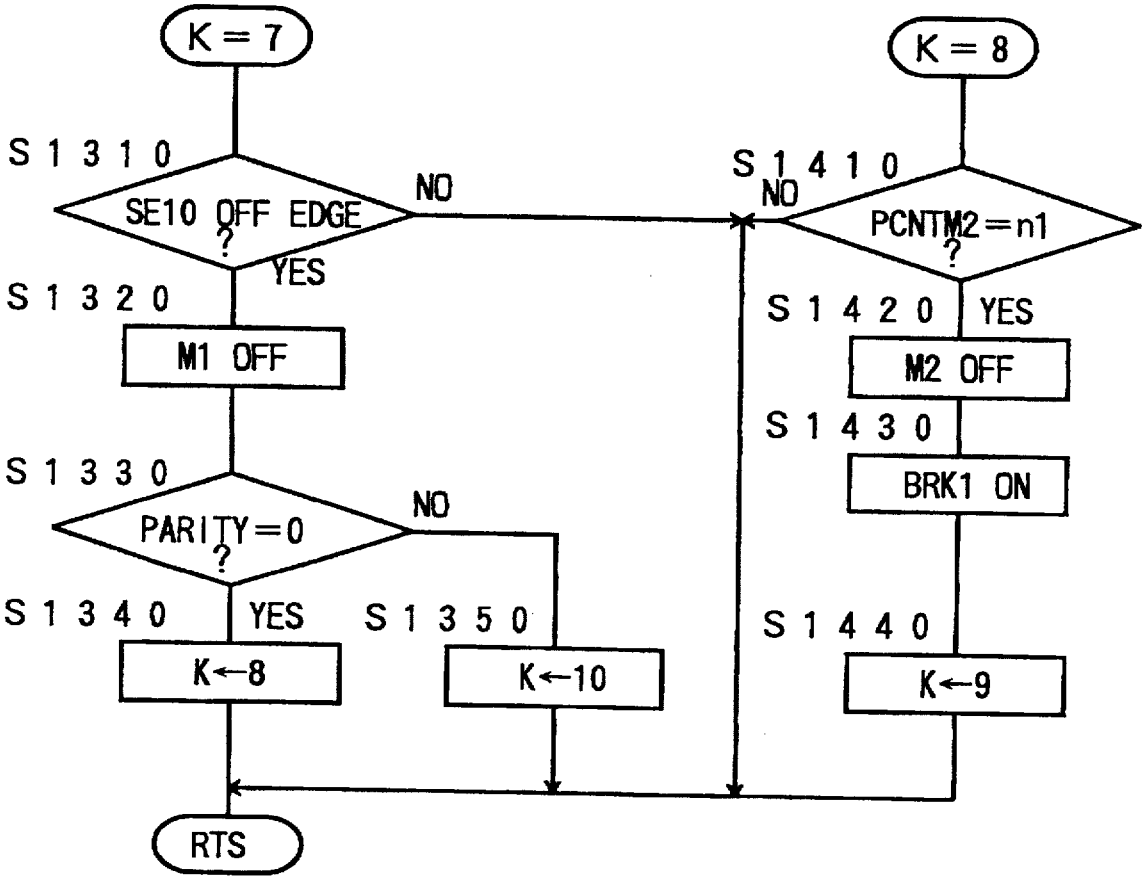
FIG. 49 is a flowchart showing a subroutine for 2-in-1 original feeding process in CPU2, continuation of FIG. 48.
Figure 50:
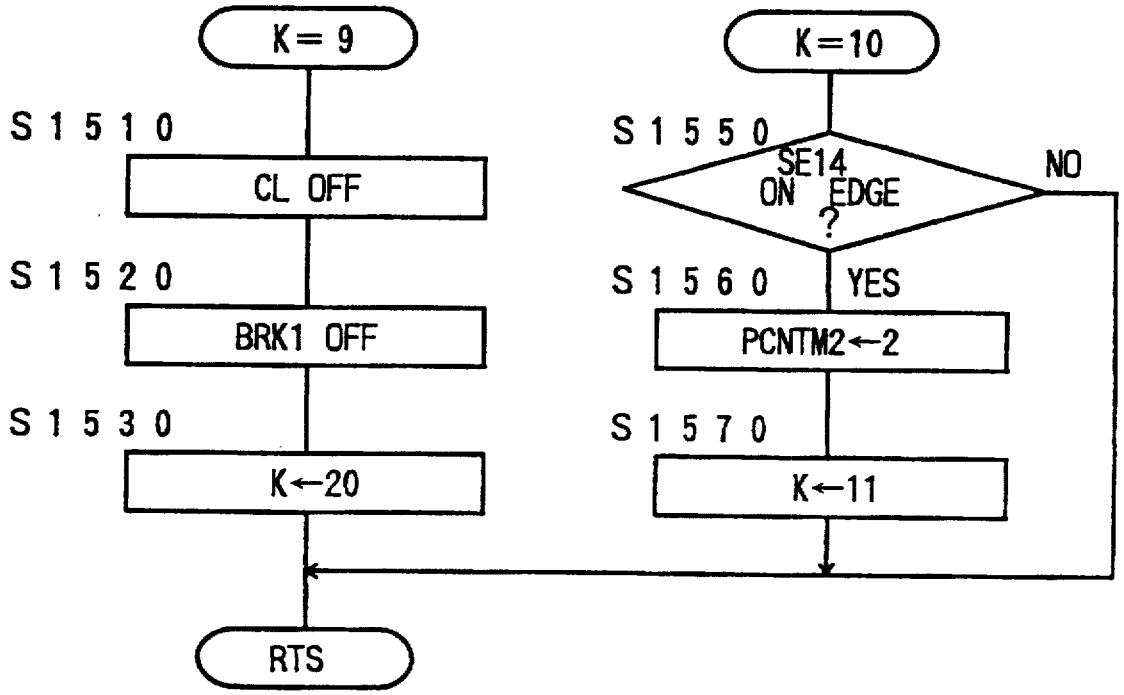
FIG. 50 is a flowchart showing a subroutine for 2-in-1 original feeding process in CPU2, continuation of FIG. 49.
Figure 51:
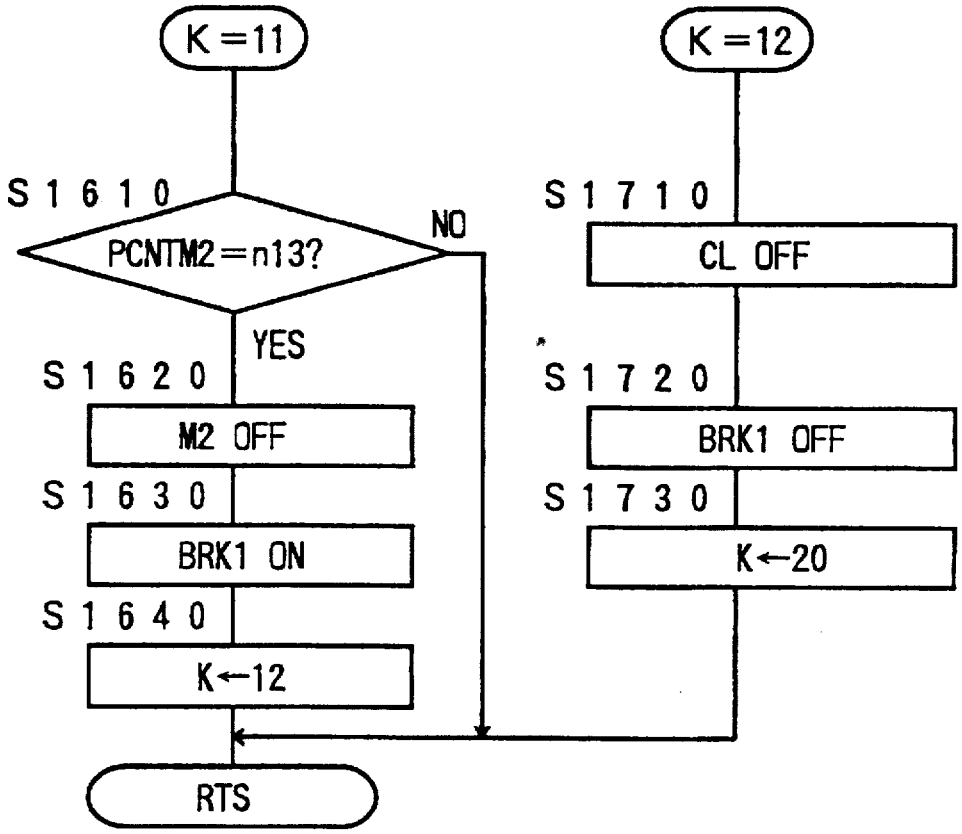
FIG. 51 is a flowchart showing a subroutine for 2-in-1 original feeding process in CPU2, continuation of FIG. 50.
Figure 52:
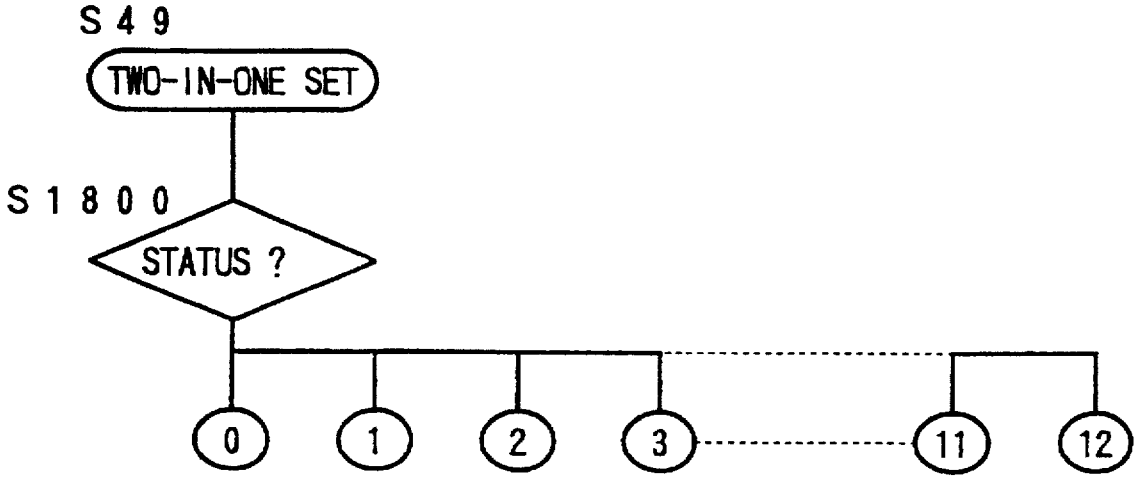
FIG. 52 is a flowchart showing a subroutine of 2-in-1 setting in CPU2.
Figure 53:
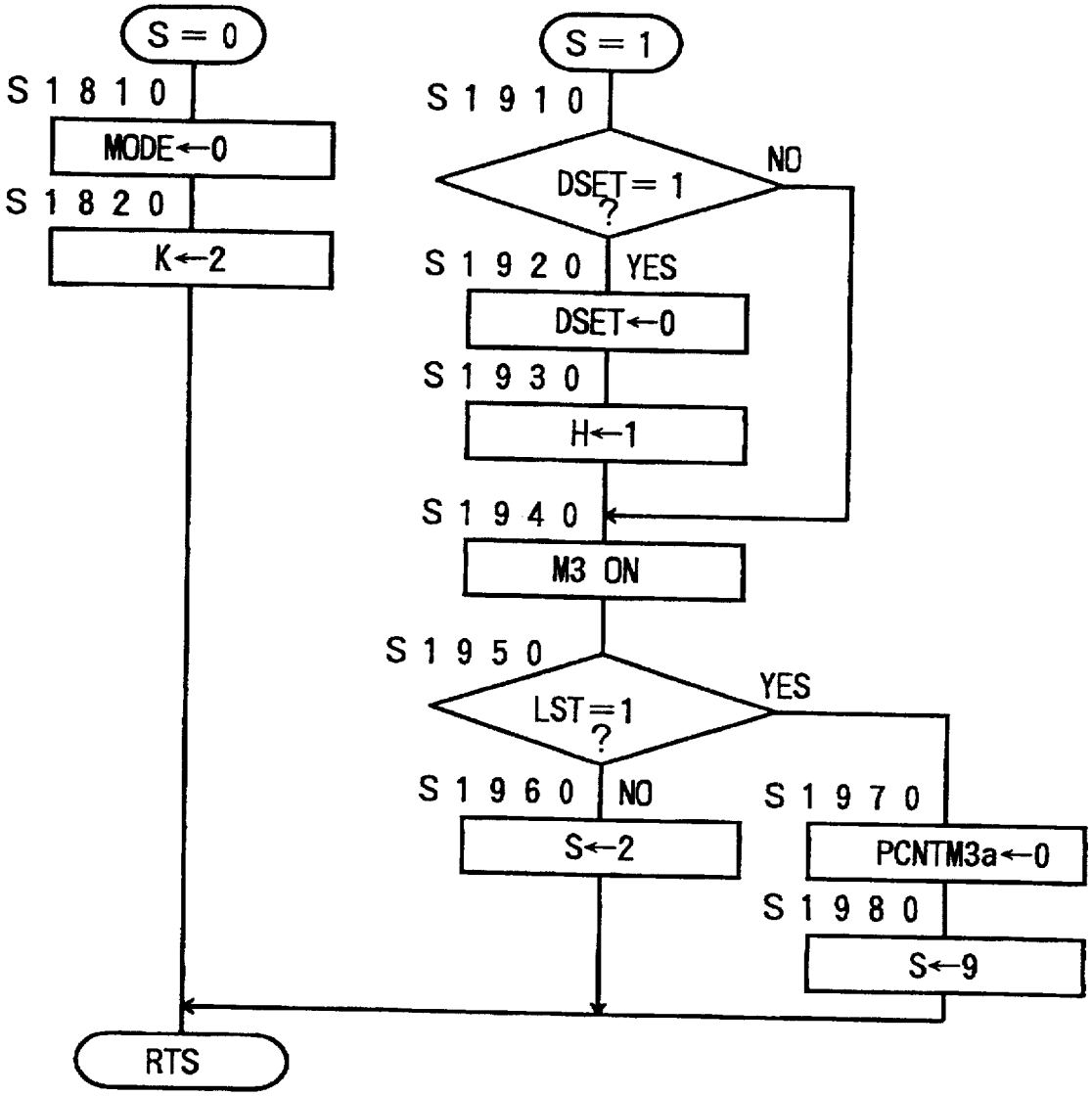
FIG. 53 is a flowchart showing a subroutine of 2-in-1 setting in CPU2, continuation of FIG. 52.
Figure 54:
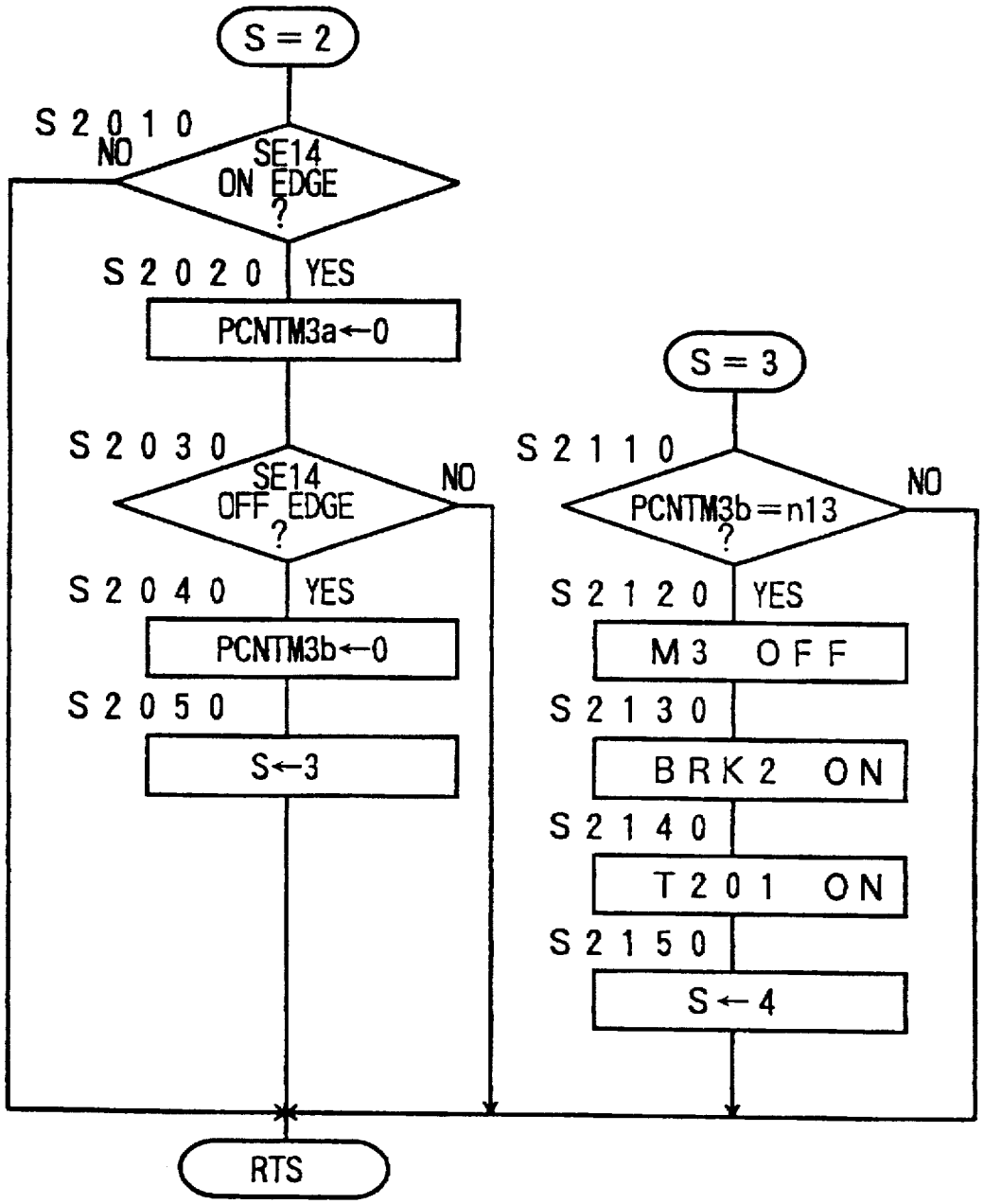
FIG. 54 is a flowchart showing a subroutine of 2-in-1 setting in CPU2, continuation of FIG. 53.
Figure 55:
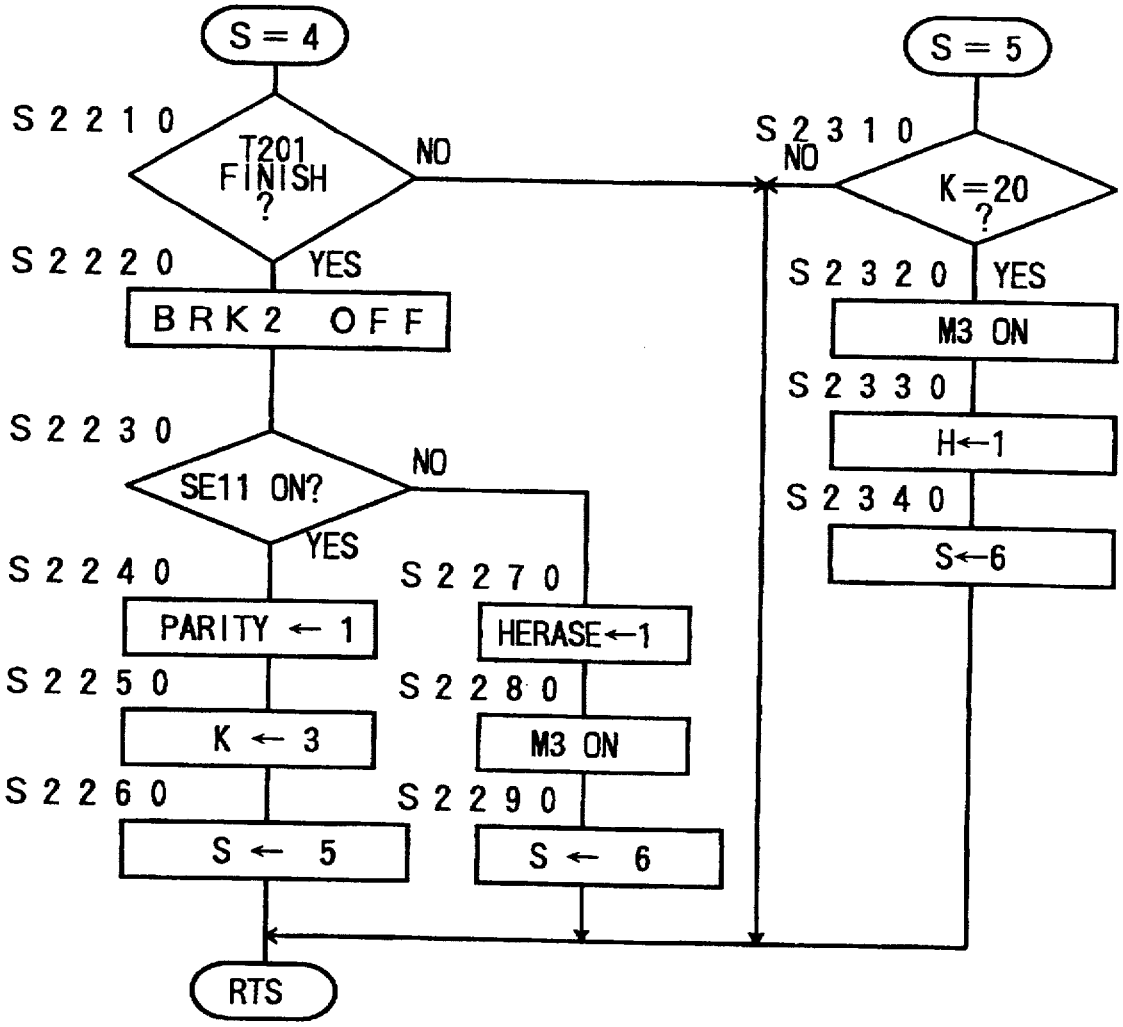
FIG. 55 is a flowchart showing a subroutine of 2-in-1 setting in CPU2, continuation of FIG. 54.
Figure 56:
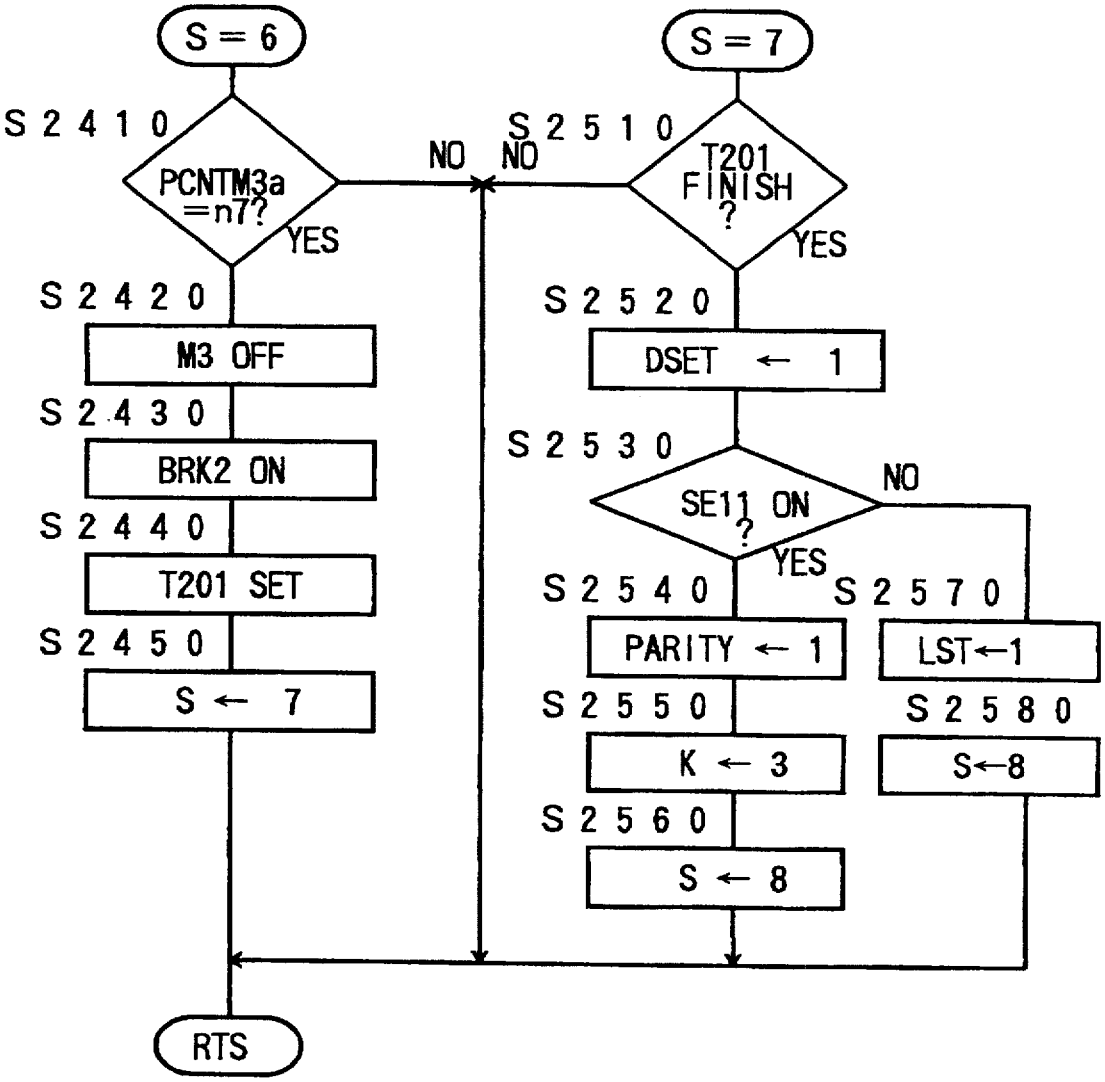
FIG. 56 is a flowchart showing a subroutine of 2-in-1 setting in CPU2, continuation of FIG. 55.
Figure 57:
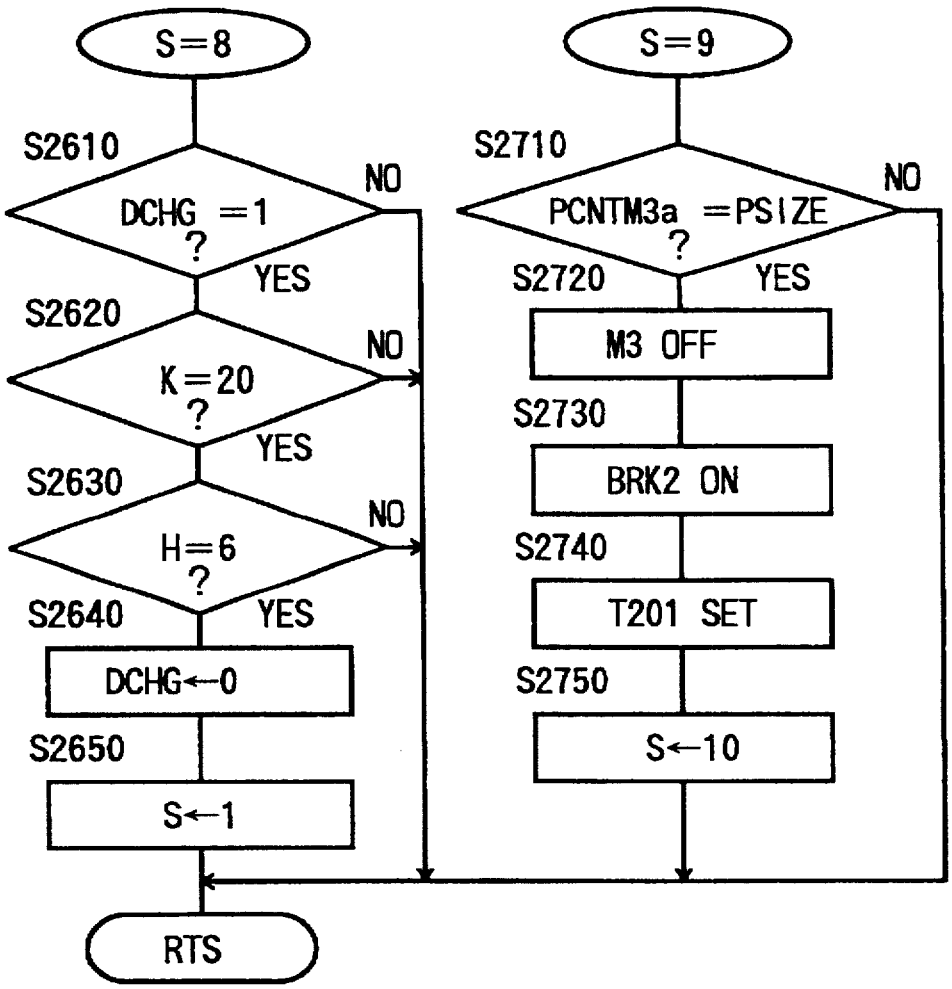
FIG. 57 is a flowchart showing a subroutine of 2-in-1 setting in CPU2, continuation of FIG. 56.
Figure 58:
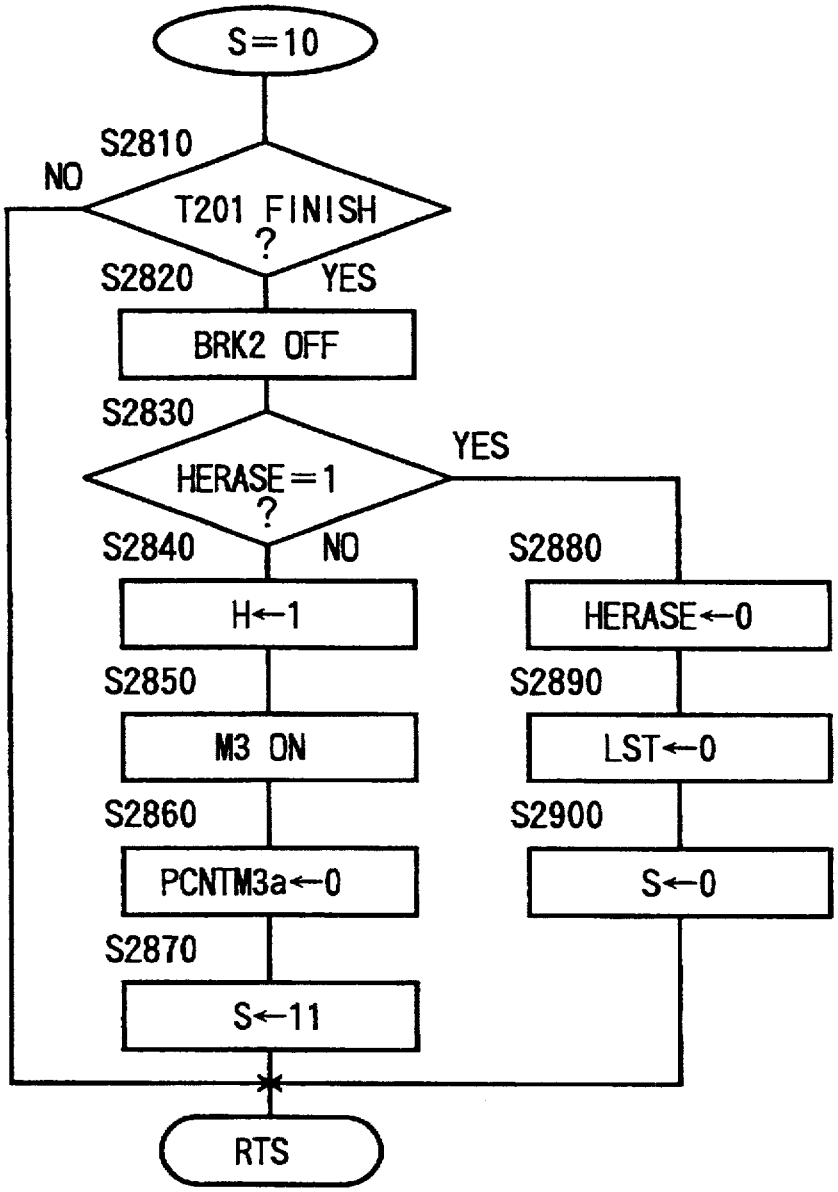
FIG. 58 is a flowchart showing a subroutine of 2-in-1 setting in CPU2, continuation of FIG. 57.
Figure 59:
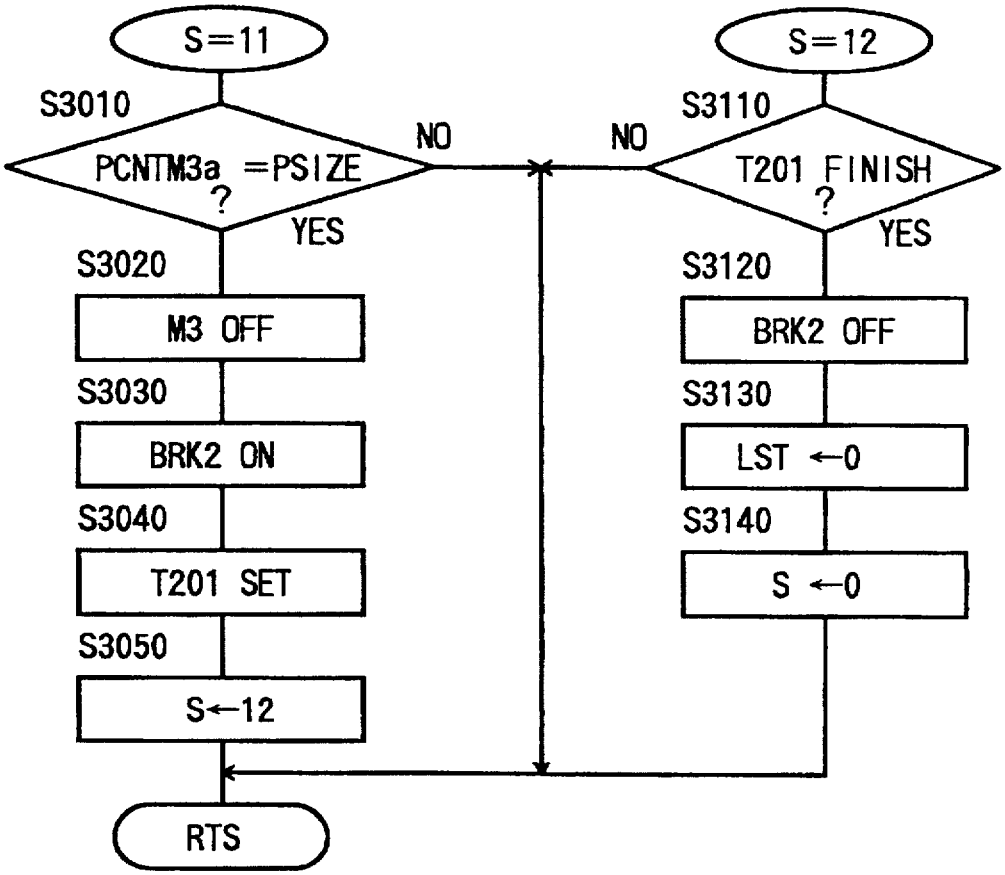
FIG. 59 is a flowchart showing a subroutine of 2-in-1 setting in CPU2, continuation of FIG. 58.

FIGS. 43 through 45 show subroutines for original discharge process which is performed at step S44.

Discharge status H is checked at step S370, and the following processes are executed based on values '0' through '6'. When status H is '0', it means a state of initialization, and therefore, any process is not performed.

When status H is '1' (when an original is discharged from exposure position, refer to steps S225 and S293), timer T301 is set at step S371, and status H is set to '2' at step S372. The timer T301 is provided for delaying the drive of discharge motor M4 until immediately before the leading end of an original reaches reverse/discharge roller 65.

When status H is '2', discharge motor M4 is turned on at step S376 after confirming that timer T301 has finished at step S375, and status H is set to '3' at step S377. At this stage, reverse/discharge roller 65 and discharge roller 68 start rotation, and an original is discharged onto tray 69.

When status H is '3', timer T302 is set at step S382 after confirming that discharge sensor SE15 is off edge state at step S381, in other words, after the rear end of an original is detected by the sensor SE15, and then, status H is set to '4'.

When status H is '4', discharge motor M4 is turned off at step S386 after confirming that timer T302 has finished at step S385, in other words, after an original has completely been discharged onto tray 69. Further, timer T303 is set at step S387, and status H is set to '5' at step S388.

When status H is '5', status H is set to '6' at step S392 after confirming that timer T303 has finished at step S391, in other words, when discharge motor M4 has completely stopped.

When status H is '6', any process is not taken, and stand ready for the following process.

A document feeding apparatus related to the present invention is not limited to the above described embodiment, and it may variably be modified within the scope of the invention.

Now, description will be made on original feeding/transporting/discharging processes under 2-in-1 mode. To begin with, description will be made on counters, pulses and timers which are used for control under this mode.

Counter PCNTM2: An increment is made every time one pulse is output from encoder E2 of main motor M2.

Counter PCNTM3*a*: An increment is made every time one pulse is output from encoder E3 of main motor M3.

Counter PCNTM3*b*: An increment is made every time one pulse is output from encoder E3 of main motor M3.

Counter PSIZE: Under 2-in-1 mode, the number of pulses which corresponds to a short side dimension of A4 size sheet is preliminarily stored.

Counter LST: Displays the number of sheet of originals positioned inside the ADF50. When it shows '0', it means that an original is placed at a preliminary feed position, intermediate waiting position and exposure position. When it shows '1', it means that an original is placed only at an exposure position.

Pulse n1: The number of pulses from the time feed motor M2 is turned on to the time the motor is turned off when an odd-numbered original is preliminarily fed.

Pulse n13: The number of pulses from the time the rear end of an odd-numbered original is detected by timing sensor SE14 to the time main motor M3 is turned off to stop the original at an intermediate waiting position. The number of pulses from the time the leading end of an even-numbered original is detected by timing sensor SE14 to the time feed motor M2 is turned off to stop the original at a preliminary feed position.

Pulse n7: The number of pulses from the time the leading end of an odd-numbered original is detected by timing sensor SE14 to the time main motor M3 is turned off to stop the original at an exposure position.

Timer T102: A time is set for a period from the time the leading end of an original forwarded from tray 51 is detected by register sensor SE12 to the time it is brought in contact with the nip section of register roller 58 and pinch roller 59*a* and an oblique feeding is corrected.

Timer T103: A time is set for a period from the time feed motor M2 is turned off to the time the motor is stopped.

Timer T201: A time is set for a period from the time electromagnetic brake BRK2 is turned on to the time transport belt 60 is stopped.

Timer T301: A time is set for a period to delay the start of original discharge.

Timer T302: A time is set for a period from the time the rear end of an original is detected by discharge sensor SE15 to the time the original is discharged onto tray 69.

Timer T303: A time is set for a period from the time discharge motor M4 is turned off to the time the motor is stopped.

Description will be made on original feeding/transporting/discharging processes under 2-in-1 mode.

FIGS. 46 through 51 show subroutines of document feeding which is executed at step S48.

In this subroutine, feed status K is checked at step S800, and the following processes are performed based on values '0'–'12' and '20'. At the initial stage, the status K is reset to '0', and any process is not taken.

When status K is '1' (refer to initialization process at step S36), pickup roller 54 is returned to its upper home position. In other words, pickup motor M1 is turned on at step S810, and the motor M1 is turned off at step S830 when the state of off edge of pickup sensor SE10 is confirmed at step S820 assuming that the pickup roller had returned to its home position. Status K is then set to '2' at step S840.

When status K is '2', any action is not taken and stands ready for the following process.

When status K is '3' (refer to the start check at step S70, 2-in-1 set at steps S225*a* and S255*a*), document feeding process is started. Pickup motor M1 is first turned on at step S910. At this stage, pickup roller 54 is brought down, and motor M1 is turned off at step S930 when the state of on edge of sensor SE10 is confirmed at step S920 since the pickup roller 54 has been brought down to a predetermined position. Feed motor M2 is then turned on at step S940, and status K is set to '4' at step S950 whereby the pickup roller 54 and separating rollers 55, 56 are rotated to forward an original from tray 51, and an original placed at the uppermost is separated into one to be transported toward register roller 58.

When status K is '4', a judgment is made whether register sensor SE12 is at the state of on edge or not at step S1010. In the case of the state of on edge (if the leading end of original is detected by the sensor SE12), timer T102 is set at step S1020, and electromagnetic brake BRK1 is turned on at step S1030 whereby register roller 58 is locked. Then, status K is set to '5' at step S1040.

When status K is '5', feed motor M2 is turned off at step S1120 after timer T102 is finished at step S1110. At this stage, the leading end of an original is brought in contact with the nip section of register roller 58 and pinch roller 59*a* forming a predetermined amount of loop, and an oblique movement is corrected. Then, at step S1130, timer T103 is set, and status K is set to '6' at step S1040.

When status K is '6', electromagnetic clutch CL is turned on at step S1220 after timer T103 is finished at step S1210, and electromagnetic brake BRK1 is turned off at step S1230 whereby register roller 58 is ready to be rotationally driven by feed motor M2. Then, counter PCNTM2 is reset to '0' at step S1240, and feed motor M2 is turned on at step S1250. At step S1260, pickup motor M1 is turned on, and status K is set to '7' at step S1270. With the turning on of the feed motor M2, transport of an original is started by register roller 58, and at the same time, PCNTM2 starts counting the number of pulses from encoder E2. With the pickup motor M1 turned on, pickup roller 54 starts returning to upper position.

When status K is '7', pickup motor M1 is turned off at step S1320 after the state of pickup sensor SE10 is judged as off edge at step S1310 whereby pickup roller 54 is returned to its home position. Then, a judgment is made whether flag PARITY is '0' or not at step S1330. The flag PARITY is reset to '0' in an initialization process and when an odd-numbered original is preliminarily fed (refer to step S2540). The flag is set to '1' when an even-numbered original is preliminarily fed (refer to step S2240). If, therefore, the flag PARITY is '0', status K is set to '8' at step S1340, and the program moves to an odd-numbered original feeding process. When the flag is '1', status K is set to '10' at step S1350, and the program moves to an even-numbered original feeding process.

When status K is '8', a judgment is made whether a value counted by PCNTM2 is n1 or not at step S1410. When a value n1 is counted, feed motor M2 is turned off at step S1420. Electromagnetic brake BRK1 is then turned on at step S1430, and status K is set to '9' at step S1440 whereby the rotation of register roller 58 is stopped to finish a preliminary document feeding process. The PCNTM2 is reset to '0' when an odd-numbered original is fed, and the odd-numbered original is stopped at a time point when the leading end has reached a preliminary feed standard point P with pulse n1.

When status K is '9', electromagnetic clutch CL is turned off at step Sl510, and electromagnetic brake BRK1 is turned off at step S1520 whereby register roller 58 is released from contact with feed motor M2, and is freed. Further, at step S1530, status K is set to '20'.

When status K is '10', in other words, when an even-numbered original is fed, a judgment is made whether the state of timing sensor SE14 is on edge or not at step S1550. At the time when the sensor SE14 becomes the state of on edge, in other words, when the leading end of an even-numbered original is detected by the sensor SE14, PCNTM2 is reset to '0' at step S1560, and at the same time, a counting process is started. Then, status K is set to '11' at step S1570.

When status K is '11', feed motor M2 is turned off at step S1620 after confirming that a value counted by PCNTM2 has reached n13 at step S1610, and electromagnetic brake BRK1 is turned on at step S1630 whereby an odd-numbered original is stopped at a preliminary feed position. At this stage, the leading end of the original is positioned at a preliminary feed standard point P', and a space between the rear end of an even-numbered original which is being stopped at an intermediate waiting position is made zero. Further, at step S1640, status K is set to '12'.

When status K is '12', electromagnetic clutch CL is turned off at step S1710. Electromagnetic brake BRK1 is then turned off at step S1720, and status K is set to '20' at step S1730 whereby register roller 58 is released from the contact with feed motor M2, and is freed. When status K is '20', any action is not taken, and wait ready for the following process since a preliminary feed process is completed.

FIGS. 52 through 59 show subroutines for setting two sheets of originals at a predetermined position on the platen glass 29 which is processed at step S49.

In this subroutine, status S is checked at step S1800, and based on values '0'–'12', the following processes are performed.

When status S is '0' (at initial stage), MODE is reset to '0' at step S1810, and feed status K is set to '2' at step S1820.

When status S is '1', a judgment is made whether flag DSET is '1' or not at step S1910. The flag DSET indicates that an original is set at an exposure position (refer to step S2520).

If the flag DSET is '0', the program moves to step S1940. When the flag is '1', the flag DSET is reset to '0' at step S1920, and discharge status H which is utilized for discharging an original onto tray 69 is set to '1' at step S1930. Then, the program moves to step S1940.

At step S1940, main motor M3 is turned on whereby register roller 58 and transport belt 60 are rotationally driven, and an original preliminarily fed is forwarded onto the platen glass 29. Then, a value of counter LST is checked at step S1950. When the LST is '0', it indicates that an odd-numbered original is placed at a preliminary feed position, and when the LST is '1', it indicates that an odd-numbered original is positioned neither in the tray 51 not at a preliminary feed position. If, therefore, the LST is '0', status S is set to '2' at step S1960, and the program moves to a transport process of an odd-numbered original toward an intermediate waiting position. When the LST is '1', PCNTM3*a* which counts the number of pulses output from encoder E3 of main motor M3 is reset to '0' at step S1970, and at the same time, a counting process is started. Further, at step S1980, status S is set to '9' to move the program for an original discharging process.

When, status S is '2', counter PCNTM3*a* which counts the number of pulses output from encoder E3 of main motor M3 is reset to '0', and a counting process is started at step S2020 after the state of on edge of timing sensor SE14 is confirmed at step S2010, in other words, when the leading end of an original is detected by the sensor SE14.

When the state of off edge of timing sensor SE14 is confirmed at step S2030, in other words, when the rear end of an original is detected by the sensor SE14, counter PCNTM3*b* which counts the number of pulses output from encoder E3 of main motor M3 is reset to '0', and at the same time, a counting process is started at step S2020. Then, status S is set to '3' at step S2050.

When status S is '3', main motor M3 is turned off at step S2120 after confirming that a value of counter PCNTM3*b* has reached n13 at step S2110, and electromagnetic brake BRK2 is turned on at step S2130. Then, timer T201 is set at step S2140, status S is set to '4' at step S2250 whereby an odd-numbered original is set at an intermediate waiting position.

When status S is '4', electromagnetic brake BRK2 is turned off at step S2220 after confirming that timer T201 has finished at step S2210, in other words, after transport belt 60 is completely stopped. Then, a judgment is made at step S2230 whether empty sensor SE11 is turned on or turned off. If the sensor SE11 is turned on, flag PARITY is set to '1' at step S2240 since the next original (an even-numbered original) is placed on tray 51, and feed status K is set to '3' at step S2250 whereby a preliminary feed process for the next even-numbered original is started. Further, at step S2260, status S is set to '5'.

On the other hand, when the sensor SE11 is turned off, flag HERASE is set to '1' at step S2270 since the next original (an even-numbered original) is not in tray 51 and the original is the last one transported to an intermediate waiting position. The flag HERASE, when it is '1', indicates that only one sheet of the last original is set at an exposure position, and the information is transmitted to the CPU1. When the flag HERASE is '1', an image of an odd-numbered original only is formed on the first half portion of a copy sheet in the main body of copying machine (the latter half portion of image forming area on photoconductive drum 10 is discharged). Then, main motor M3 is turned on at step S2280, and status S is set to '6' at step S2290 whereby only an odd-numbered original (the last one) is forwarded to an exposure position.

When status S is '5', main motor M3 is turned on at step S2320 after confirming at step S2310 that status K is '20', in other words, if a preliminary feed process for an even-numbered original has already been finished. Then, document discharge status H is set to '1' at step S2330 whereby transport of a second original to an exposure position is started, and a discharging process of an original placed at the exposure position is started simultaneously. Further, at step S2340, status S is set to '6'.

When status S is '6', main motor M3 is turned off at step S2420 when it is confirmed that count value of PCNTM3*a* has reached n7 at step S2410. Electromagnetic brake BRK2 is then turned on at step S2430, and timer T201 is set at step S2420 whereby two sheets of originals (if the last original is an odd-numbered original, the last original only) are placed at an exposure position. Further, at step S2450, status S is set to '7'.

When status S is '7', flag DSET is set to '1' at step S2520 after confirming at step S2510 that timer T201 has finished, in other words, after transport belt 60 has completely stopped. The flag DSET indicates that an original is placed at an exposure position. Then, a judgment is made whether empty sensor SE11 is turned on or not at step S2530. If the sensor SE11 is turned on and there is an original (an odd-numbered original) in tray 51, flag PARITY is reset to '0' at step S2540, and feed status K is set to '3' at step S2550 whereby a preliminary feed process for the next original is started. Further, at step S2560, status S is set to '8'. When the sensor SE11 is turned off and there is no original left in tray 51, counter LST is set to '1' at step S2570, and status S is set to '8' at step S2580.

When status S is '8', flag DCHG is reset to '0' at step S2640 after confirming that flag DCHG is '1' (request for original exchange) at step S2610, feed status K is '20' (completion of a preliminary feed process for an odd-numbered original) at step S2620, and discharge status H is '6' (completion of a discharge process) at step S2630. At step S2650, status S is set to '1' whereby a transport process of an odd-numbered original to an intermediate waiting position is started.

When status S is '9', in other words, when an odd-numbered original is discharged to tray 69 (refer to step S1980), count value (the number of pulses) of counter PCNTM3*a* is compared with the number of pulses (corresponds to short side of A4 size sheet) stored in PSIZE at step S2710. When the count value of the counter PCNTM3*a* reaches the PSIZE, main motor M3 is turned off at step S2720 since the odd-numbered original is discharged form an exposure position and separated from transport belt 60. Electromagnetic brake BRK2 is then turned on at step S2730. Then, timer T201 is set at step S2740, and status S is set to '10' at step S2750. Thereafter, the original is discharged onto tray 69 by reverse/discharge roller 65 and discharge roller 68.

When status S is '10', electromagnetic brake BRK2 turned off at step S2820 after confirming at step S2810 that timer T201 has finished, in other words, after transport belt has completely stopped, and electromagnetic brake BRK2 is turned off at step S2820. Then, a judgment is made whether flag HERASE is '1' or not at step S2830. If the flag HERASE is '0', it means that there is an even-numbered original left on platen glass 29, and therefore, discharge status H is set to '1' at step S2840, and main motor M3 is turned on at step S2850 whereby a discharge process of an even-numbered original is started.

Simultaneously with a timing that main motor M3 is turned on, counter PCNTM3*a* is reset to '0' at step S2860, and a counting process is started. Status S is then set to '11' at step S2870.

On the other hand, when the flag HERASE is '1', counter LST is reset to '0' at step S2890 since an original previously discharged is an odd-numbered last original, and status S is reset to '0' at step S2900 to finish this subroutine.

When status S is '11', in other words, when a discharge process for an even-numbered original is started, main motor M3 is turned off at step S3020 after confirming at step S3010 that a count value of counter PCNTM3*a* has reached PSIZE (the number of pulses corresponds to the length of short side of A4 size sheet), and electromagnetic brake BRK2 is turned on at step S3030. Thereafter, an even-numbered original is discharged onto tray 69 by reverse/discharge roller 65 and discharge roller 68. Further, at step S3040, timer T201 is set, and status S is set to '12' at step S3050.

When status S is '12', electromagnetic brake BRK2 is turned off at step S3120 after confirming at step S3110 that timer T201 has finished, in other words, after transport belt 60 has completely stopped. Then, counter LST is reset to '0' at step S3130, and status S is reset to '0' at step S3140 to finish the present subroutine.

Figure 60:
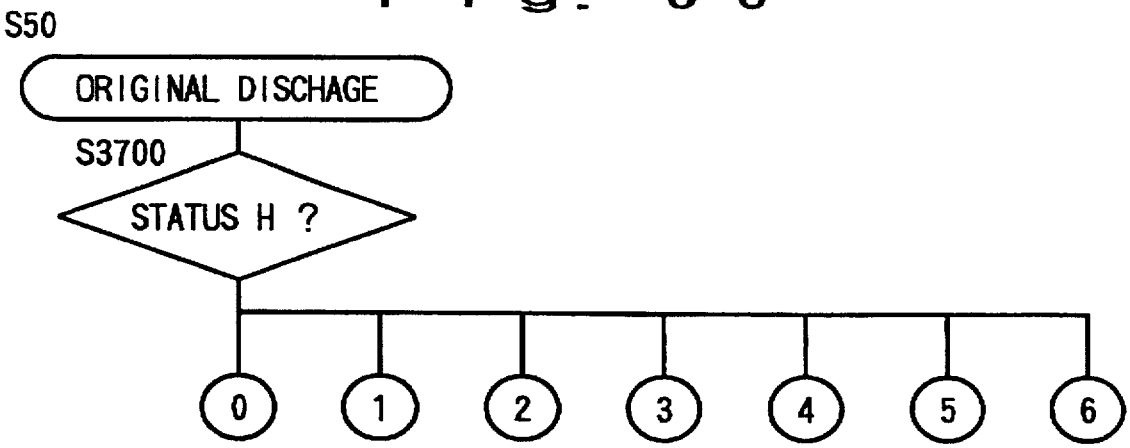
FIG. 60 is a flowchart showing a subroutine of original discharging process in CPU2.
Figure 61:
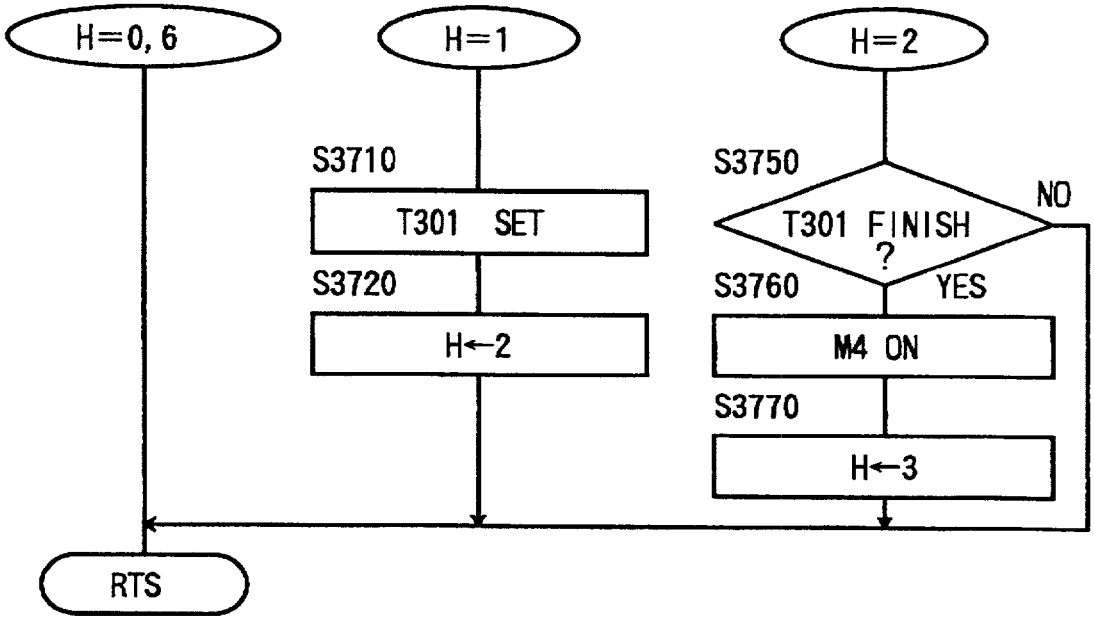
FIG. 61 is a flowchart showing a subroutine of original discharging process in CPU2, continuation of FIG. 60.
Figure 62:
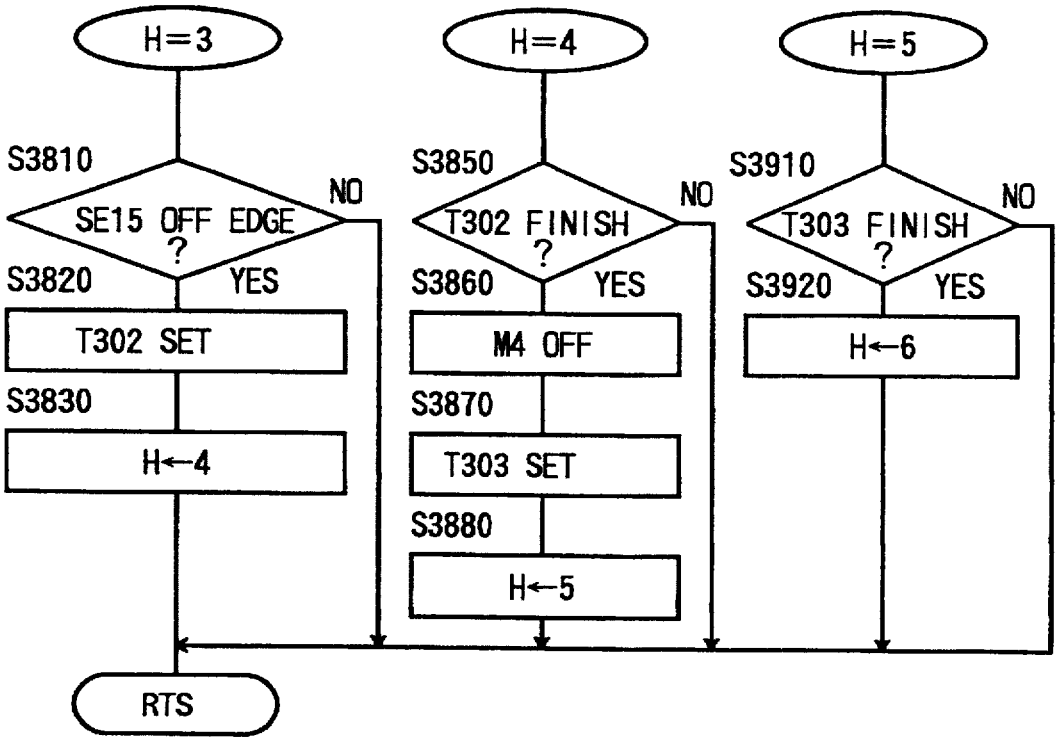
FIG. 62 is a flowchart showing a subroutine of original discharging process in CPU2, continuation of FIG. 61.

FIGS. 60 through 62 show subroutines of original discharge processing which is executed at step S50.

Here in this subroutine, discharge status H is checked at step S3700, and the following processes are performed based on valued '0'–'6'.

When status H is '0', it means a state of initialization, and any action is not taken.

When status H is '1' (when an original is discharged from an exposure position, refer to steps S1930, S2330 and S2840), timer T301 is set at step S3710, and status H is set to '2' at step S3720. The timer T301 is provided for delaying the drive of discharge motor M4 until immediately before the leading of an original reaches reverse/discharge roller 65.

When status H is '2', discharge motor M4 is turned on at step S3760 after confirming at step S3750 that timer T301 has finished, and status H is set to '3' at step S3770. At this stage, reverse/discharge roller 65 and discharge roller 68 starts rotation, and an original is discharged onto tray 69.

When status H is '3', timer T302 is set at step S3820 after confirming at step S3810 that discharge sensor SE15 is at the state of off edge, in other words, after the rear end of an original is detected by the sensor SE15, and status H is set to '4' at step S3830.

When status H is '4', discharge motor M4 is turned off at step S3860 after confirming at step S3850 that timer T302 has finished, in other words, after an original has completely been discharged onto tray 69. Further, at step S3870, timer T303 is set, and status H is set to '5' at step S3880.

When status H is '5', status H is set to '6' after confirming at step S3910 that timer T303 has finished, in other words, when discharge motor M4 has completely stopped.

When status H is '6', any action is not taken, and stand ready for the following process.

An automatic document feeder related to the present invention is not limited to above described embodiments, and it may variably modified within a scope of the present invention.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should ne construed as being included therein.

What is claimed is:

1. A sheet feeding apparatus, comprising:

forwarding means for successively forwarding a plurality of sheets accommodated in a state of stacked layer one by one; said forwarding means is movable between a sheet forwarding position where the forwarding means is brought in contact with the leading end of a sheet for forwarding the sheet and a retracted position where the forwarding means is separated away from the sheet;

transport means for receiving a sheet forwarded by the forwarding means and transporting the sheet in a predetermined direction of transport; and control means for controlling a timing of movement of the forwarding means, wherein said control means forwards a sheet by positioning the forwarding means at a forwarding position and moves the forwarding means to a retracted position after the leading end of the sheet is forwarded by the forwarding means, and further starts moving the forwarding means to the forwarding position for forwarding the following sheet before the rear end of the sheet previously forwarded passes through the forwarding means, and the forwarding means is positioned at the forwarding position after the rear end of the sheet previously forwarded has passed through the forwarding means 2. A sheet feeding apparatus, comprising:

forwarding means for forwarding stacked sheets one by one;

said forwarding means, comprising: a pickup roller movable between a forwarding position where the pickup roller is brought in contact with said stacked sheets and a retracted position separated away from the sheets for forwarding a sheet by giving a transport force to the sheet at the forwarding position; and separating means for receiving sheets forwarded by the pickup roller and separating the received sheets into one sheet for a further transport process;

transport means for receiving a sheet forwarded from the forwarding means and further transporting the sheet; and control means for controlling a timing of the movement of said pickup roller, wherein the control means moves the pickup roller from the forwarding position to the retracted position when the sheet previously forwarded by the forwarding means has reached the transport means, and starts moving the pickup roller to the forwarding position before the rear end of the sheet previously forwarded passes through the pickup roller for forwarding the following sheet, and positions the pickup roller at the forwarding position after the rear end of the sheet previously forwarded has passed through the pickup roller.

3. A sheet feeding apparatus as claimed in claim 2, wherein said control means moves the pickup roller to the forwarding position when the transport of the sheet previously forwarded is started by said transport means.

4. A sheet feeding apparatus, comprising:

means for successively forwarding a plurality of sheets accommodated in a state of stacked layer one by one, said forwarding means movable between a forwarding position where the forwarding means is brought in contact with the leading end of the stacked sheets for forwarding sheets and a retracted position where the forwarding means is separated away from the sheets;

transport means for receiving sheets forwarded by the forwarding means and transporting the sheet toward a predetermined transport direction;

detecting means provided between said forwarding means and said transport means for detecting a sheet forwarded by the forwarding means;

means for controlling the transport of a sheet by controlling said transport means corresponding to a result of a detection conducted by said detecting means; and control means for controlling a timing of movement of said forwarding means, wherein the control means forwards a sheet by positioning the forwarding means at a forwarding position and moves the forwarding means to a retracted position after the leading edge of the sheet is forwarded by the forwarding means, and further starts moving the forwarding means to the forwarding position for forwarding the following sheet before the rear end of the sheet previously forwarded passes through the detecting means.

5. A sheet feeding apparatus as claimed in claim 4, further comprising judging means for judging a sheet jam based on the result of a detection conducted by said detecting means, wherein when a jam is judged, a movement of the forwarding means to a forwarding position is suspended and the forwarding means is moved to a retracted position.

* * * * *